US010253507B1

(12) United States Patent
Bilge

(10) Patent No.: US 10,253,507 B1
(45) Date of Patent: Apr. 9, 2019

(54) SYSTEM FOR MOUNTING WALL PANELS TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 15/488,897

(22) Filed: Apr. 17, 2017

(51) Int. Cl.
*E04F 13/08* (2006.01)

(52) U.S. Cl.
CPC ..... *E04F 13/0892* (2013.01); *E04F 13/0801* (2013.01); *E04F 13/0894* (2013.01)

(58) Field of Classification Search
CPC ..... E04F 13/0892; E04F 13/0894; E04F 13/0801
USPC ..... 52/235, 474, 506.01, 506.06
See application file for complete search history.

(56) References Cited

U.S. PATENT DOCUMENTS 2,591,361 A * 4/1952 Knott ..... E04F 13/0814 52/489.1
2,620,906 A * 12/1952 Ketchum, Jr. ..... E04F 13/0814 24/561
2,857,995 A * 10/1958 Boulton ..... E04F 13/0814 52/489.1
3,235,915 A * 2/1966 Glaser ..... E04B 2/827 52/64
3,561,182 A * 2/1971 Madl ..... E04B 2/96 52/235
3,981,116 A * 9/1976 Reed ..... E04B 9/183 52/506.1
4,181,293 A * 1/1980 Laribee ..... E04F 11/1804 256/67
4,625,481 A * 12/1986 Crandell ..... E04F 13/0889 52/235
4,672,784 A * 6/1987 Pohlar ..... E04B 2/96 52/209
4,768,321 A * 9/1988 Crandell ..... E04F 13/0808 52/235
4,782,635 A * 11/1988 Hegle ..... E04B 2/94 52/126.4
4,850,167 A * 7/1989 Beard ..... E04B 1/0046 52/200
4,936,065 A 6/1990 Hutchinson
4,977,717 A * 12/1990 Niwata ..... E04B 2/967 52/204.593
5,644,878 A 7/1997 Wehrmann
5,720,571 A * 2/1998 Frobosilo ..... E04B 2/96 403/2

(Continued)

*Primary Examiner* — Brent W Herring
(74) *Attorney, Agent, or Firm* — Richard M. Goldberg

(57) ABSTRACT

A system for mounting wall panels to an existing wall, includes a base assembly adapted to be secured to the existing wall; a wall panel securement arrangement adapted to be secured to a wall panel; and an adjustment arrangement for adjustably securing the securement arrangement to the base assembly at a position with three degrees of freedom, the adjustment arrangement including a sliding member slidably received in the base support for movement in a first lengthwise direction of the base support and in a second transverse direction of the base support, the sliding member including two parallel, spaced apart capture walls extending from a central member thereof, and the adjustment positioning member includes an adjustment plate positioned adjustably between the capture walls for adjustment in a direction orthogonal to the first and second directions.

34 Claims, 51 Drawing Sheets

(56) References Cited

U.S. PATENT DOCUMENTS 5,829,216 A * 11/1998 Newcomb ..... E04F 13/0807 52/395
5,846,018 A * 12/1998 Frobosilo ..... E04B 2/96 403/403
5,906,080 A * 5/1999 diGirolamo ..... E04B 2/7453 411/546
6,098,364 A * 8/2000 Liu ..... E04F 13/0855 52/235
6,213,679 B1 * 4/2001 Frobosilo ..... E04B 2/82 403/14
6,226,947 B1 * 5/2001 Bado ..... E04F 13/0805 52/235
6,260,321 B1 7/2001 Rudduck
6,612,087 B2 * 9/2003 diGirolamo ..... E04B 2/767 403/403
6,688,069 B2 * 2/2004 Zadeh ..... E04B 1/2403 52/712
7,043,884 B2 * 5/2006 Moreno ..... E04F 13/0808 52/235
7,104,024 B1 * 9/2006 diGirolamo ..... E04B 2/767 403/231
7,168,213 B2 1/2007 Rudduck et al.
7,174,690 B2 * 2/2007 Zadeh ..... E04B 1/2403 52/712
7,503,150 B1 * 3/2009 diGirolamo ..... E04B 2/96 403/403
7,562,509 B2 * 7/2009 Ness ..... E04F 13/081 52/235
7,926,230 B2 * 4/2011 Yoshida ..... E04F 13/0808 52/235
7,966,783 B2 * 6/2011 Wilson ..... E04F 13/18 52/235
8,033,066 B2 * 10/2011 Griffiths ..... E04F 13/081 52/235
8,127,507 B1 * 3/2012 Bilge ..... E04F 13/0823 52/235
8,240,099 B2 * 8/2012 Hummel, III ..... E04F 13/0892 52/235
8,365,484 B2 * 2/2013 Foley ..... E04B 1/4114 403/403
8,453,388 B2 * 6/2013 Neuhofer, Jr. ..... A47B 96/067 211/94.01
8,468,765 B1 * 6/2013 Kim ..... E04F 13/0835 52/235
8,555,577 B2 10/2013 Maday et al.
8,646,237 B1 * 2/2014 Takagi ..... E04B 1/7629 52/464
8,745,935 B2 * 6/2014 DuPont ..... H02S 20/00 52/173.3
8,769,901 B2 * 7/2014 Todd ..... E04F 13/0805 52/302.1
8,991,127 B2 * 3/2015 Todd ..... E04F 13/0805 52/235
9,010,056 B2 * 4/2015 Ben David ..... E04C 2/543 52/466
9,068,358 B2 * 6/2015 MacDonald ..... E04F 13/0805
9,091,078 B2 * 7/2015 Desch nes ..... E04F 13/0803
9,091,079 B2 * 7/2015 Wright ..... E04F 13/0816
9,540,804 B1 * 1/2017 Farahmandpour .. E04F 13/0801
9,683,367 B1 * 6/2017 Ting ..... E04B 2/965
9,783,993 B2 * 10/2017 Gleeson ..... E04F 13/0853
9,903,123 B1 * 2/2018 Simonsen ..... E04F 13/0814
10,011,997 B1 7/2018 Bilge
10,041,256 B2 * 8/2018 Scully ..... E04F 13/0807
2002/0023405 A1 * 2/2002 Zadeh ..... E04B 1/2403 52/714
2002/0083655 A1 * 7/2002 Paul ..... E04B 9/122 52/105
2002/0083656 A1 * 7/2002 Paul ..... E04B 9/122 52/105
2003/0150179 A1 8/2003 Moreno
2004/0118075 A1 * 6/2004 Zadeh ..... E04B 1/2403 52/715
2004/0194417 A1 * 10/2004 Paul ..... E04B 9/067 52/716.8
2005/0223581 A1 * 10/2005 Hale ..... G01B 3/004 33/758
2006/0016137 A1 1/2006 Ferro
2008/0010927 A1 * 1/2008 Wilson ..... E04F 13/0803 52/387
2008/0134594 A1 * 6/2008 Ness ..... E04F 13/081 52/200
2009/0139176 A1 * 6/2009 Schroeder, Sr. ..... E04B 5/10 52/656.1
2009/0241451 A1 * 10/2009 Griffiths ..... E04F 13/081 52/309.4
2009/0282751 A1 * 11/2009 Orfield ..... B29C 47/0066 52/105
2012/0017530 A1 * 1/2012 Hummel, III ..... E04F 13/081 52/506.05
2012/0096799 A1 * 4/2012 Wright ..... E04F 13/0816 52/578
2012/0186170 A1 * 7/2012 Macdonald ..... E04F 13/0805 52/173.3
2013/0091786 A1 * 4/2013 DuPont ..... H02S 20/00 52/173.3
2013/0205698 A1 * 8/2013 Todd ..... E04F 13/0805 52/302.1
2014/0112698 A1 * 4/2014 Ben David ..... E04C 2/543 403/28
2014/0123585 A1 * 5/2014 Desch nes ..... E04F 13/0803 52/506.05
2014/0260042 A1 * 9/2014 Todd ..... E04F 13/0805 52/489.1
2014/0290166 A1 * 10/2014 Bordener ..... E04F 13/0803 52/474
2015/0308098 A1 * 10/2015 Tessadori ..... E04F 13/0807 52/698
2015/0345152 A1 * 12/2015 Libreiro ..... E04F 13/0848 52/506.05
2016/0153189 A1 * 6/2016 Wright ..... E04B 1/98 52/167.1
2016/0244967 A1 8/2016 Zhou et al.
2016/0369496 A1 * 12/2016 Farahmandpour .. E04F 13/0801
2017/0130464 A1 * 5/2017 Gleeson ..... E04B 1/40
2017/0241133 A1 * 8/2017 Ting ..... E04B 1/41

* cited by examiner

SYSTEM FOR MOUNTING WALL PANELS TO A WALL

BACKGROUND OF THE INVENTION

The present invention relates generally to a wall system, and more particularly, to a system for easily mounting wall panels over an existing wall.

In order to enhance the look of a wall structure, it is known to secure wall panels to the wall structure. However, the securement of wall panels to the wall structure is generally a long and tedious job since it entails using fastening devices such as nails and/or screws to secure the walls panels directly to the wall structure.

When securing the wall panels to an existing wall, precise measurements must be taken and the wall panels must be precisely positioned over the existing wall. This is time consuming and tedious. Further, if a mistake is made as to the positioning of one wall panel, this will affect the positioning of the remaining wall panels, and may result in removing the misaligned wall panels and re-securing these wall panels correctly in position. In addition, no consideration is taken for any unevenness in the existing wall.

It would therefore be desirable to provide wall panels that can be positioned and adjusted on the existing wall during assembly.

SUMMARY OF THE INVENTION

Accordingly, it is an object of the present invention to provide a system and method for easily mounting wall panels over an existing wall that overcomes the aforementioned problems.

It is another object of the present invention to provide a system and method for easily mounting wall panels over an existing wall, while permitting adjustment of the position of the wall panels in three dimensions.

It is still another object of the present invention to provide a system and method for mounting wall panels over an existing wall with exact precision.

It is yet another object of the present invention to provide a system and method for easily mounting wall panels over an existing wall which easily captures and restrains ends of the wall panels.

It is a further object of the present invention to provide a system and method for easily mounting wall panels over an existing wall which allows for thermal expansion of the wall panels.

In accordance with an aspect of the present invention, a system for mounting wall panels to an existing wall, includes a base assembly adapted to be secured to the existing wall; a wall panel securement arrangement adapted to be secured to a wall panel; and an adjustment arrangement for adjustably securing the securement arrangement to the base assembly at a position with at least one degree of freedom.

Preferably, the adjustment arrangement adjustably secures the securement arrangement to the base assembly at a position with three degrees of freedom, and the three degrees of freedom are mutually orthogonal.

In one embodiment, the base assembly includes a base support, and the adjustment arrangement includes a sliding member slidably received in the base support for movement in a first lengthwise direction of the base support. The base support includes at least one opening for receiving a fastening member therethrough to secure the base support to the existing wall. The base support also includes measuring gradations thereon for correctly positioning the sliding member relative to the base support. The sliding member is further slidably received in the base support for movement in a second transverse direction of the base support.

Preferably, the base support includes a base plate and two L-shaped retaining walls extending outwardly from opposite side edges of the base plate, with the base plate being adapted to be secured to the existing wall and each L-shaped retaining wall including a first wall extending orthogonally from a side edge of the base plate and a second wall extending orthogonally inwardly from a free edge of the first wall in parallel, spaced apart relation from the base plate. The sliding member includes a central member, and first and second wing members secured to opposite edges of the central member, with each wing member slidably received within a respective the L-shaped retaining wall; and a distance between opposite free edges of the two wing members is less than a distance between the first walls of the two L-shaped retaining walls to permit sliding movement of the sliding member relative to the base support in the first lengthwise direction and the second transverse direction of the base support. The central member includes at least one threaded opening for receiving an adjusting member therethrough to adjust a distance of the sliding member relative to the base support in a third direction which is orthogonal to the first lengthwise direction and second transverse direction. The central member further includes at least one opening for receiving a fastening member therethrough to secure the sliding member to the base support.

The sliding member includes a central member slidably received within the base support, and at least one capture member extending from the central member; and the adjustment arrangement further includes an adjustment positioning member adjustably connected to the at least one capture member for adjustably moving in a third direction orthogonal to the first lengthwise direction. Preferably, the at least one capture member includes two parallel, spaced apart capture walls extending from the central member; and the adjustment positioning member includes an adjustment plate positioned adjustably between the capture walls in at least an adjustment direction orthogonal to the first lengthwise direction such that at least one securing member is adapted to be secured through the adjustment plate and at least one of the capture walls for securing the adjustment plate to the capture walls. In such case, the sliding member is further slidably received in the base support for movement in a transverse direction of the base support, the transverse direction being orthogonal to the first lengthwise direction and the adjustment direction. Preferably, at least one of the adjustment plate and at least one capture wall, includes at least one opening therein for receiving at least one securing member.

In one modification, the at least one capture member is angularly adjustable relative to the central member.

The adjustment arrangement further includes an adjustment support member connected with the adjustment positioning member; and the wall panel securement arrangement is engaged with the adjustment support member.

Preferably, each wall panel includes a main panel section and L-shaped connecting walls at side edges thereof, and one leg of each L-shaped connecting wall is engaged with the wall panel securement arrangement. In such case, the wall panel securement arrangement includes a retaining wall against which an edge of a wall panel rests, and at least one of a tab and a rod for engaging within an opening at a side edge of the wall panel.

In one modification, the wall panel securement arrangement further includes an adjusting arrangement for adjusting a position in the third direction of the at least one tab relative to the adjustment support member.

Further, each wall panel securement arrangement includes a cover securing arrangement, and a cover adapted to be secured by the cover securing arrangement in a gap between adjacent wall panels. The cover securing arrangement includes spaced apart catch walls extending therefrom, and each cover includes capture walls adapted to be engaged by the catch walls to hold the cover in the gap between adjacent wall panels.

Preferably, the adjustment support member includes a track, and the wall panel securement arrangement includes at least one wall panel sliding support slidably received with the track and including a securement member for securing the wall panel thereto. Each wall panel sliding support includes at least one angled wall for orienting a wall panel secured to the adjustment support member in an angled, three-dimensional manner.

In one embodiment, each wall panel sliding support includes an arrangement for holding a framing stud.

Each wall panel sliding support can be slidably received either within or on a outside of a respective track.

In another embodiment, the adjustment support member includes a platform, and the wall panel securement arrangement includes at least one wall panel support mounted to the platform and including a securement member for securing the wall panel thereto.

In another embodiment, the adjustment support member includes at least one wall panel sliding support slidably received within the base assembly, and the wall panel securing arrangement includes a portion of the base assembly and a portion of the at least one wall panel sliding support to capture a wall panel therebetween, with the base assembly adapted to be secured to the existing wall.

In another embodiment, the wall panel securement arrangement includes at least one connecting panel for connecting together spaced apart adjustment arrangements, and a securing assembly mounted on the at least one connecting panel for mounting each wall panel on the at least one connecting panel.

In one embodiment, each connecting panel includes at least one slot therein, and the securing assembly includes at least one securing member slidably mounted in the at least one slot for securement to a respective wall panel. Preferably, each securing member includes at least one plate or rod for insertion within a respective opening in a wall panel.

In another embodiment, the securing assembly includes at least one bracket member mounted to each connecting panel, and at least one hook member mounted to each wall panel, with each hook member adapted to engage one bracket member for mounting each wall panel to the connecting panels. There is also an adjustment arrangement for adjusting a position of each hook member relative to a respective bracket member on which the hook member is mounted. Preferably, the adjustment arrangement includes at least one adjusting bolt threadedly engaged through each hook member for engagement with a respective bracket member. More preferably, the at least one adjusting bolt includes two adjusting bolts threadedly engaged through each hook member in mutually orthogonal directions for engagement with a respective bracket member for adjusting a position of the respective hook member relative to the bracket member in the mutually orthogonal directions.

In addition, a level measuring device is provided and adapted to be connected with at least one of the wall panel securement arrangement and the adjustment arrangement.

Further, measuring gradations are provided on at least one of the base assembly, wall panel securement arrangement and adjustment arrangement.

The above and other features of the invention will become readily apparent from the following detailed description thereof which is to be read in connection with the accompanying drawings.

DETAILED DESCRIPTION

Figure 1:
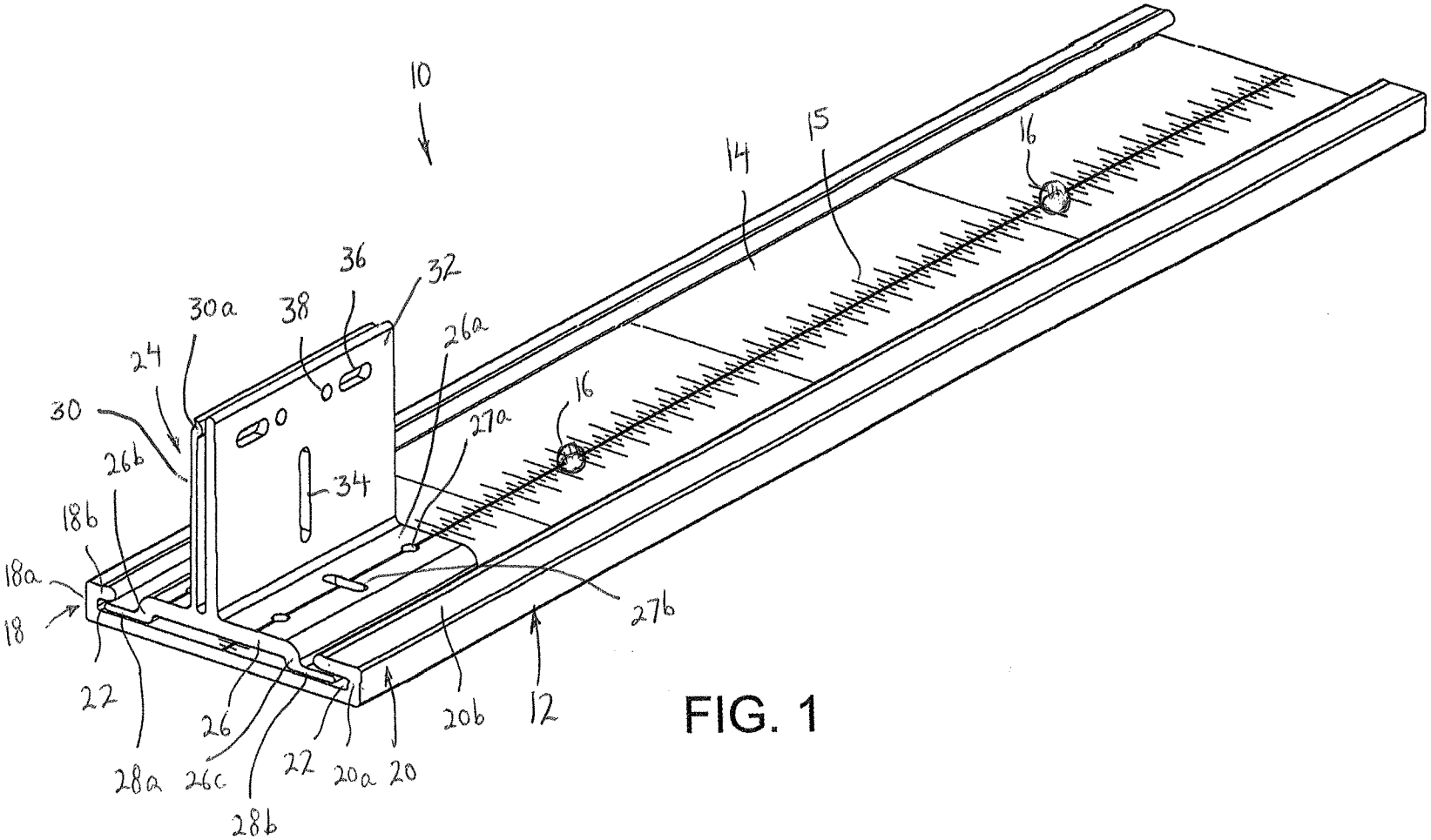
FIG. 1 is a perspective view of the base support and sliding support member of a system for easily mounting wall panels over an existing wall.

Referring to the drawings in detail, and initially to FIG. 1 thereof, there is shown a portion of a system 10 for easily mounting wall panels over an existing wall.

System 10 includes a base assembly including an elongated base support 12 that is adapted to be secured to an existing wall (not shown). Base support 12 includes an elongated base plate 14 having measuring gradations 15 along the upper surface thereof and openings 16 therealong through which screws (not shown) are adapted to extend to secure base plate 14 to the existing wall. L-shaped retaining walls 18 and 20 extend outwardly from opposite side edges of base plate 14. Specifically, each L-shaped retaining wall 18, 20 includes a first wall 18*a*, 20*a* that extends at a right angle from a side edge of base plate 14 and an inwardly extending second wall 18*b*, 20*b* that extends toward the opposite side edge of base plate 14 in parallel spaced apart relation to base plate 14 with a space 22 therebetween. Preferably, inwardly extending second wall 20*b* has a greater width than inwardly extending second wall 18*b*, as show best in FIG. 1C, although the present invention is not limited thereto.

An adjustment arrangement for adjustably securing the wall panels to base support 12 at a position with at least two degrees of freedom, includes a sliding support member 24 slidably retained within base support 12. Sliding support member 24 includes a central member formed by an inverted U-shaped plate 26 that fits in the space between the spaced-apart free edges of second walls 18*b*, 20*b*. Inverted U-shaped plate 26 thereby includes an upper plate 26*a* and two downwardly extending leg plate 26*b*, 26*c* at opposite ends thereof that position upper plate 26*a* in parallel, spaced apart relation from the upper surface of base plate 14. A plurality of threaded openings 27*a* and at least one slot 27*b* extend through upper plate 26*a*.

Wing plates 28*a*, 28*b* extend outwardly from opposite free ends of leg plates 26*b*, 26*c* at the side edges of inverted U-shaped plate 26, with wing plates 28*a*, 28*b* slidably retained in spaces 22. It will be appreciated that the distance between the free end edges of wing plates 28*a*, 28*b* is less than the distance between first walls 18*a*, 20*a* of L-shaped retaining walls 18, 20 so as to permit lengthwise sliding adjustment of sliding support member 24 along a first lengthwise direction of base support 12, while also permitting transverse, side to side sliding adjustment of sliding support member 24 within base support 12 along a second transverse direction, thereby providing two degrees of freedom.

In this manner, adjustment bolts 25 (FIG. 1A) are adapted to be threadedly received within threaded openings 27*a* to engage the upper surface of base plate 14 in order to adjust the height of sliding support member 24 relative thereto. In other words, as bolts 25 are rotated, with the free ends of bolts 25 in contact with the upper surface of base plate 14, sliding support member 24 moves up or down on bolts 25, depending upon the direction of rotation of bolts 25, to thereby raise or lower sliding support member 24. This also causes the upper surfaces of wing plates 28*a* and 28*b* to tightly engage against the underside of second walls 18*b* and 20*b*, respectively, to lock sliding support member 24 in that position. Thereafter, a screw (not shown) can be inserted through each slot 27*b* into base plate 14 and, if desired, into the existing wall, to further lock sliding support members 24 in position. Thus, sliding support member 24 can be locked to base plate 14 after sliding support member 24 has been moved and adjusted in the first lengthwise direction and second transverse direction. Further, slots 27*b* permit further later transverse adjustment by loosening any screws therein, transversely adjusting sliding support member 24 and re-tightening the screws.

Two parallel, spaced apart capture walls 30, 32 extend upwardly at the center of upper plate 26*a*, preferably along the entire length of upper plate 26*a*. The upper end of capture wall 30 includes an inwardly directed lip 30*a*, as best shown in FIG. 1D. Each capture wall 30, 32 preferably includes at least one slot 34 oriented in a third direction which is orthogonal to the first lengthwise direction and second transverse direction, at least one slot 36 oriented in the first lengthwise direction and at least one circular threaded will opening 38.

Although base support 12 has been shown with L-shaped retaining walls 18 and 20, second walls 18*b* and 20*b* can be eliminated.

Figure 1A:
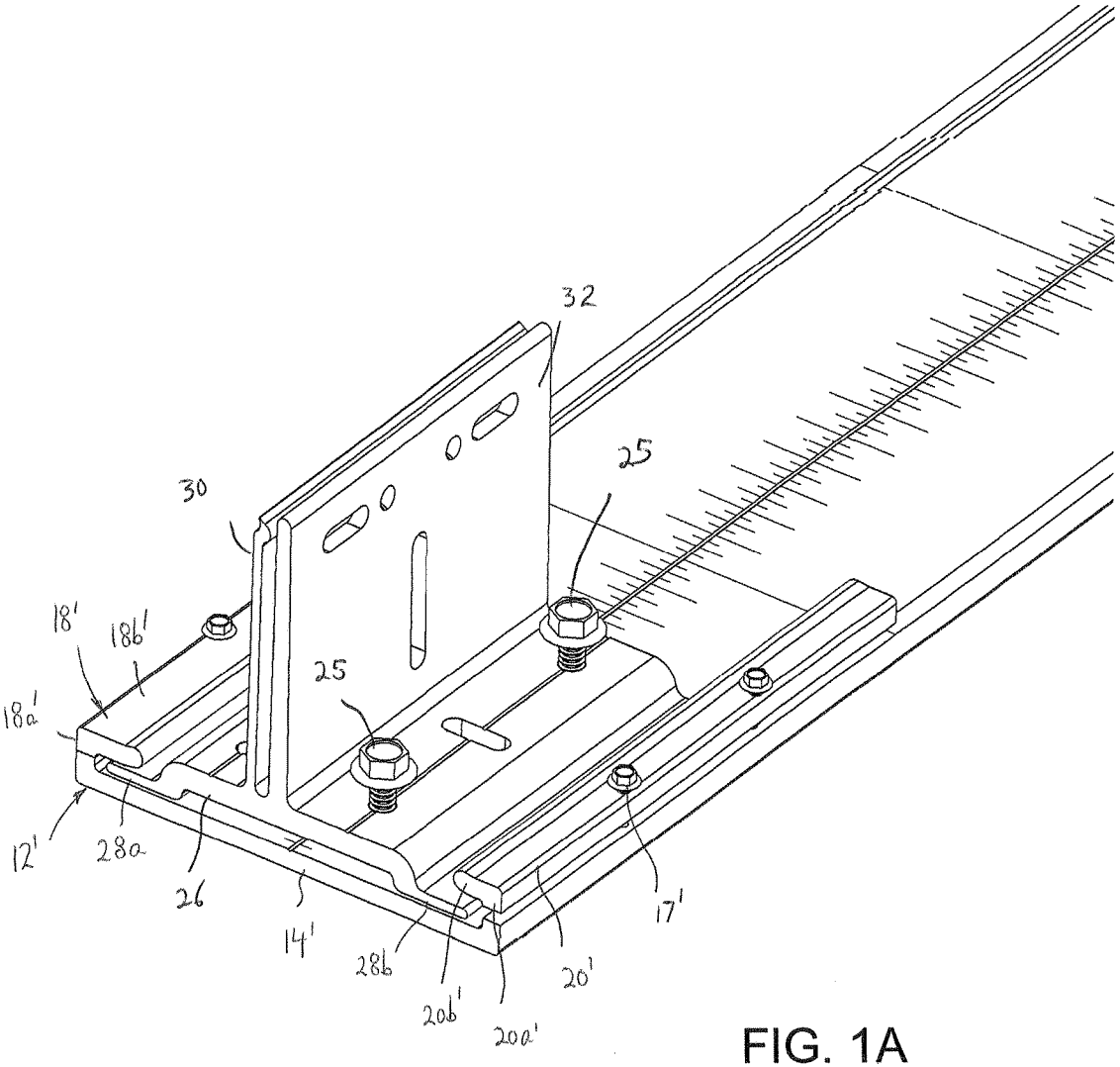
FIG. 1A is a perspective view of a first modified base support with sliding support member.

A first modified base support 12' is shown in FIG. 1A, in which second walls 18*b*', 20*b*' and a portion 18*a*', 20*a*' of the first walls of L-shaped retaining walls 18', 20' are formed separate from base plate 14', and are secured to base plate 14' by screws 17' that provide a small height adjustment of second walls 18*b*', 20*b*' relative to base plate 14' in the aforementioned third direction in order to accommodate different thickness wing plates 28*a*, 28*b* and/or allow for further height adjustment of wing plates 28*a*, 28*b* in a third direction by adjustment bolts 25.

Figure 1B:
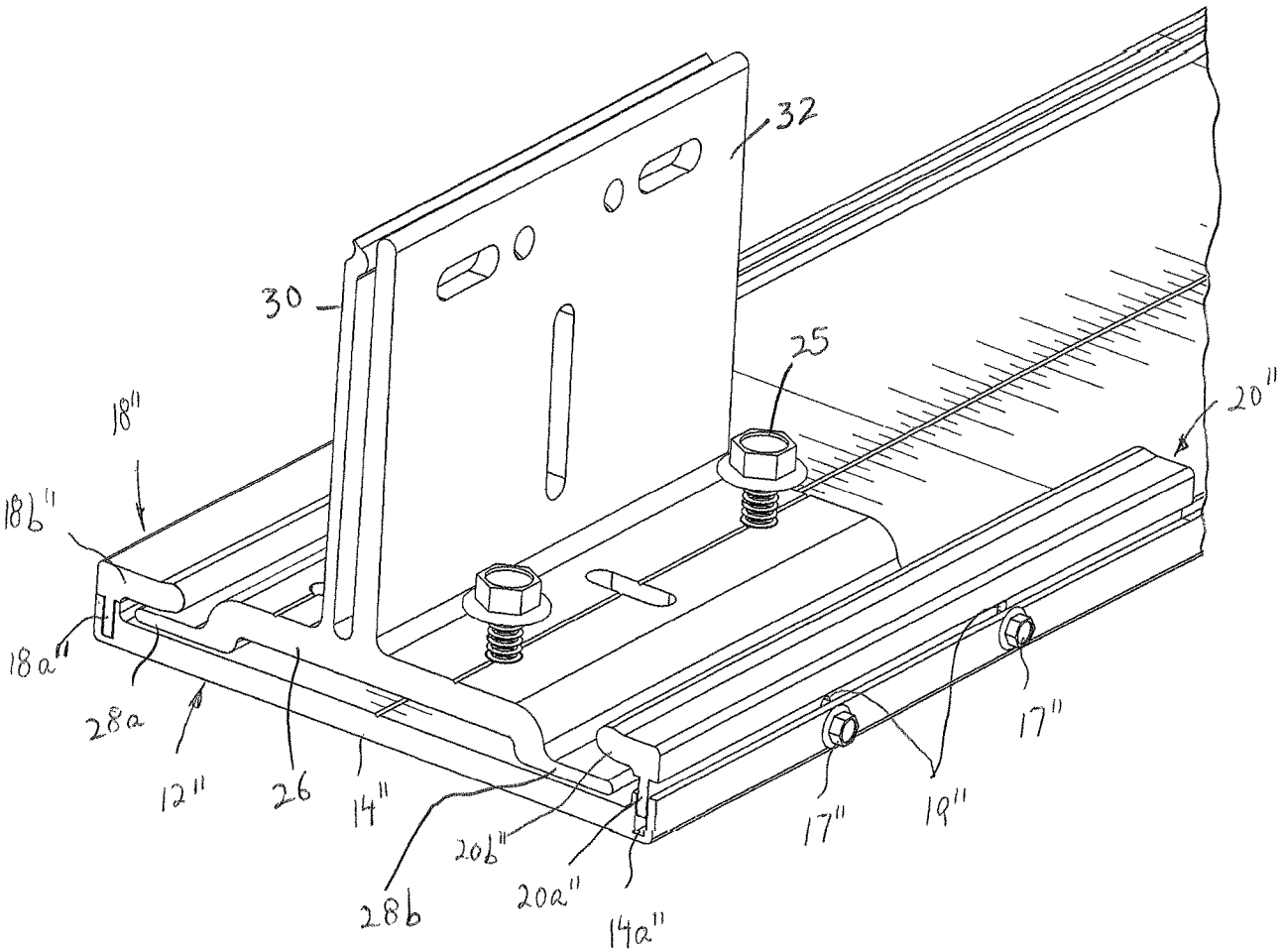
FIG. 1B is a perspective view of a second modified base support with sliding support member.

A second modified base support 12" is shown in FIG. 1B, in which L-shaped retaining walls 18", 20" are formed separate from base plate 14". In this modification, base plate 14" is provided with lengthwise slots 14*a*" along each side edge, and first walls 18*a*", 20*a*" of L-shaped retaining walls 18", 20" fit within slots 14*a*". Each first wall 18*a*", 20*a*" has a plurality of elongated slots 19" extending in the third direction and screws 17" extend through openings in side edges of base plate 14" and extend through elongated slots 19" and are tightened so as to hold L-shaped retaining walls 18", 20" at a small desired adjusted height in the third direction.

Figure 1C:
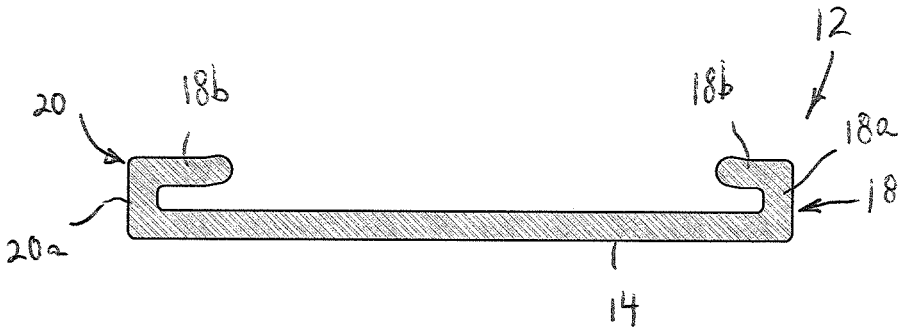
FIG. 1C is a cross-sectional view of the base support of FIG. 1.
Figure 1D:
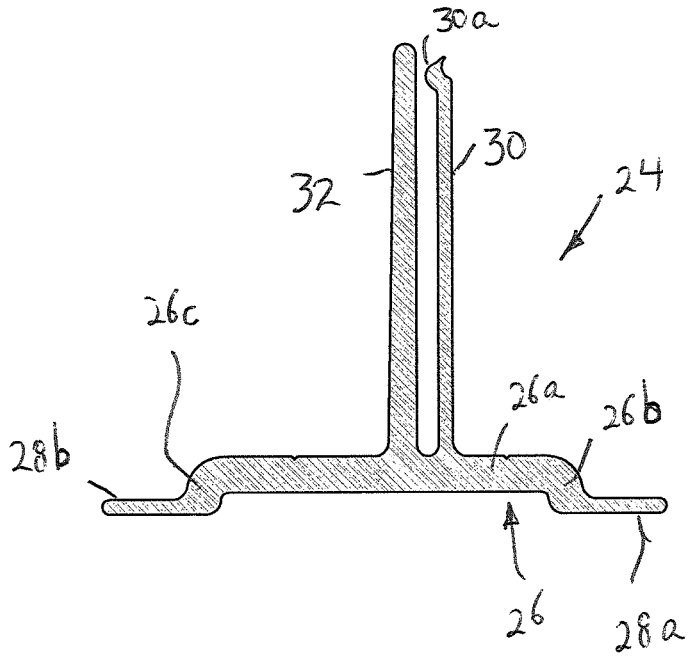
FIG. 1D is a cross-sectional view of the sliding support member of FIG. 1.

As shown best in FIG. 1C, second wall 18*b* is preferably shorter in the second transverse direction than the other second wall 20*b*, and the free ends of each second wall 18*b*, 20*b* are preferably upturned slightly.

Figure 1E:
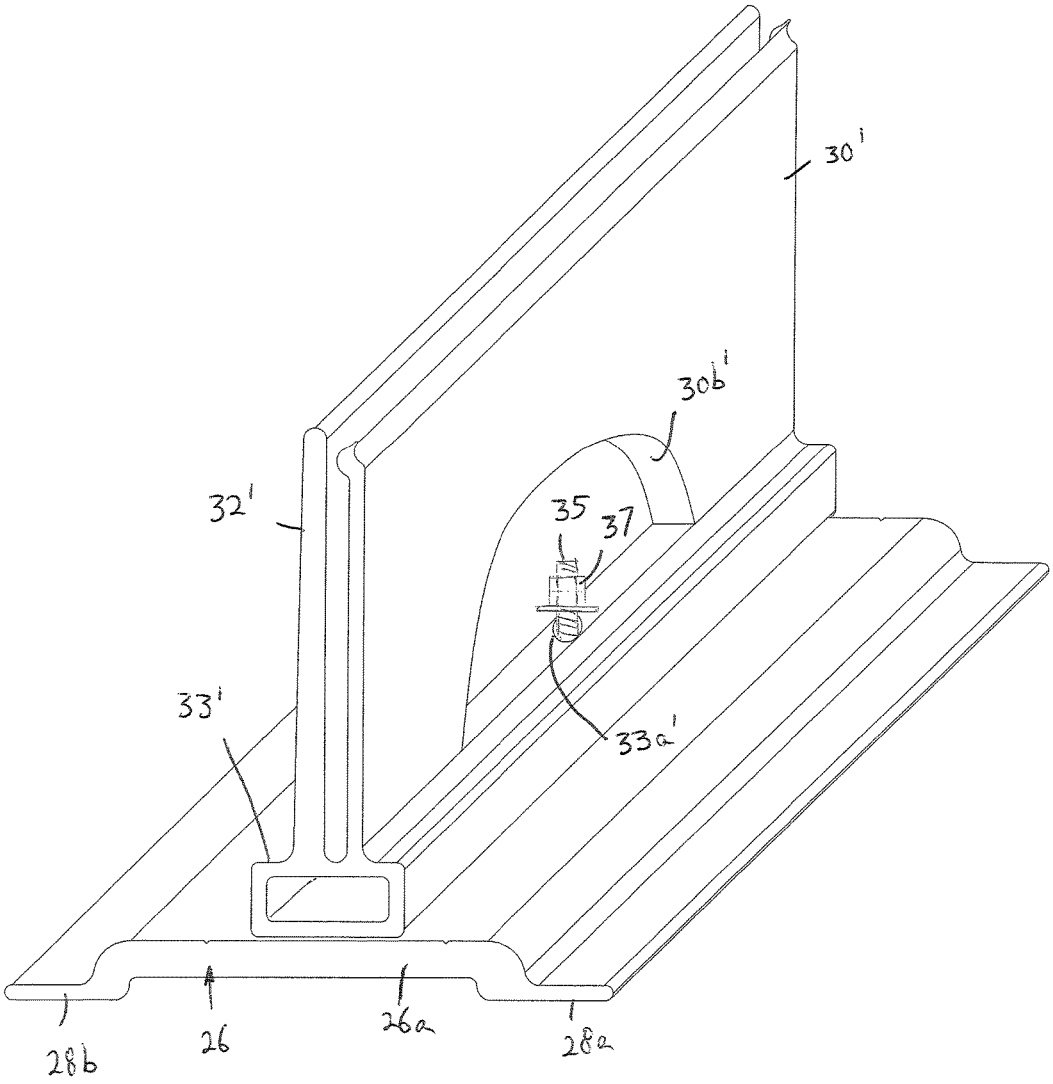
FIG. 1E is a perspective view of a modified sliding support member.
Figure 1F:
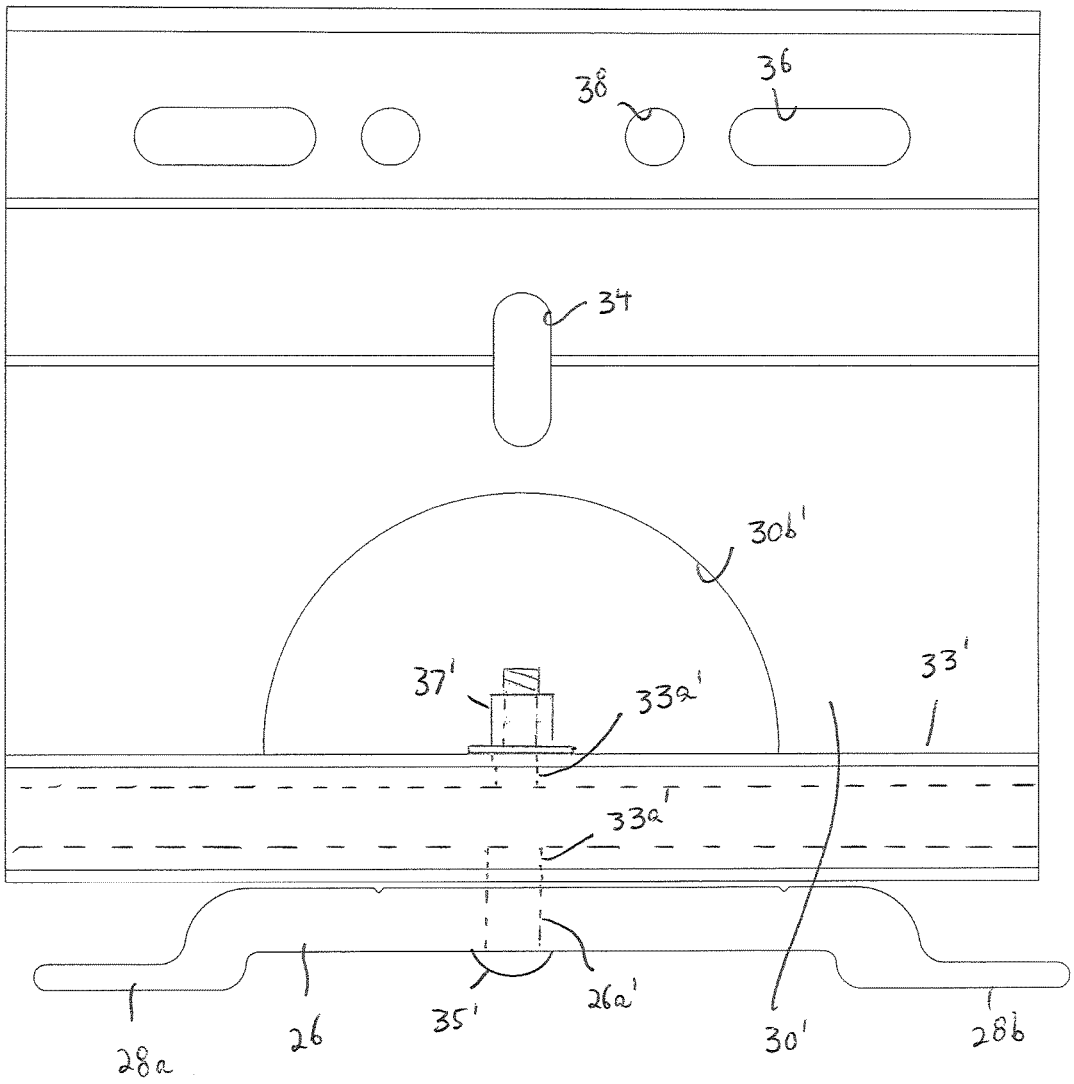
FIG. 1F is a plan view of the modified sliding support member of FIG. 1E.

It will be appreciated that, although sliding support member 24 is shown as a single piece, unitary member, it can be formed from a plurality of parts, for example, as shown in FIGS. 1E and 1F. Specifically, inverted U-shaped plate 26 and wing plates 28*a* and 28*b* are formed as a single, unitary member. Another single, unitary member is formed by capture walls 30' and 32' connected at the lower ends to an elongated hollow rectangular bar 33' that seats in the first lengthwise direction centrally on the upper surface of upper plate 26*a*. Capture wall 30' includes a central arc shaped opening 30*b*', and aligned through openings 33*a*' extend through the upper and lower portions of rectangular bar 33' and which are aligned with an opening 26*a*' through U-shaped plate 26. A bolt 35' extends upwardly through opening 26*a*' and openings 33*a*', and a nut 37' is threateningly connected to bolt 35' so as to secure rectangular bar 33' to U-shaped plate 26. It will be appreciated that this arrangement provides a further degree of adjustment, that is, an angular or rotating adjustment of capture walls 30' and 32' relative to the lengthwise direction of U-shaped plate 26.

Figure 1H:
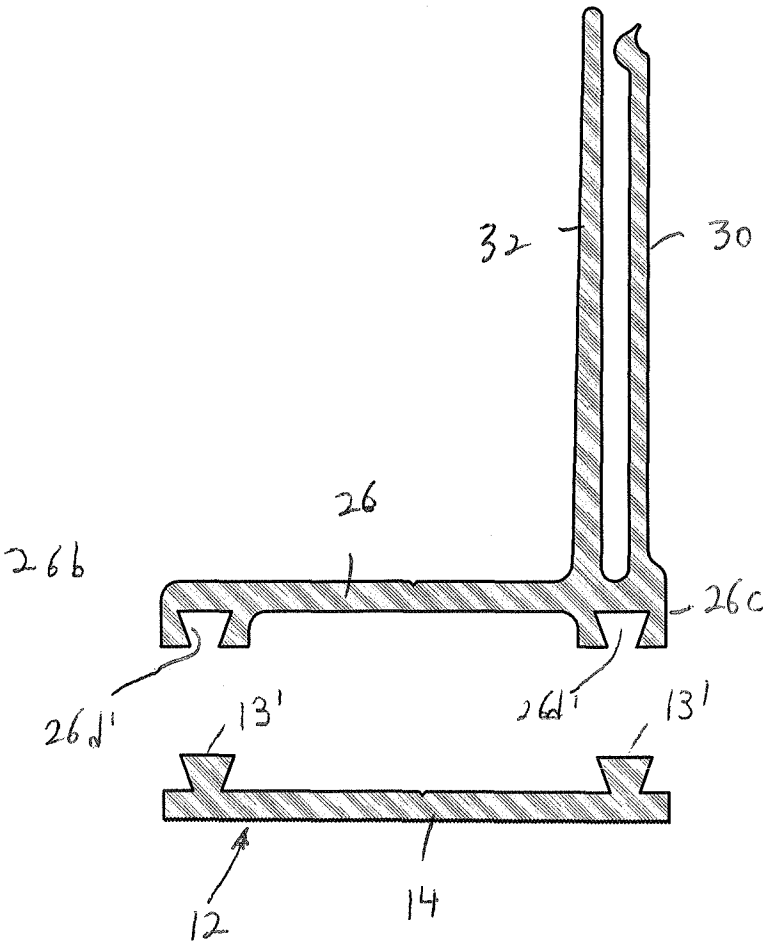
FIG. 1H is a cross-sectional view of a further modified sliding support member.
Figure 1G:
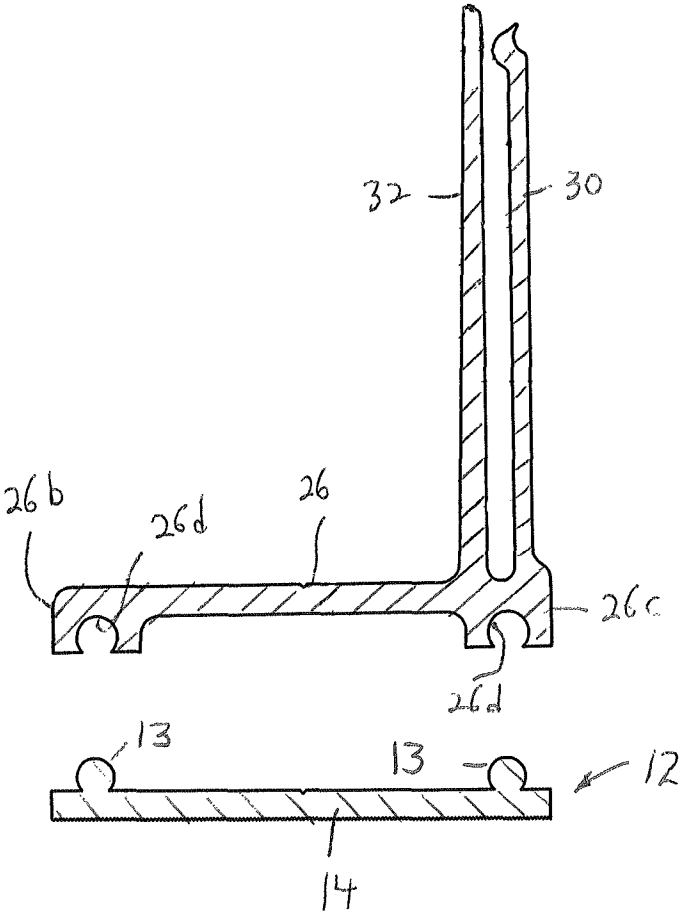
FIG. 1G is a cross-sectional view of a further modified sliding support member.

As another example, as shown in FIG. 1G, wing plates 28*a* and 28*b* are eliminated, and the underside of leg plates 26*b* and 26*c* are provided with elongated part circular openings 26*d*. In such case, L-shaped retaining walls 18 are eliminated from base support 12, with the upper surface of base plate 14 being provided with bulbous projections 13 that are adapted to snap or slide into part circular openings 26*d*. With such arrangement, after projections 13 have been snap or slid fit into openings 26*d*, inverted U-shaped plate 26 can either be permanently fixed, or alternatively, slid, relative to base plate 14. In addition, as shown, retaining walls 30 and 32 are positioned immediately over leg plate 26*c*, rather than being centered on inverted U-shaped plate 26.

FIG. 1H shows a modification in which the part circular openings 26*d* and bulbous projections 13 are replaced with dovetail shaped openings 26*d*' and dovetail shaped projections 13'.

Figure 2:
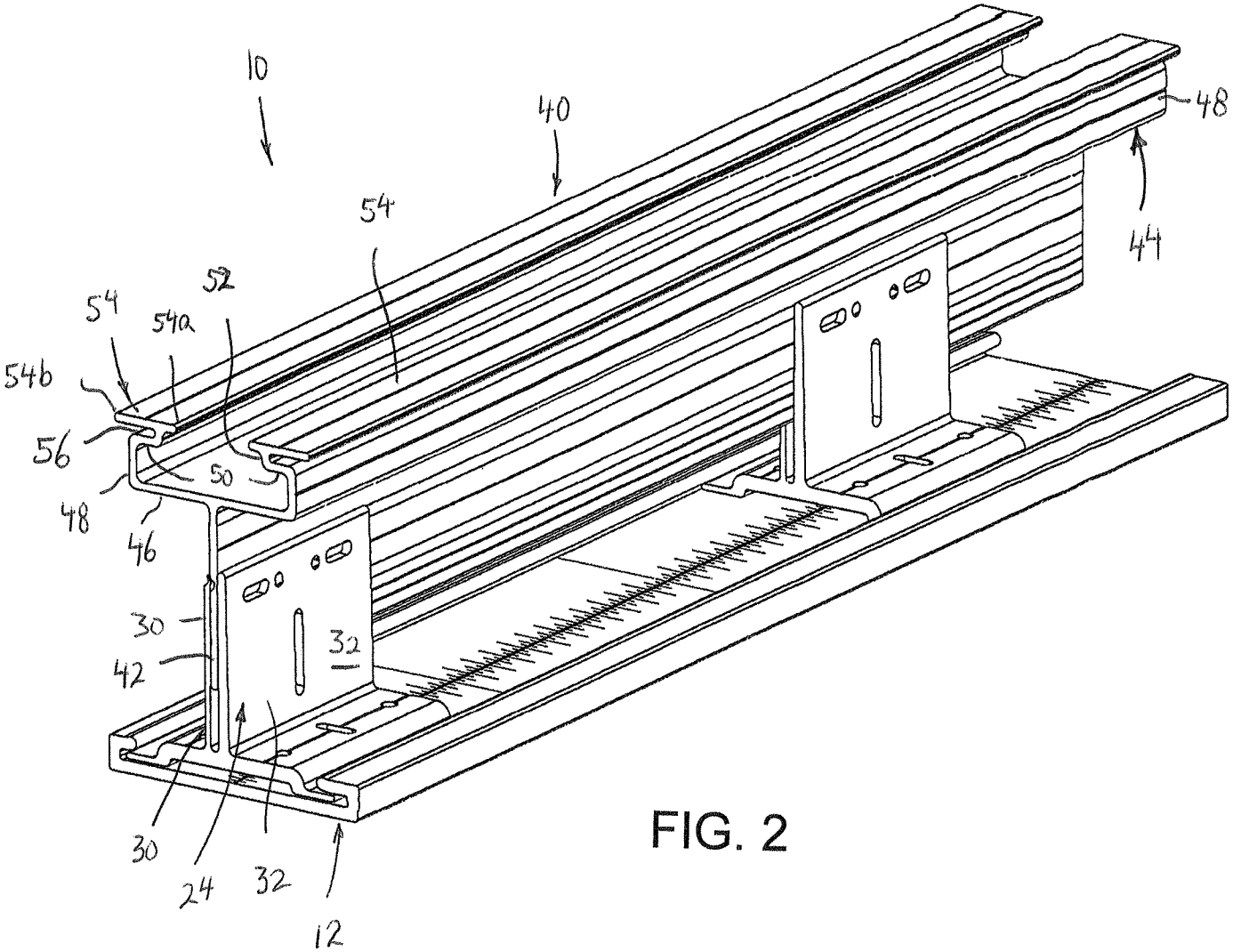
FIG. 2 is a perspective view of an adjustment support member with the assembly of FIG. 1.

As shown in FIG. 2, in order to provide large adjustment in the third direction which is orthogonal to the first lengthwise direction and second transverse direction, an adjustment support member 40 is connected with sliding support member 24 and can be adjusted relative thereto in the third direction which is orthogonal to the first lengthwise direction and second transverse direction.

Specifically, adjustment support member 40 includes an elongated rectangular plate 42 that is dimensioned to fit snugly between capture walls 30 and 32, such that retaining lip 30*a* applies pressure to plate 42. It will be appreciated that plate 42 can be moved in the first lengthwise direction, as well as the third direction which is orthogonal to the first lengthwise direction and second transverse direction, and once positioned at the desired location, is secured in that position by screws extending through at least one of slots 34, 36 and openings 38. Although there are no fixed openings in plate 42, the screws can still pass therethrough. Alternatively, openings can also be provided in plate 42. Further, at any time, the screws can be loosened, plate 42 is then adjusted in position and the screws are retightened. Alternatively, it will be appreciated that slots 34, 36 and openings 38 can be provided in plate 42 instead of, or in addition to, capture walls 30 and 32.

Adjustment support member 40 includes a U-shaped track 44, with an elongated rectangular lower plate 46 and two upstanding, parallel, spaced apart walls 48 extending in the third direction from opposite lengthwise edges of lower plate 46. The opposite free lengthwise edge of rectangular plate 42 is fixed centrally to the lower surface of lower plate 46 in the lengthwise direction thereof, such that when plate 42 is captured between capture walls 30 and 32, lower plate 46 of track 44 is preferably oriented in parallel spaced relation from base plate 14.

U-shaped track 44 further includes inwardly directed walls 50 extending inwardly toward each other from the lengthwise edges of spaced apart walls 48, in parallel, spaced apart relation to lower plate 46. A further elongated stub wall 52 extends in the third direction from the free lengthwise edge of each inwardly directed wall 50. Finally, an elongated retaining wall 54 is connected to the free end of each stub wall 52 and extends in a direction in parallel, spaced apart relation to inwardly directed walls 50. Specifically, each stub wall 52 is connected to each retaining wall 54 at a position slightly spaced from the inner edge thereof such that a first inner portion 54*a* of each retaining wall 54 extends inwardly of the respective stub wall 52 so as to be in parallel, spaced apart relation from lower plate 46, and such that a larger second outer portion 54*b* of each retaining wall 54 extends outwardly of the respective stub wall 52 so as to be in parallel, spaced apart relation from the respective inwardly directed wall 50 with an elongated gap 56 therebetween.

Although not shown in FIG. 2, lower plate 46 of adjustment support member 40 preferably includes measuring gradations thereon similar to the measuring gradations 15. In this regard, reference is made to measuring gradations 715 in FIG. 37. Further, although not shown in FIG. 2, each retaining wall 54 preferably also includes measuring gradations thereon similar to the measuring gradations 15. In this regard, reference is made to measuring gradations 719 in FIG. 37.

Preferably, base support 12, sliding support member 24 and adjustment support member 40 are made of a thermally isolated material such as polyamide, an equivalent thereof or any other suitable material.

With the above arrangement, it will be appreciated that adjustment of the position of the wall panels on an existing wall can occur in the first lengthwise, second transverse and third orthogonal directions by adjustment of sliding support members 24 in base support 12, and in the third orthogonal direction as well as the first lengthwise direction by adjustment of plates 42 in sliding support member 24.

Figure 3:
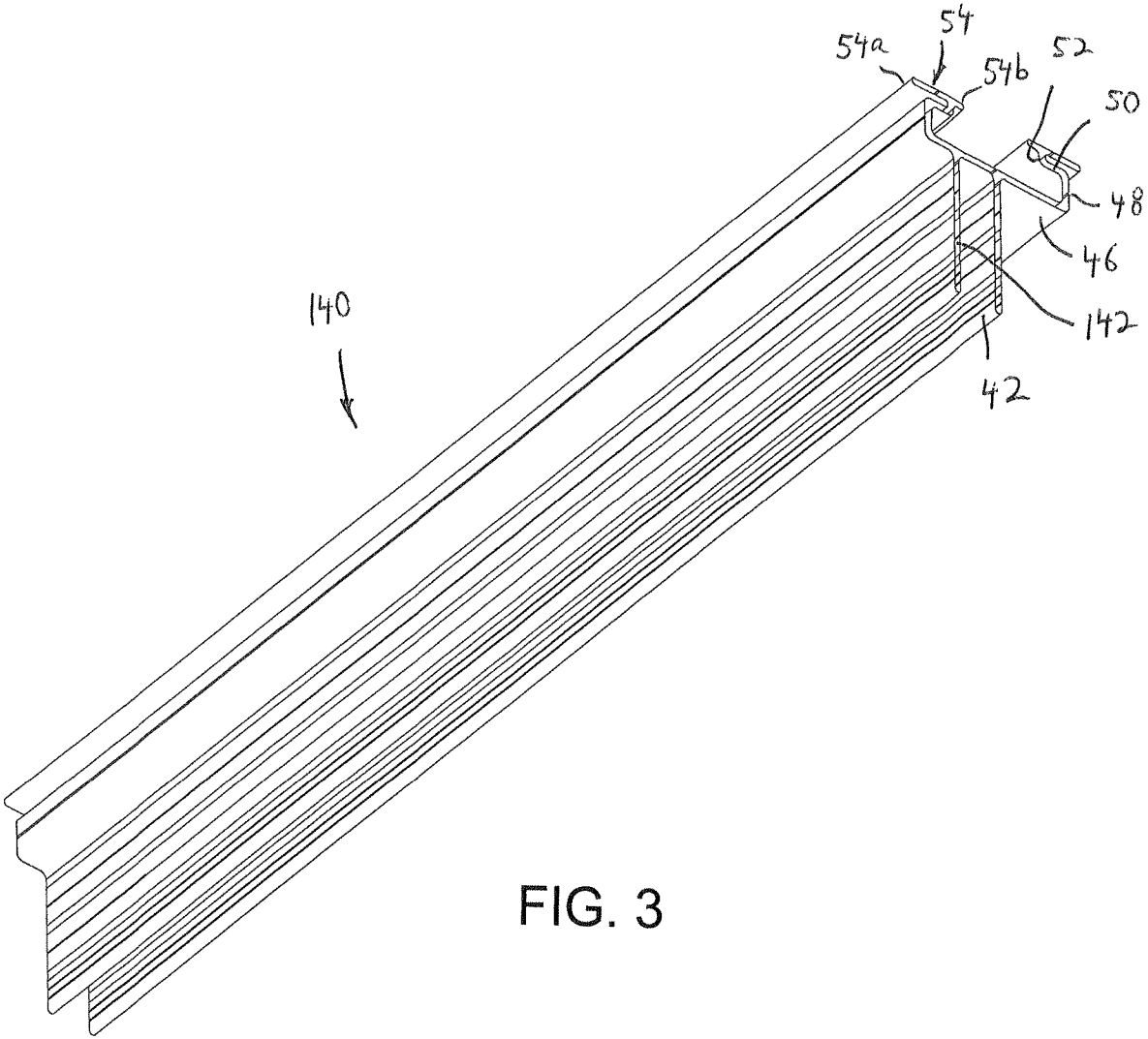
FIG. 3 is a perspective view of a modified adjustment support member.

Referring now to FIG. 3, there is shown a modified adjustment support member 140 which is identical to adjustment support member 40, and the same numerals are provided, except for any differences. Modified adjustment support member 140 provides a second elongated rectangular plate 142 that extends from the underside of lower plate 46 in parallel, spaced apart relation from elongated rectangular plate 42. In this manner, while elongated rectangular plate 42 is positioned between retaining walls 30 and 32, second elongated rectangular plate 142 is positioned to the outside of one of retaining walls 30 and 32, to provide additional securement and stability.

Figure 4:
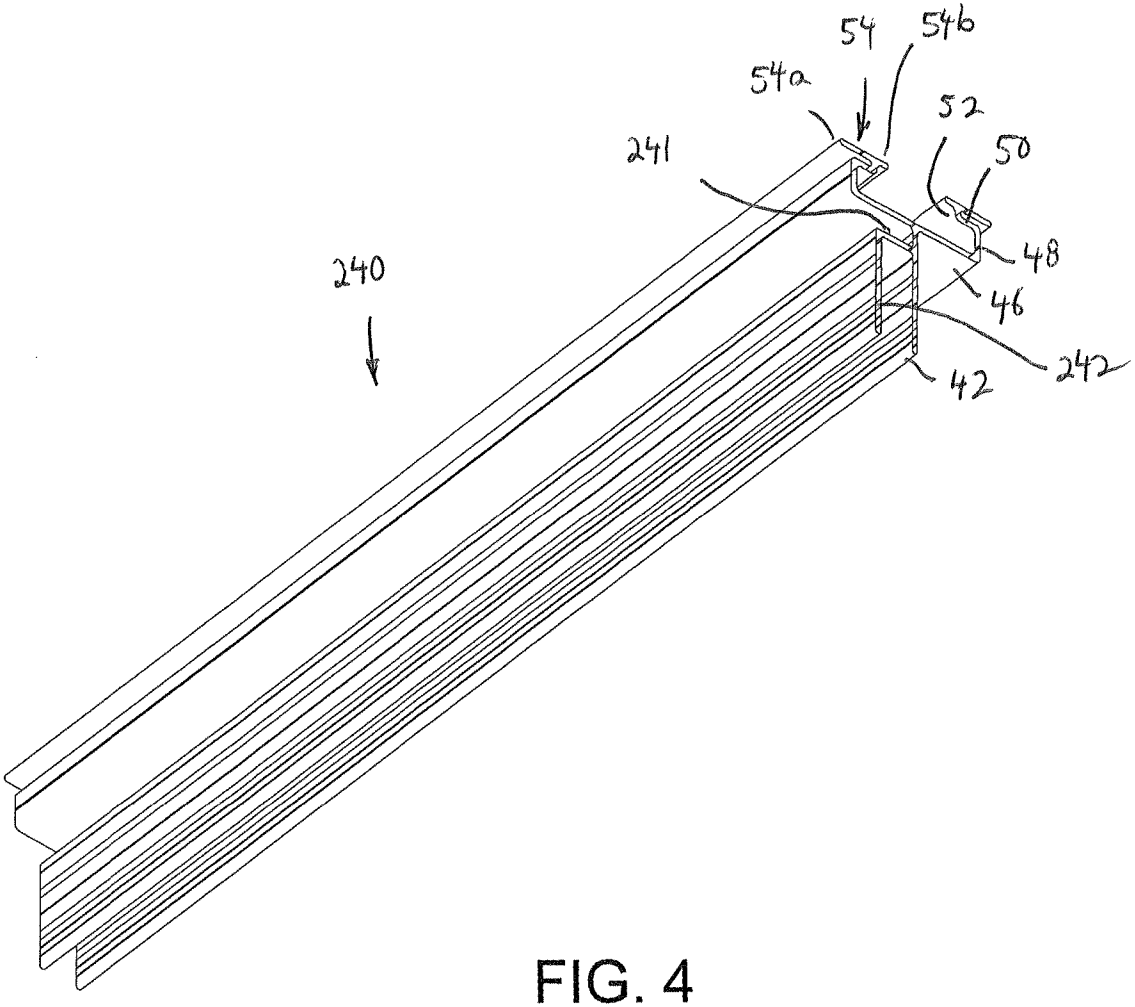
FIG. 4 is a perspective view of another modified adjustment support member.

FIG. 4 shows another modified adjustment support member 240 which is identical to adjustment support member 40, and the same numerals are provided, except for any differences. Modified adjustment support member 240 provides an L-shaped wall connected to elongated rectangular plate 42 at a position spaced slightly below the underside of lower plate 46, and thereby includes a transverse connecting wall 241 and a second elongated rectangular plate 242 that extend from the free end of transverse connecting wall 241 in parallel, spaced apart relation from elongated rectangular plate 42. This arrangement provides additional height adjustability of adjustment support member 40.

One manner of connecting wall panels over an existing wall with the above arrangement, will now be discussed.

Figure 5:
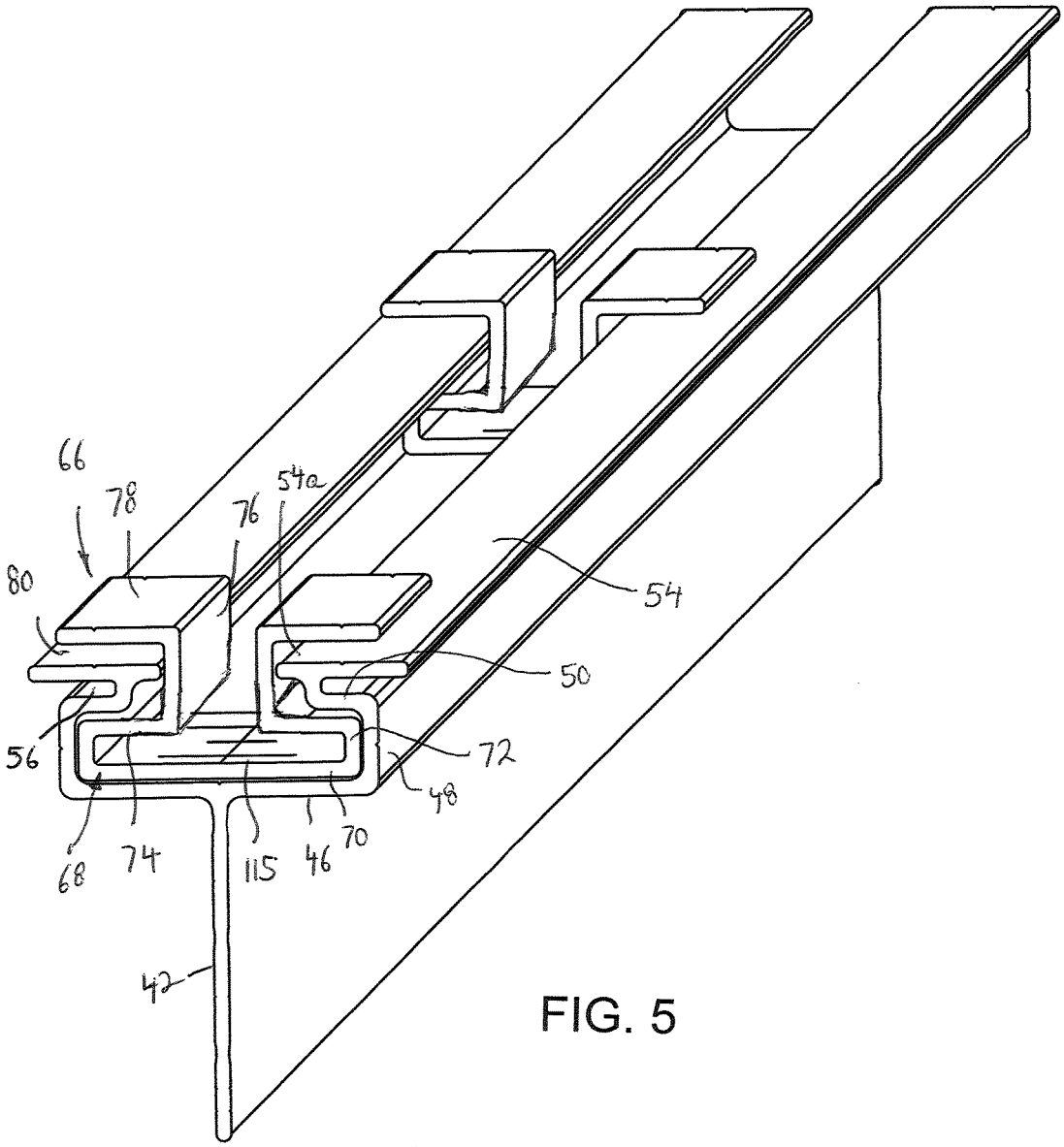
FIG. 5 is a perspective view of the adjustment support member of FIG. 2, assembled with wall panel sliding supports.
Figure 6:
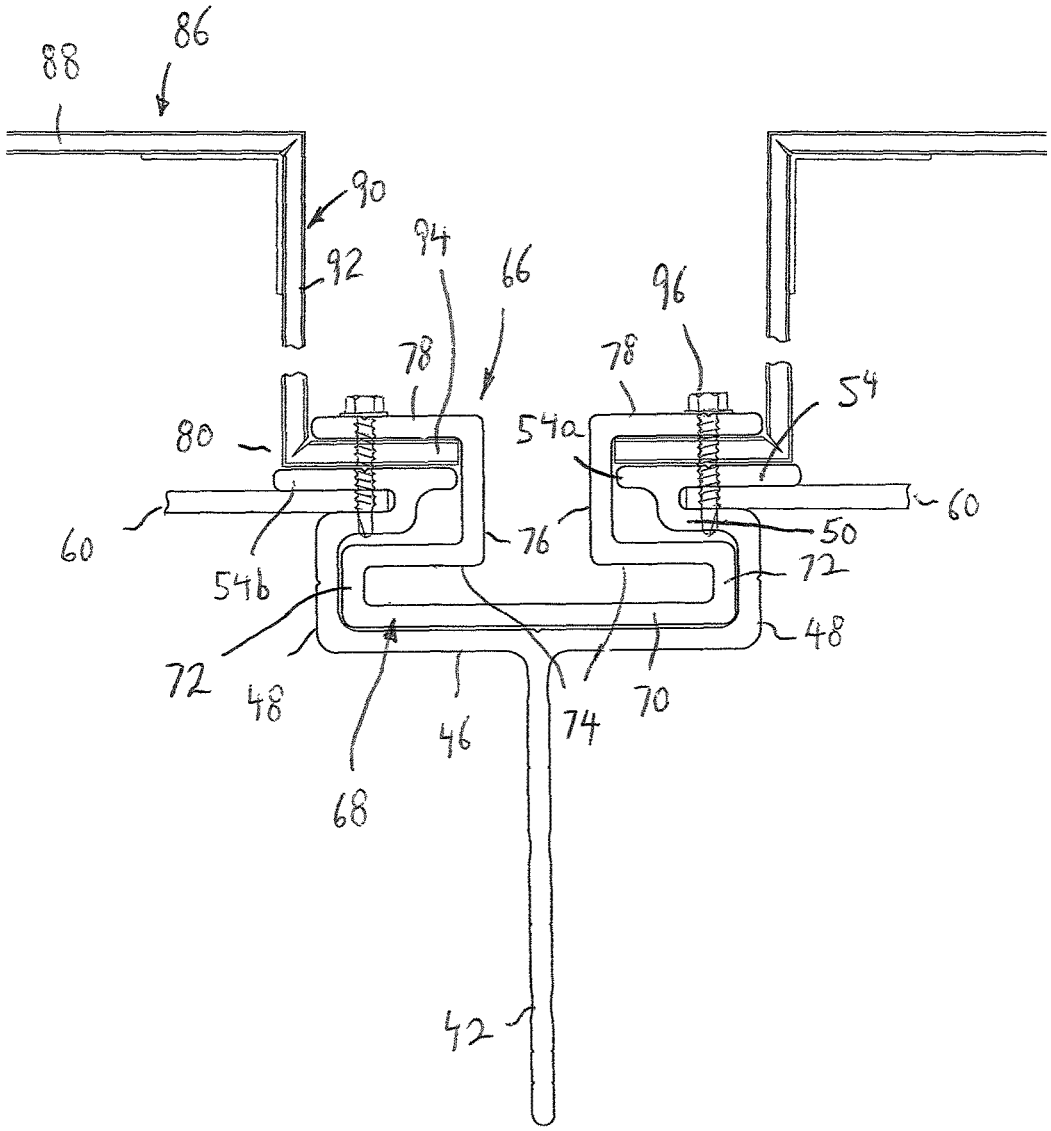
FIG. 6 is a plan view of arrangement of FIG. 5, assembled with wall panels and connecting panels.

Specifically, as shown in FIGS. 5 and 6, wall panel sliding supports 66 are slidably retained in each U-shaped track 44. Each wall panel sliding support 66 includes a U-shaped slide 68 that fits slidably within U-shaped track 44, and includes an elongated rectangular lower plate 70 positioned in sliding engagement on lower plate 46, and two upstanding, parallel, spaced apart walls 72 positioned in parallel, sliding engagement within upstanding walls 48 and extending from opposite lengthwise edges of lower plate 70. Measuring markings or gradations 115 are provided on the upper surface of elongated rectangular lower plate 70 similar to measuring gradations 15.

U-shaped slide 68 further includes inwardly directed walls 74 extending inwardly toward each other from the lengthwise edges of spaced apart walls 72 and positioned in parallel, sliding engagement beneath inwardly directed walls 50, so as to slidably capture U-shaped slide 68 within U-shaped track 44.

Extension walls 76 extend in the third direction from the free lengthwise edge of each inwardly directed wall 74 at a position inwardly of the first inner portion 54*a* of retaining walls 54 such that the opposite lengthwise edges of walls 76 terminate inwardly and are spaced above in the third orthogonal direction from the inner edge of first portion 54*a* of retaining walls 54. A retaining wall 78 is connected to the outer free end of each wall 76 and extends in a direction in the second transverse direction in parallel, spaced apart relation to the respective retaining wall 54 with a space 80 therebetween.

As shown in FIG. 6, connecting panels 60 can be provided to connect together spaced apart adjustment support members 40. Specifically, each connecting panels 60 has one end inserted in a gap 56 of one adjustment support member 40 and the opposite end in a gap 56 of another spaced apart adjustment support member 40.

With this arrangement, wall panels 86 to be secured over an existing wall, include an outer exposed main panel section 88 and inwardly extending L-shaped connecting walls 90 at each edge of outer exposed panel section 88. Outer exposed main panel section 88 is preferably a planar, rectangular panel, although the present invention is not limited thereby, and outer exposed main panel section 88 can have any suitable shape, including a three dimensional shape. Each L-shaped connecting wall 90 includes an inwardly extending bent end wall 92 that extends from an outer edge of a main panel section 88 in the third direction and a securing wall 94 that extends from the opposite free end of inwardly extending wall 92 in a direction parallel but opposite from main panel section 88. Securing wall 94 is inserted within the space 80 between retaining walls 54 and 78. Screws 96 are then inserted through retaining wall 78, securing wall 94, retaining wall 54, connecting panel 60 and inwardly directed wall 50 to secure these elements together, as shown in FIG. 6.

Accordingly, with this arrangement, each wall panel 86 can be adjusted easily in three dimensions to take into account any unevenness in the existing wall or any repositioning that may be required.

Figure 6A:
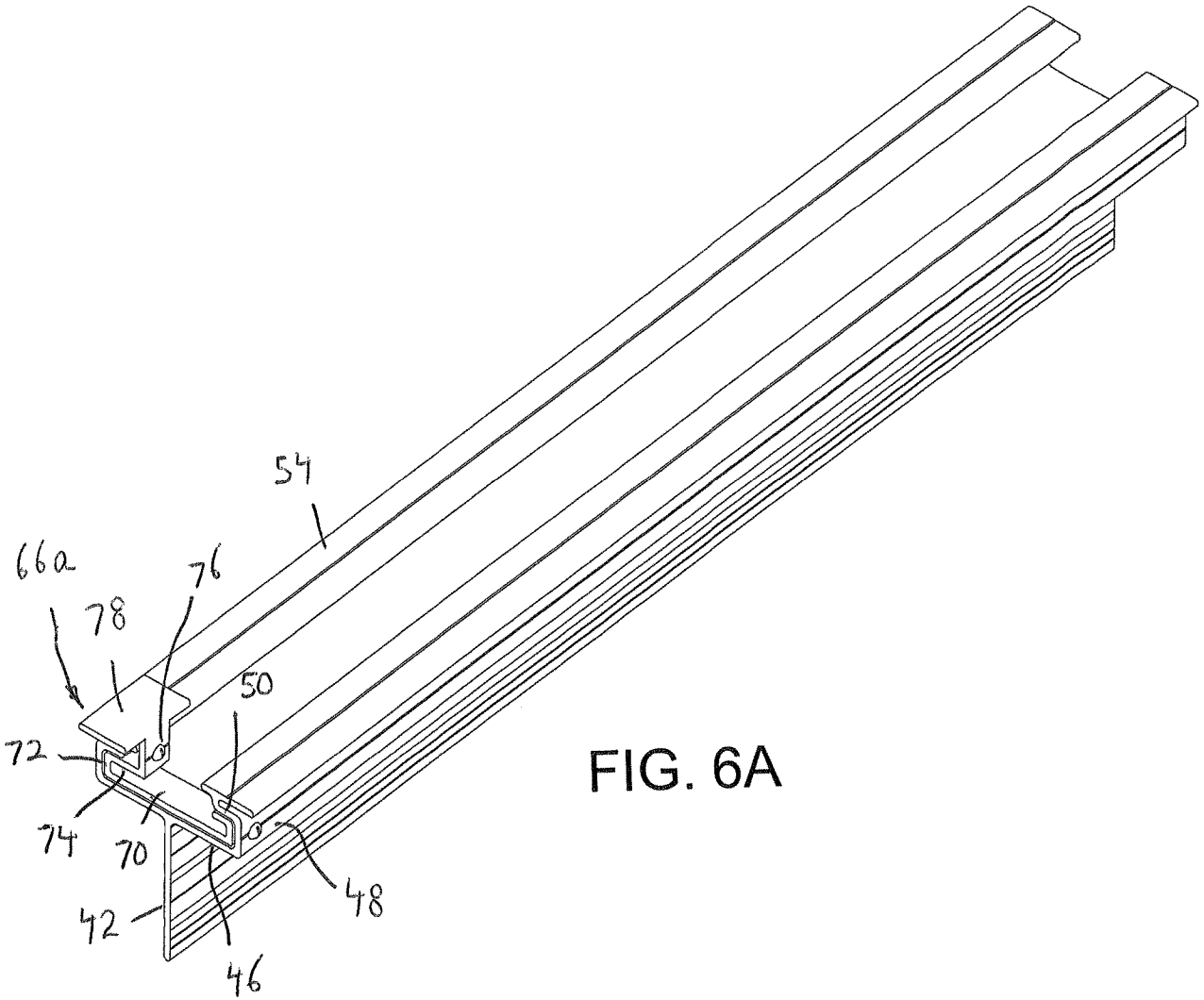
FIG. 6A is a perspective view of the adjustment support member of FIG. 2, assembled with a modified wall panel sliding support.

FIG. 6A shows a modified wall panel sliding support 66*a* in which one extension wall 76 and its corresponding retaining wall 78 are eliminated. Modified wall panel sliding support 66*a* is provided at a corner where only one retaining wall 78 is required.

Figure 7:
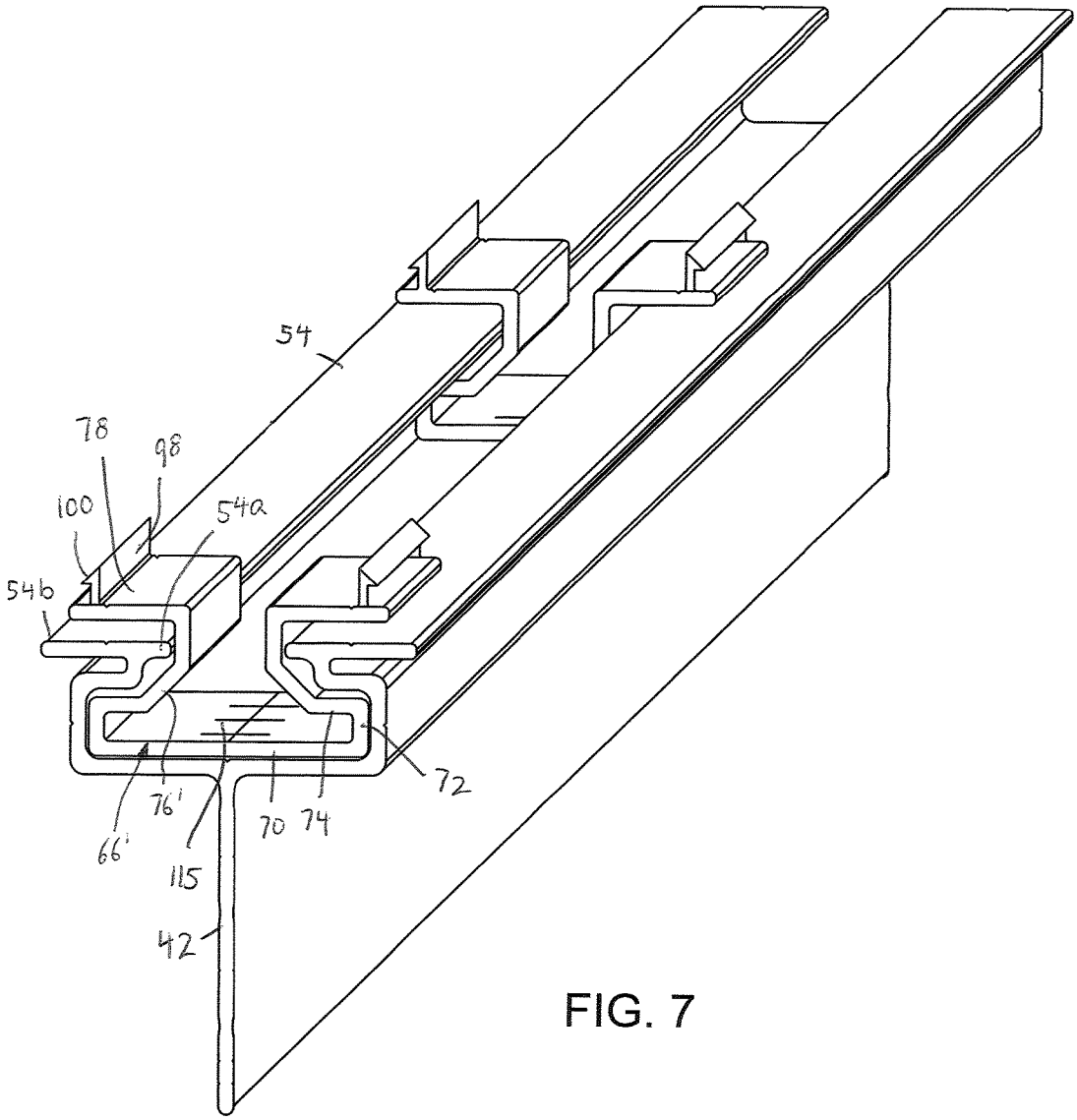
FIG. 7 is a perspective view of the adjustment support member of FIG. 2, assembled with a further modified wall panel sliding support.
Figure 8:
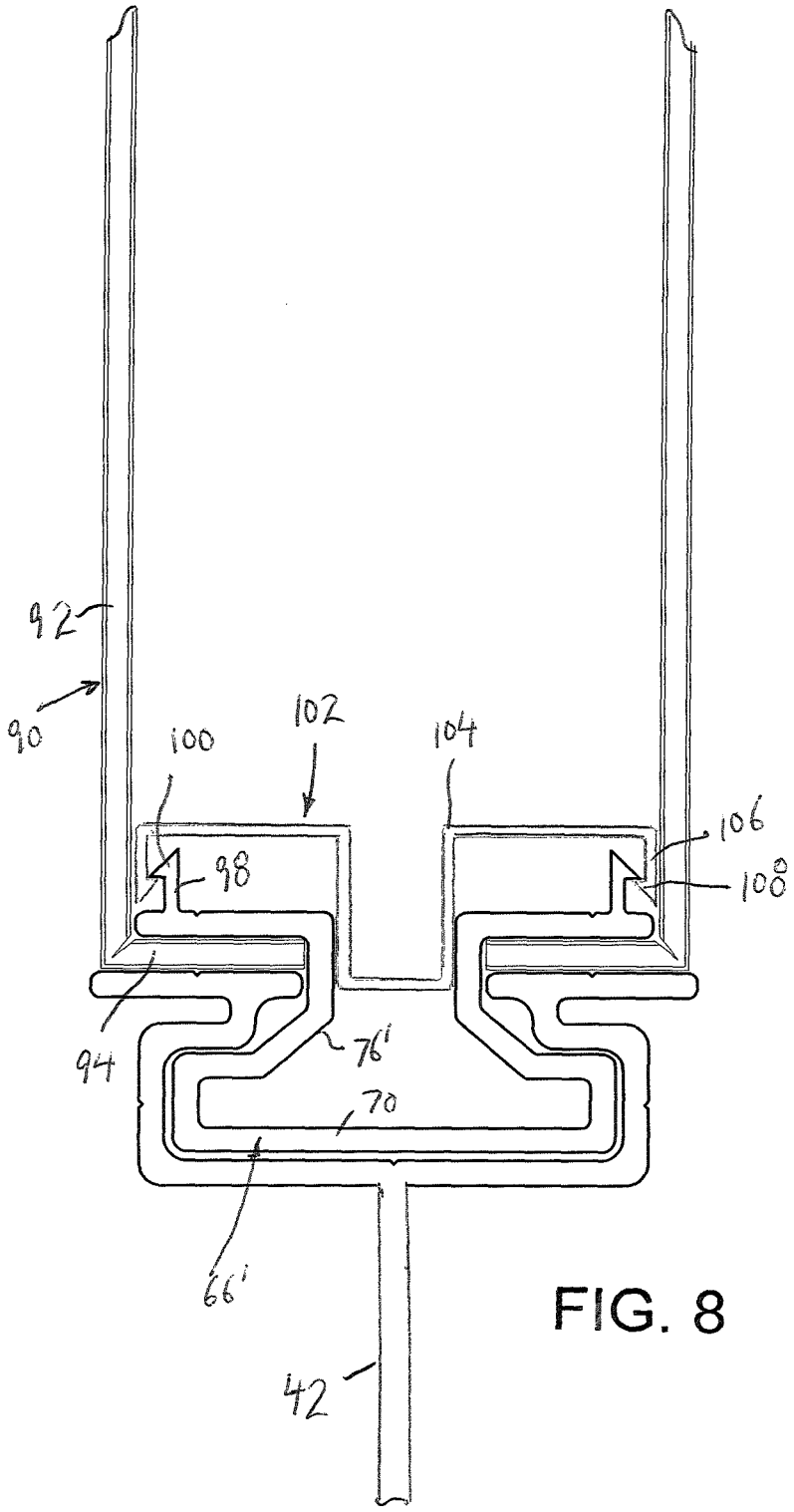
FIG. 8 is a plan view of the assembly of FIG. 7 with wall panels and a cover.

Referring now to FIGS. 7 and 8, modified wall panel sliding supports 66' are shown. Specifically, extension walls 76 are replaced by V-shaped extension walls 76'. More importantly, catch walls 98 extend outwardly from the exposed surface of each retaining wall 78 in the third direction at a position slightly spaced inwardly from the outer free edge thereof. Each catch wall 98 includes an outwardly facing V-shaped catch 100 at the upper end thereof.

A cover 102 having a central section 104 is adapted to be secured in covering relation to wall panel sliding support 66', and includes capture walls 106 at opposite ends thereof, with each capture wall 106 having an inwardly facing V-shaped latch 108 at the free end thereof for engaging with a respective V-shaped catch 100.

Figure 9:
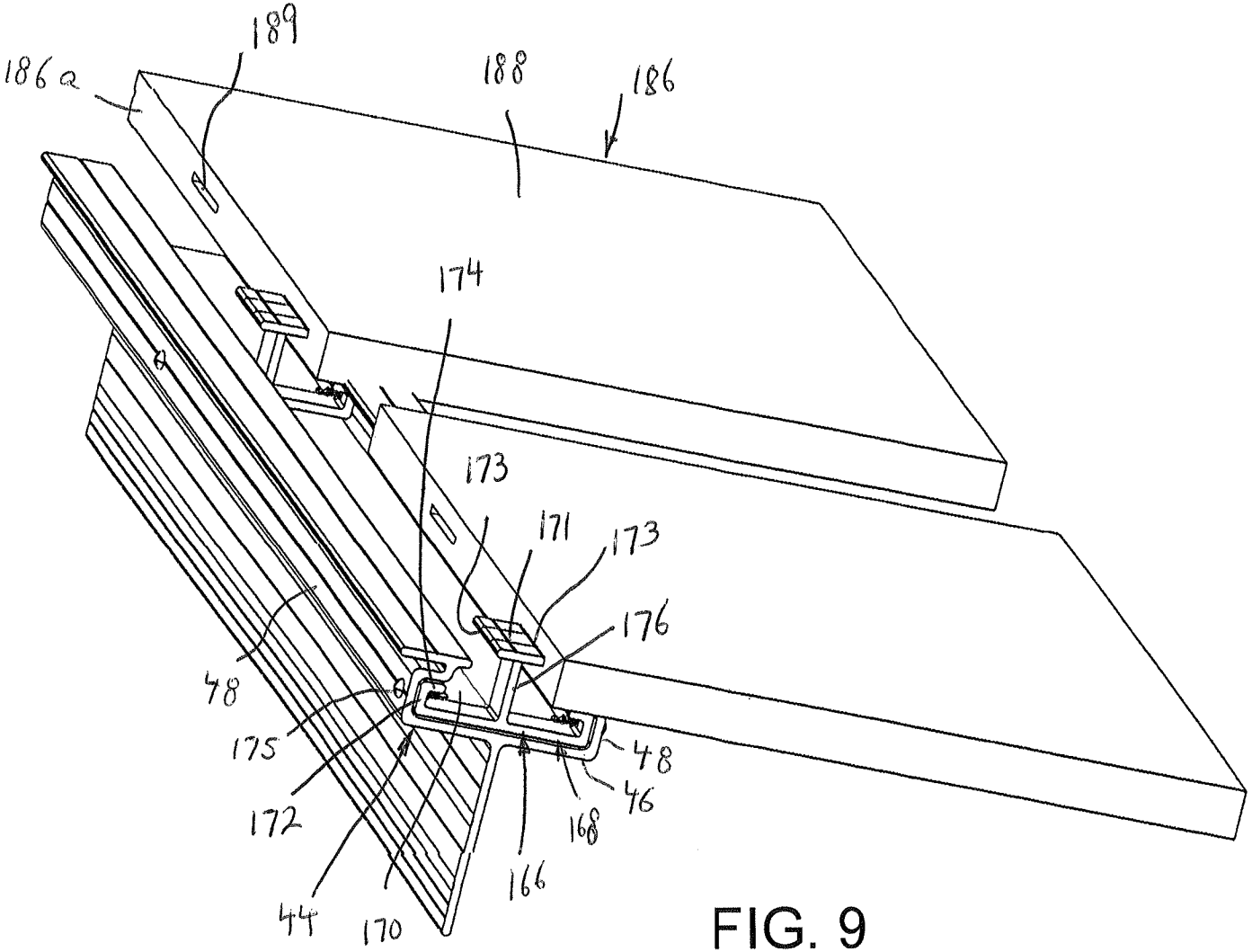
FIG. 9 is a perspective view of modified wall panel sliding supports assembled with the adjustment support member of FIG. 2.

Referring now to FIG. 9, there is shown modified wall panel sliding supports 166 which are slidably retained in U-shaped track 44. Each wall panel sliding support 166 includes a U-shaped slide 168 that fits slidably within U-shaped track 44, and includes an elongated rectangular lower plate 170 positioned in sliding engagement on lower plate 46, and two upstanding, parallel, spaced apart walls 172 positioned in parallel, sliding engagement within upstanding walls 48 and extending from opposite lengthwise edges of lower plate 170. U-shaped slide 168 further includes inwardly directed walls 174 extending inwardly toward each other from the lengthwise edges of spaced apart walls 172 and positioned in parallel, sliding engagement beneath inwardly directed walls 50, so as to slidably capture U-shaped slide 168 within U-shaped track 44.

A single extension wall 176 extends in the third direction from the center of the elongated rectangular lower plate 170, and a rectangular securing plate 171 is mounted centrally to the free end of extension wall 176 so as to define tabs 173 extending to opposite sides of single extension wall 176.

Each wall panel 186 is formed from a single panel member 188 having slots 189 at opposite side edges thereof. With this arrangement, each single panel member 188 has an end thereof seated on top of a respective retaining wall 54, with a tab 173 inserted into a slot 189 in a side wall thereof, in order to retain wall panels 186 in position.

Thus, wall panel sliding supports 166 are slid to desired positions with tabs 173 inserted into slots 189, and screws 175 are screwed through upstanding walls 48 of U-shaped track 44 and upstanding walls 172 of U-shaped slide 168 to lock slides 168 in the desired positions.

It will further be appreciated that each wall panel 186 can be made as a solid panel, or alternatively, as a hollow panel with bent down side walls 186*a* through which slots 189 are provided. It will further be appreciated that, although not shown, there will be measuring markings or gradations on the upper surface of elongated rectangular lower plate 170 similar to measuring gradations 15.

Figure 10:
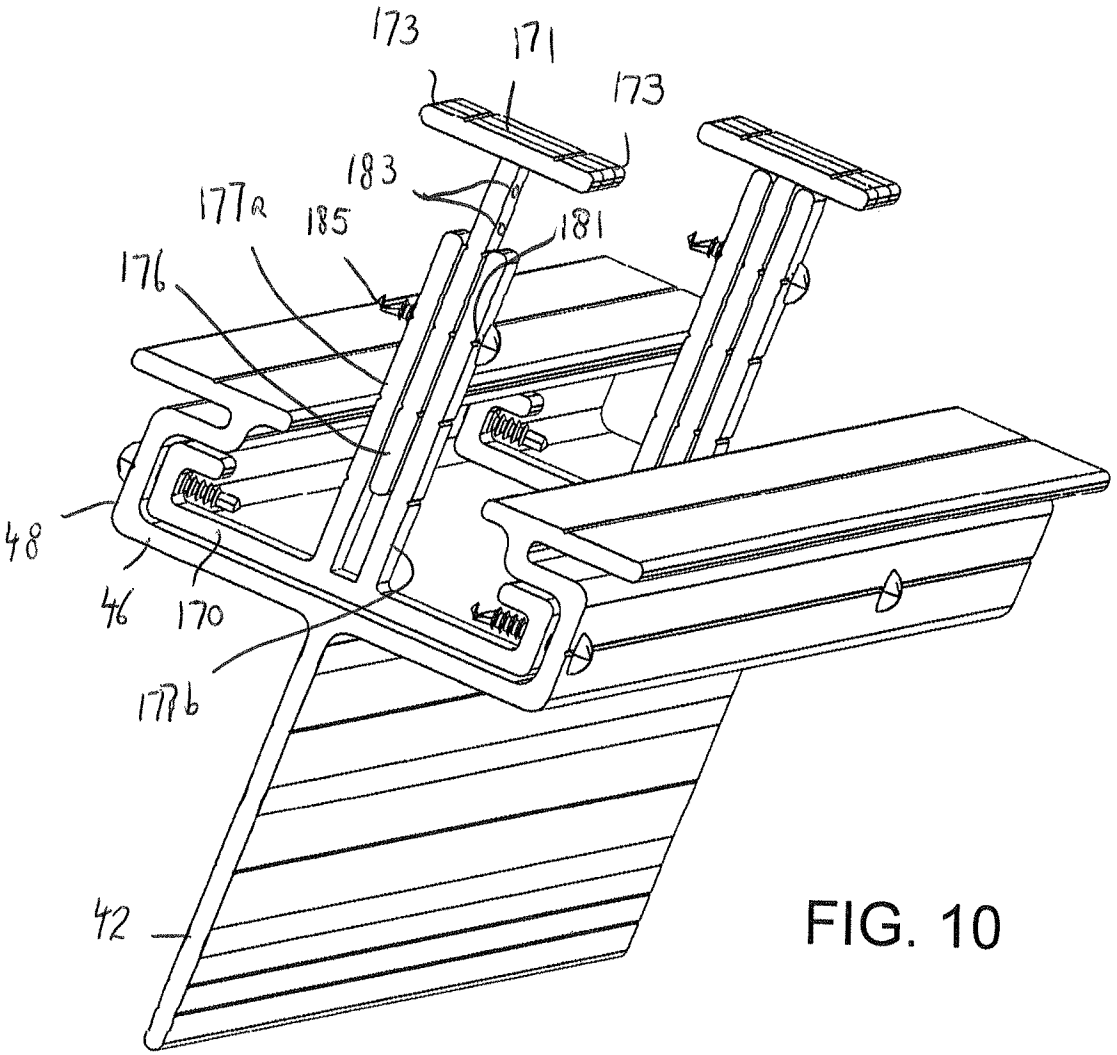
FIG. 10 is a perspective view of further modified wall panel sliding supports similar to those of FIG. 9, assembled with the adjustment support member of FIG. 2.

FIG. 10 shows a modification of the embodiment of FIG. 9 in which adjustability of rectangular securing plate 171 is provided relative to elongated rectangular lower plate 170 of U-shaped slide 168 in the third orthogonal direction.

Specifically, two parallel, spaced apart extension walls 177*a* and 177*b* extend outwardly in the third direction from the center of elongated rectangular lower plate 170, and have aligned openings 181. A single extension wall 176 is slidably positioned between extension walls 177*a* and 177*b*, and includes a plurality of spaced apart openings 183 therealong. Single extension wall 176 can be selectively secured at a desired height by adjusting the position of single extension wall 176 between extension walls 177*a* and 177*b*, and then secured in that position by a bolt 185 extending through aligned openings 181 and 183. Rectangular securing plate 171 is mounted centrally to the free end of single extension wall 176 so as to define tabs 173 extending to opposite sides of single extension wall 176.

It will be appreciated that other means for connecting the wall panels to the wall panel sliding supports can be provided.

Figure 11:
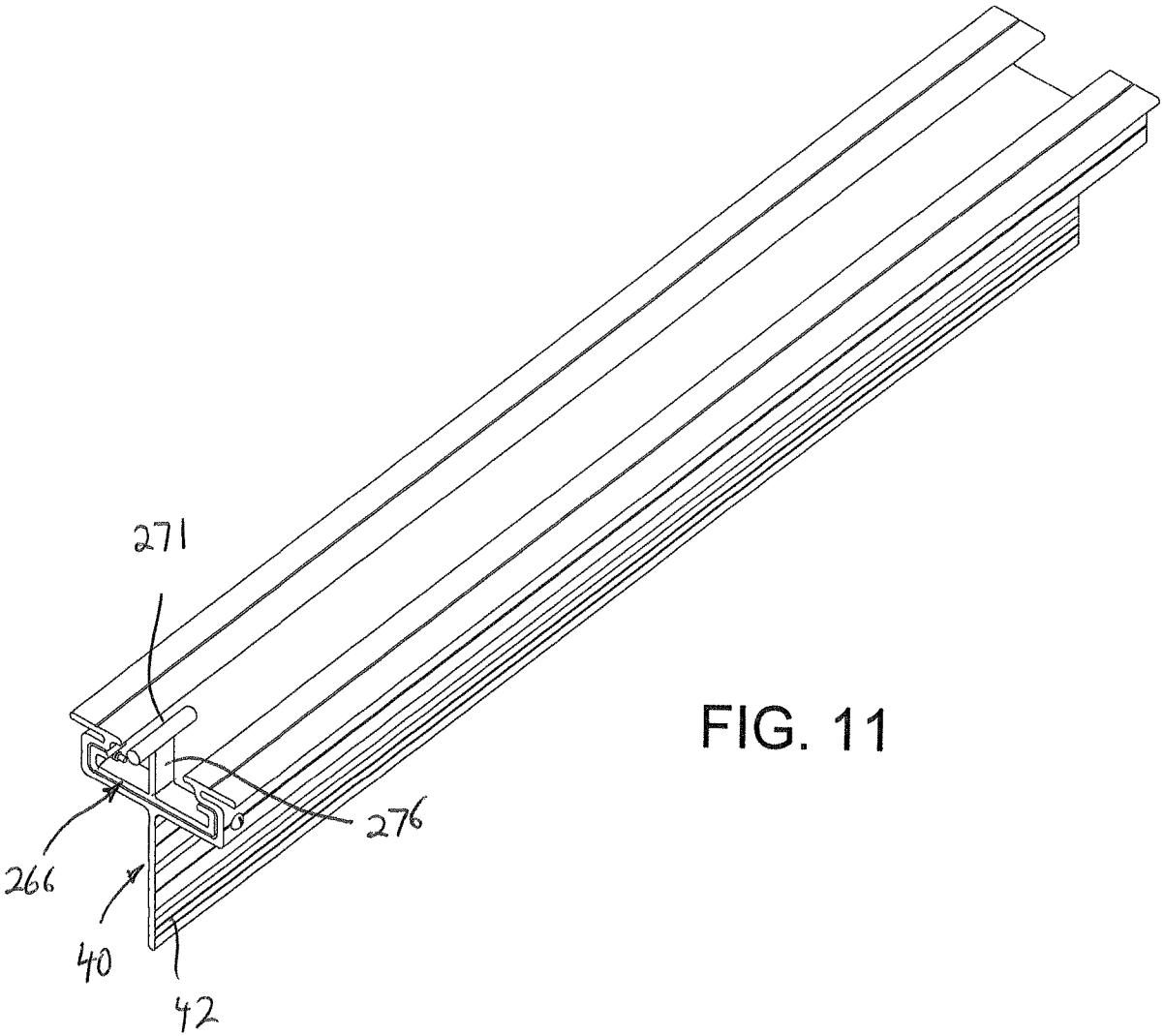
FIG. 11 is a perspective view of still further modified wall panel sliding supports similar to those of FIG. 9, assembled with the adjustment support member of FIG. 2.

For example, as shown in FIG. 11, a wall panel sliding support 266 is shown which is identical to wall panel sliding support 166 of FIG. 9, except that rectangular securing plate 171 is replaced with a rod 271 at the upper end of single extension wall 276, with rod 271 extending in the first lengthwise direction. With this arrangement, the wall panels would include circular openings (not shown) in place of rectangular slots 189 for receiving the ends of rod 271. It will be appreciated that the wall panels 186 will therefore be oriented perpendicular to the arrangement shown in FIG. 9 in order for the ends of the rod 271 to be inserted into the circular openings.

Figure 12:
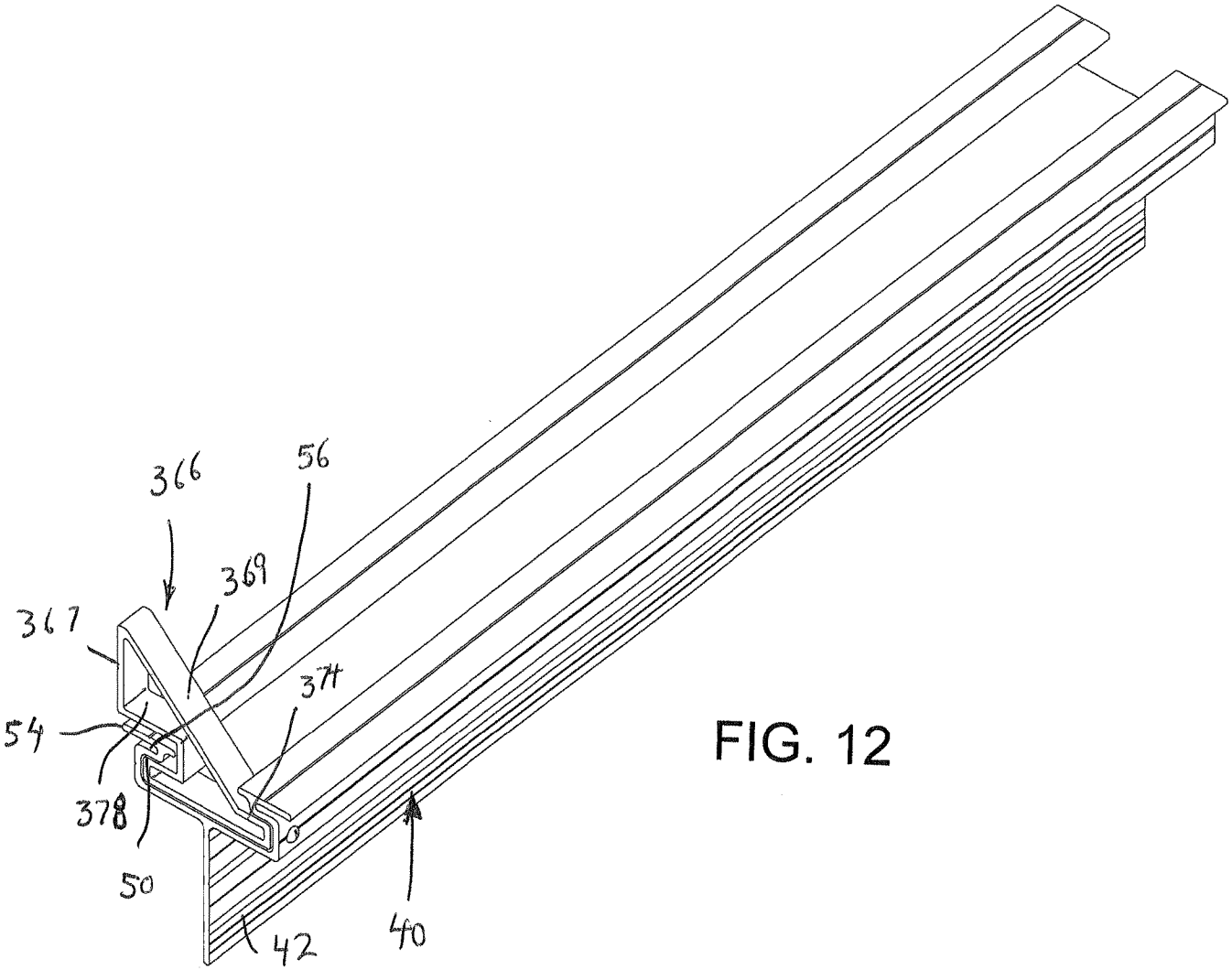
FIG. 12 is a perspective view of a yet further modified wall panel sliding support, assembled with the adjustment support member of FIG. 2.

FIG. 12 shows a modified wall panel sliding support 366 which is identical to wall panel sliding support 66 of FIG. 5, except that one extension wall 76 and its corresponding retaining wall 78 are eliminated. In place thereof, an extension wall 367 extends in the third orthogonal direction from the free end of the single retaining wall 378, and an inclined wall 369 connects the free end of extension wall 367 and the free and of inwardly directed wall 374 at the opposite side of wall panel sliding support 366.

Figure 13:
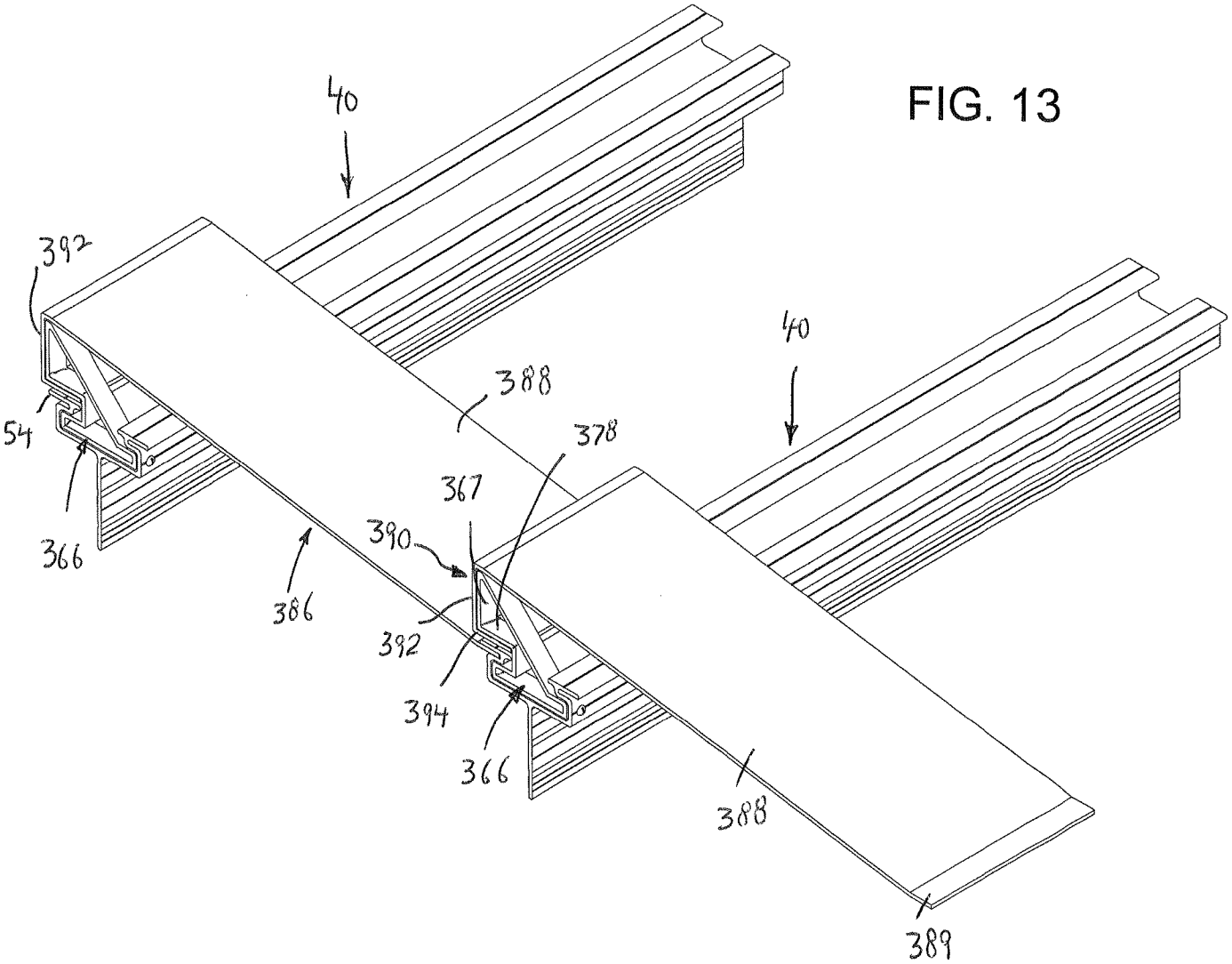
FIG. 13 is a perspective view of the assembly of FIG. 12, assembled with modified wall panels.

In this manner, as shown in FIG. 13, modified wall panels 386 can be secured thereto in an angled manner to provide a three-dimensional appearance. Specifically, each wall panel 386 includes an outer exposed panel section 388 having an inwardly extending L-shaped connecting wall 390 secured to one end thereof. Specifically, L-shaped connecting wall 390 includes an inwardly extending wall 392 that extends from an outer edge of main panel section 388 in the third orthogonal direction and at an acute angle relative to main panel section 388, and a securing wall 394 that extends from the opposite free end of inwardly extending wall 392 in the same direction as main panel section 388 but spaced therefrom. Securing wall 394 is inserted within the space between retaining walls 54 and 378, with inwardly extending wall 392 overlying extension wall 367.

The opposite end of main panel section 388 is slightly bent to define a bent end 389 which is inserted in the gap 56 between inwardly directed wall 50 and retaining wall 54. Screws (not shown) are then inserted through bent end 389, retaining wall 54, securing wall 394 and retaining wall 378 to secure these elements together.

It will be appreciated that, with this arrangement, because inclined wall 369 *h* foul as one end raised relative to the other end due to extension wall 367, one and of each wall panel 386 is raised relative to the other hand so as to present a three-dimensional arrangement.

Figure 14:
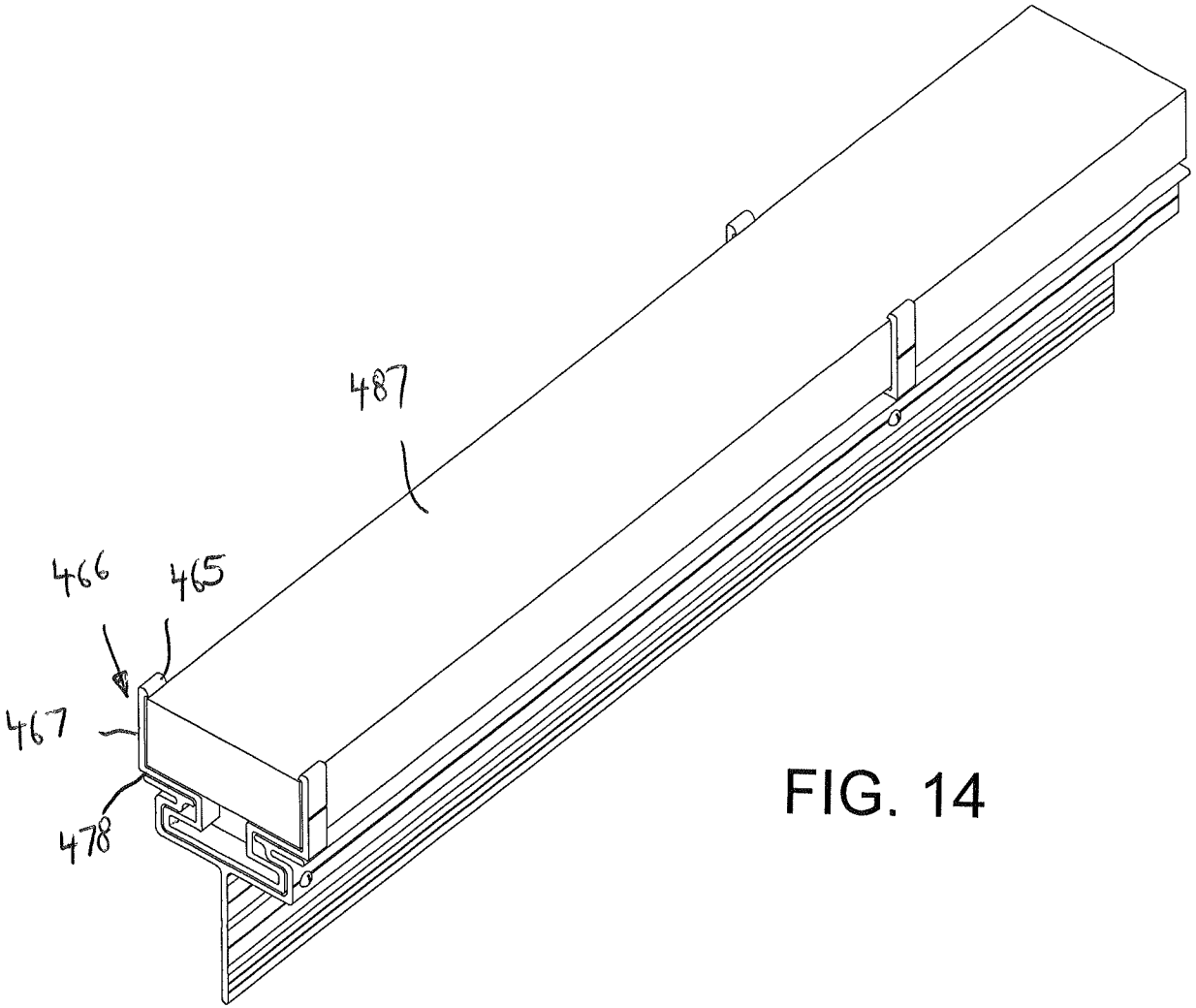
FIG. 14 is a perspective view of still further modified wall panel sliding supports for connection with a 2×4 framing stud, and assembled with the adjustment support member of FIG. 2.

FIG. 14 shows a further modified wall panel sliding support 466 which is identical to wall panel sliding support 66 of FIG. 5, except that an extension wall 467 extends in the third direction from the free end of each retaining wall 478 in a direction away from adjustment support member 40, with the free end of each extension wall 467 having a slightly inturned lip 465. With this arrangement, a 2×4 framing stud 487 (or any other size framing stud) or the like can be positioned between adjacent extension walls 467 and held by inturned lips 465. Planar wall panels can then be secured on top of the 2×4 framing studs 487, and secured thereto by screws. Of course, it will be appreciated that, in such case, the screws will be exposed on the outer facing surface of the wall panels.

Figure 15:
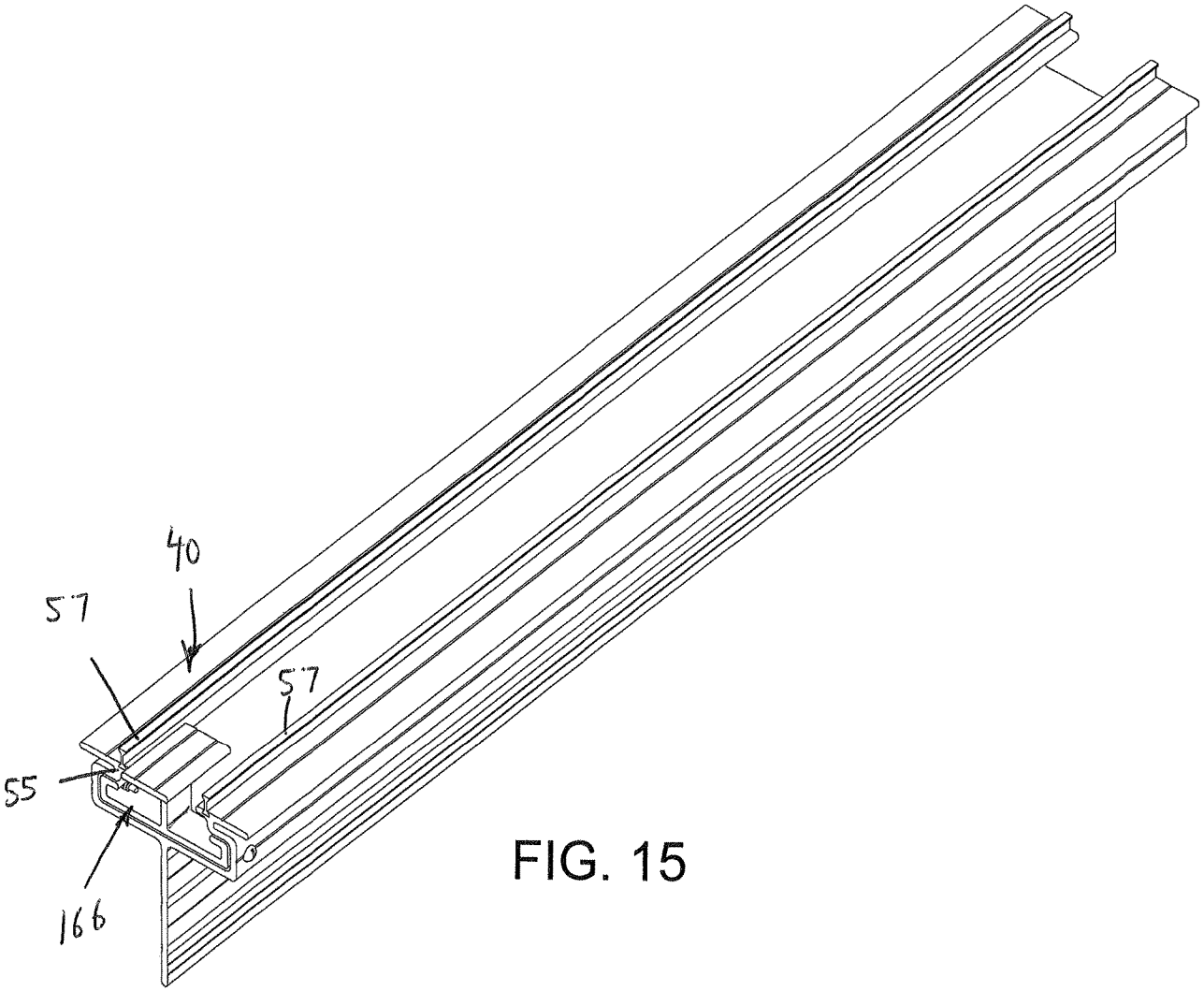
FIG. 15 is a perspective view of a wall panel sliding support which is the same as that of FIG. 9, assembled with a modified adjustment support member.
Figure 16:
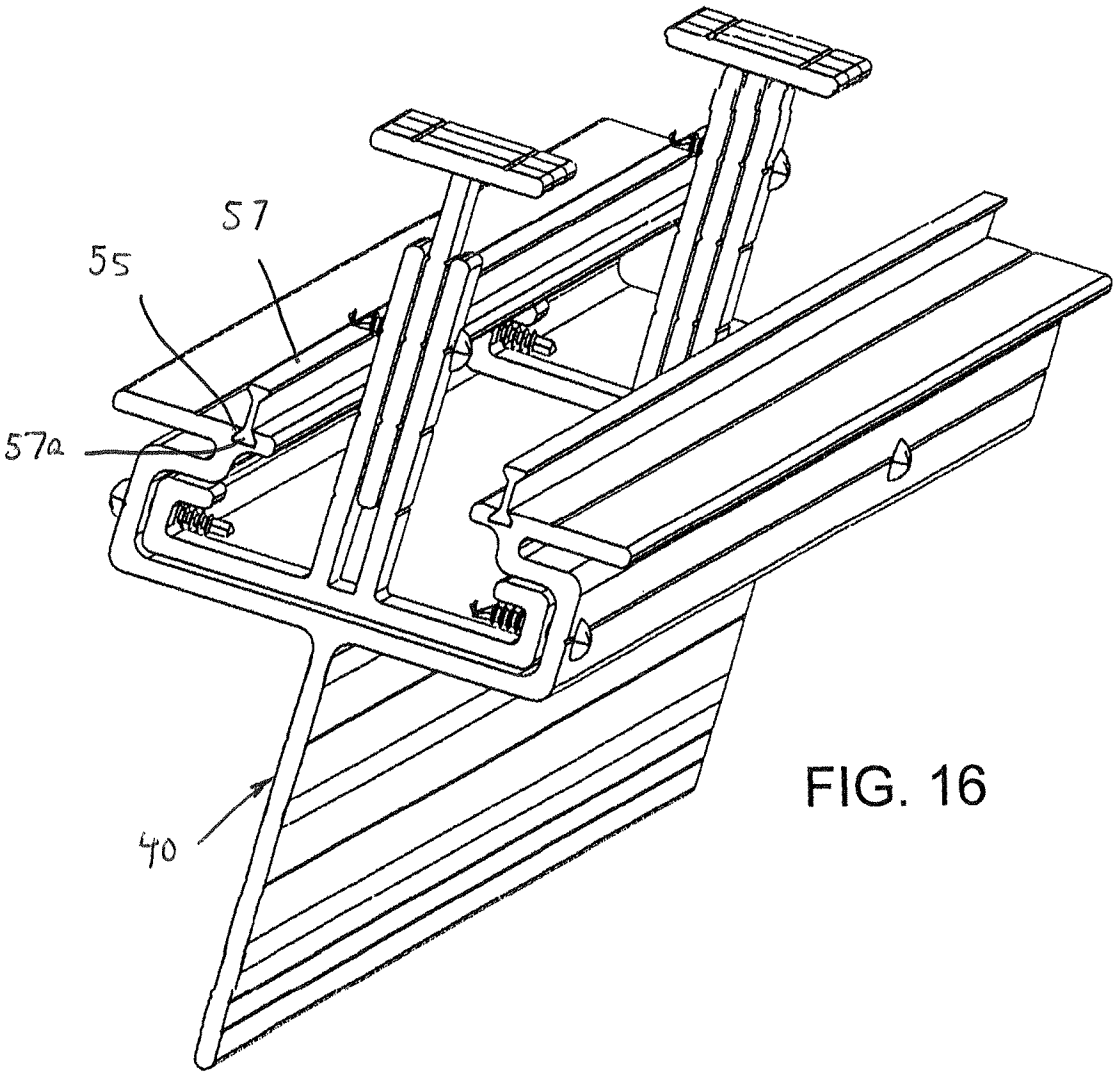
FIG. 16 is a perspective view of wall panel sliding supports which are the same as that of FIG. 10, assembled with a modified adjustment support member.
Figure 17:
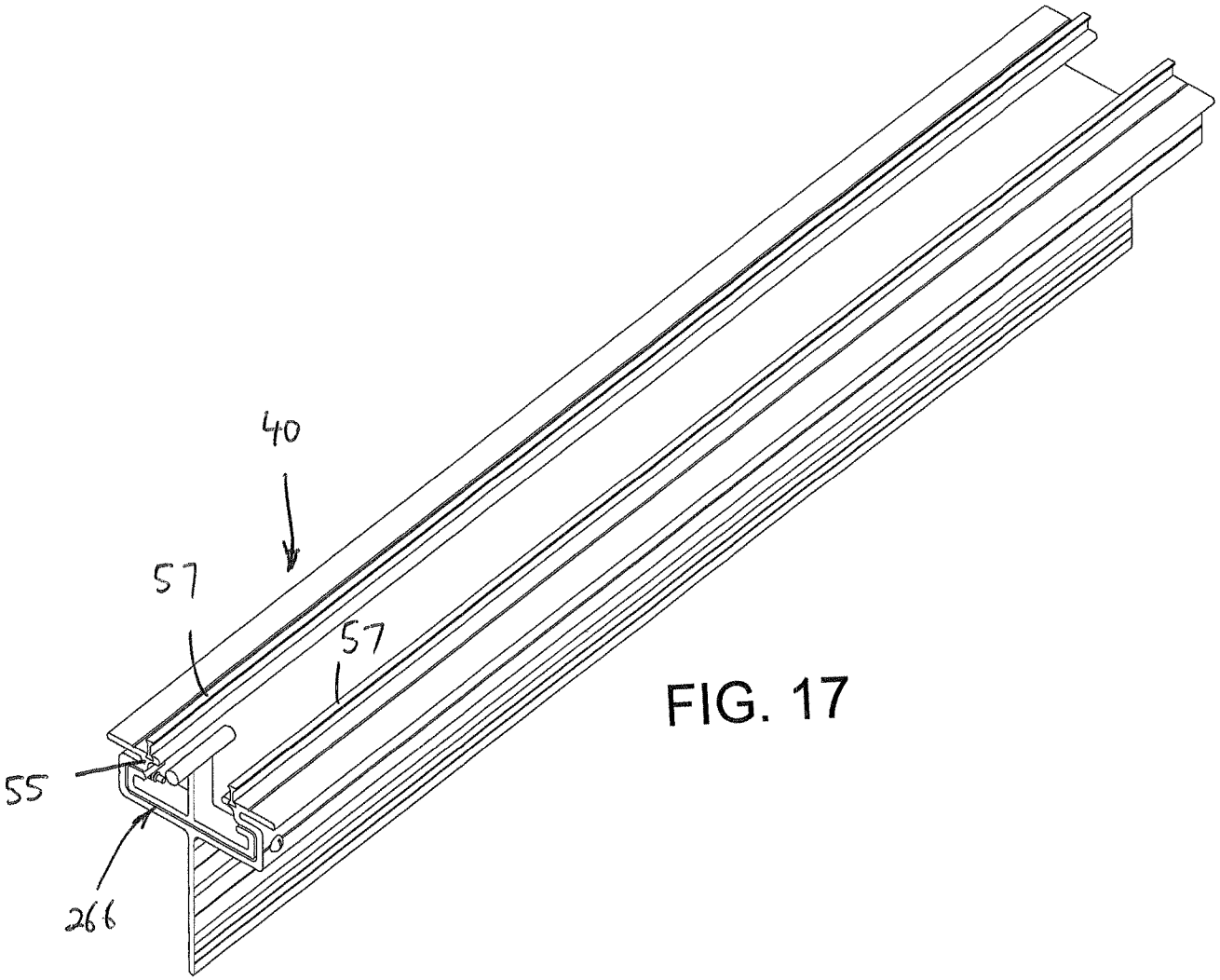
FIG. 17 is a perspective view of a wall panel sliding support which is the same as that of FIG. 11, assembled with a modified adjustment support member.

FIGS. 15-17 show embodiments which are identical to the embodiments of FIGS. 9-11, respectively, except that retaining walls 54 include elongated dovetail shaped slots 55 therein extending in the first lengthwise direction. Retaining bars 57 having at least one dovetail shaped end 57*a* fit within each dovetail shaped slot 55. Retaining bars 57 function as water locking panels to prevent water ingress. Retaining bars 57 can be inserted after wall panels 86 are assembled with adjustment support members 40, or alternatively, can be inserted prior to assembly of wall panels 86 and, in such case, wall panels 86 would be angled when assembled to pass by retaining bars 57.

It will be appreciated that, while wall panel sliding supports 66 have been disclosed as being slidable on the inside of U-shaped track 44 of adjustment support member 40, the wall panel sliding supports can be slidably positioned on the outside of adjustment support member 40 as well, as will now be disclosed.

Figure 18:
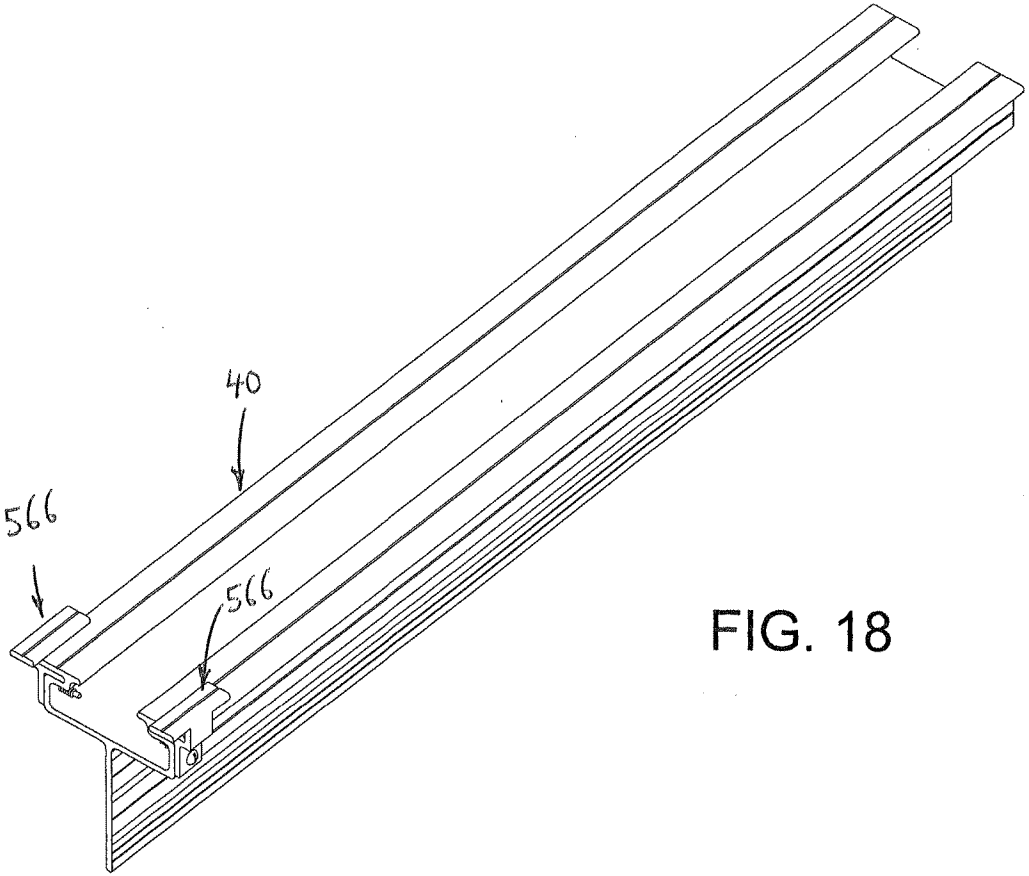
FIG. 18 is a perspective view of a modified wall panel sliding support assembled with the adjustment support member of FIG. 2.
Figure 19:
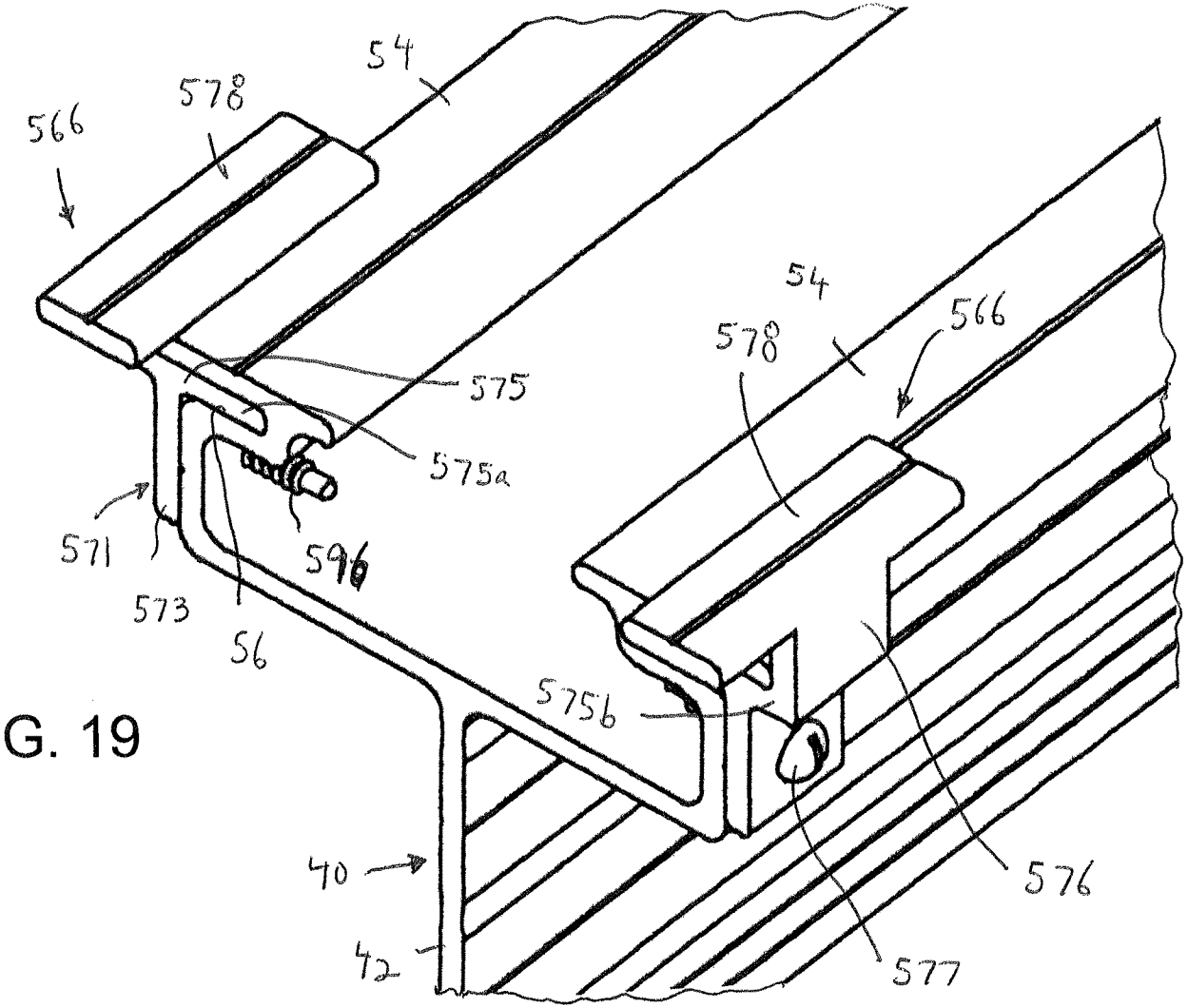
FIG. 19 is an enlarged perspective view of a portion of the assembly of FIG. 18.

Specifically, as shown in FIGS. 18 and 19, wall panel sliding supports 566 each include a T-shaped wall 571 formed by a wall 573 extending in the third orthogonal direction and a transverse wall 575 bisected by and connected at the upper end of wall 573 so as to form first and second wall sections 575*a* and 575*b* on opposite sides of transverse wall 575. An extension wall 576 extends in the third orthogonal direction from the free end of second wall section 575*b* in a direction away from wall 573. A rectangular retaining wall 578 has one edge connected to the upper end of extension wall 576. With this arrangement, first wall section 575*a* is inserted within elongated gap 56 of adjustment support member 40 sliding movement therein. In such position, wall 573 is positioned flush against the outer surface of the respective upstanding wall 48 of adjustment support member 40. Further, in such position, rectangular retaining wall 578 is positioned in parallel, spaced relation from the respective retaining wall 54 of adjustment support member 40.

With this arrangement, wall panels (not shown) which are identical to wall panels 86 of FIG. 6 are provided, except that securing wall 94 is oriented 180° from that shown in FIG. 6, that is, securing wall 94 is positioned in parallel spaced relation directly beneath outer exposed panel section 88. Thus, securing wall 94 is positioned between retaining walls 54 and 578. Wall panel sliding supports 566 are secured to upstanding walls 48 by screws 596 extending therethrough.

Figure 20:
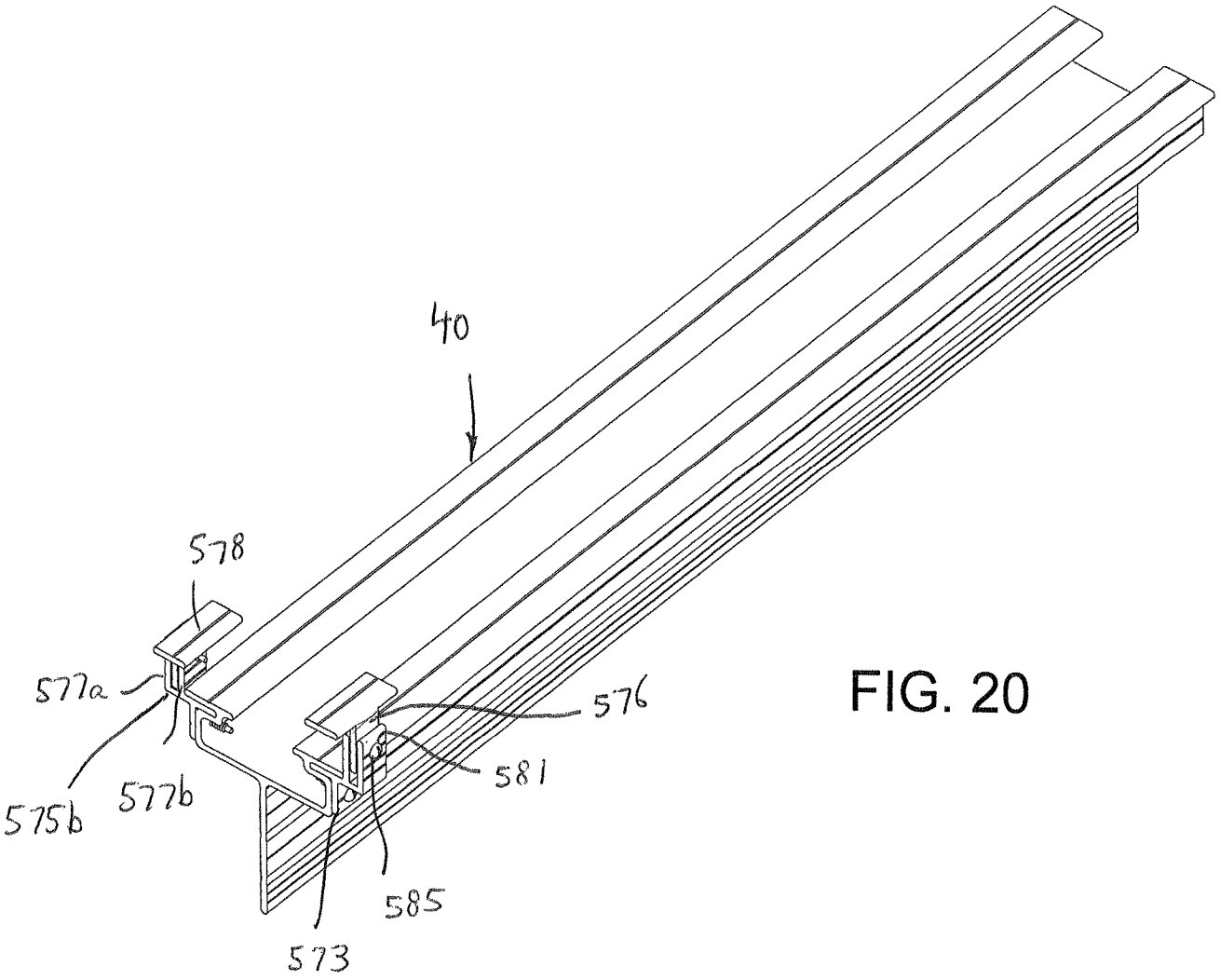
FIG. 20 is a perspective view of a further modified wall panel sliding support assembled with the adjustment support member of FIG. 2.

FIG. 20 shows a modification of the embodiment of FIGS. 18 and 19 in which adjustability of rectangular retaining wall 578 is provided relative to retaining wall 54.

Specifically, two parallel, spaced apart extension walls 577*a* and 577*b* extend outwardly in the third orthogonal direction from the free end of second wall section 575*b* in a direction away from wall 573, and have aligned openings 581. A single extension wall 576 is slidably positioned between extension walls 577*a* and 577*b*, and includes a plurality of spaced apart openings (not shown) therealong. Single extension wall 576 can be selectively secured at a desired height by adjusting the position of single extension wall 576 between extension walls 577*a* and 577*b*, and then secured in that position by a bolt 585 extending through aligned openings 581 and one of the openings in single extension wall 576. Retaining wall 578 has one edge connected to the upper end of extension wall 576.

Figure 21:
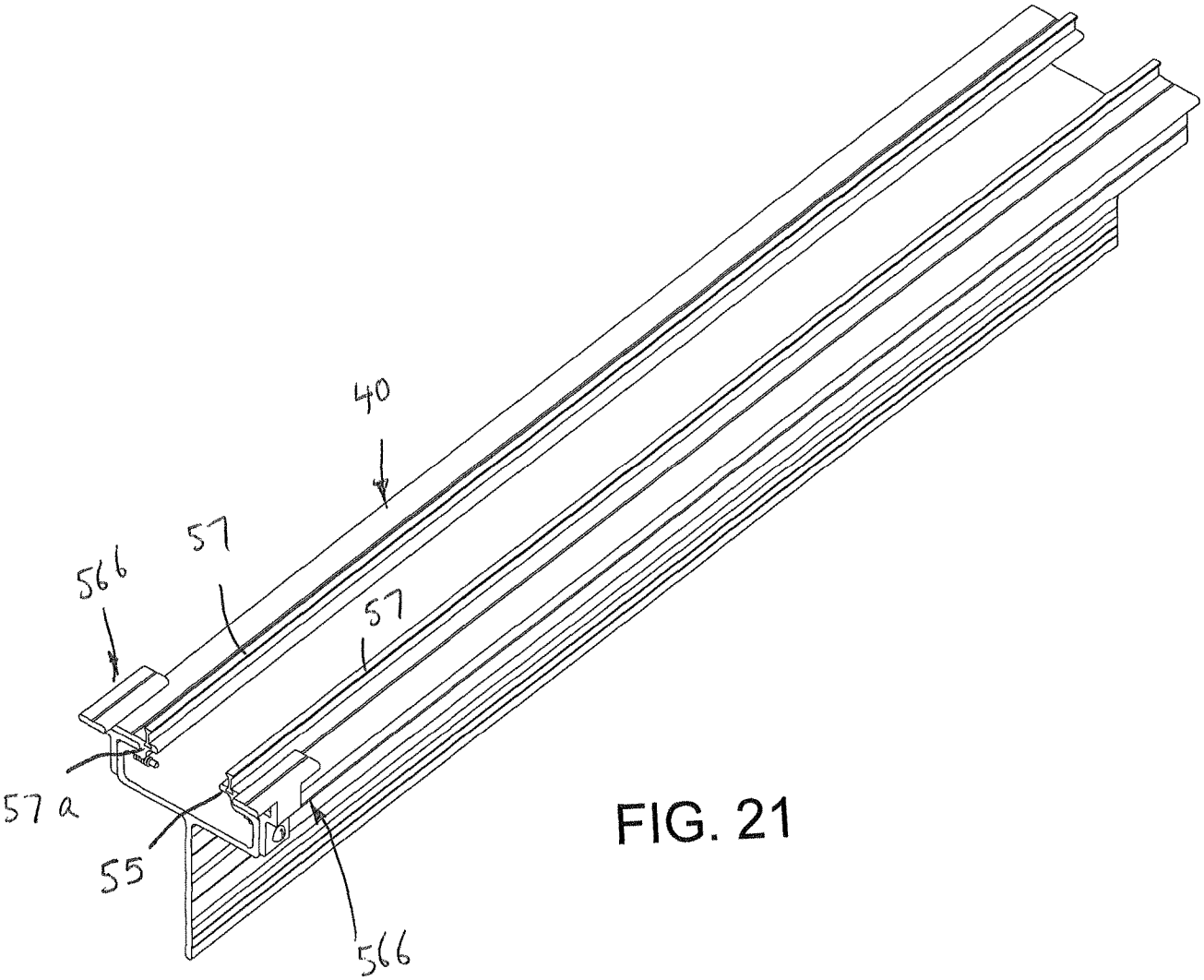
FIG. 21 is a perspective view of a wall panel sliding support which is the same as that of FIG. 18, assembled with a modified adjustment support member.
Figure 22:
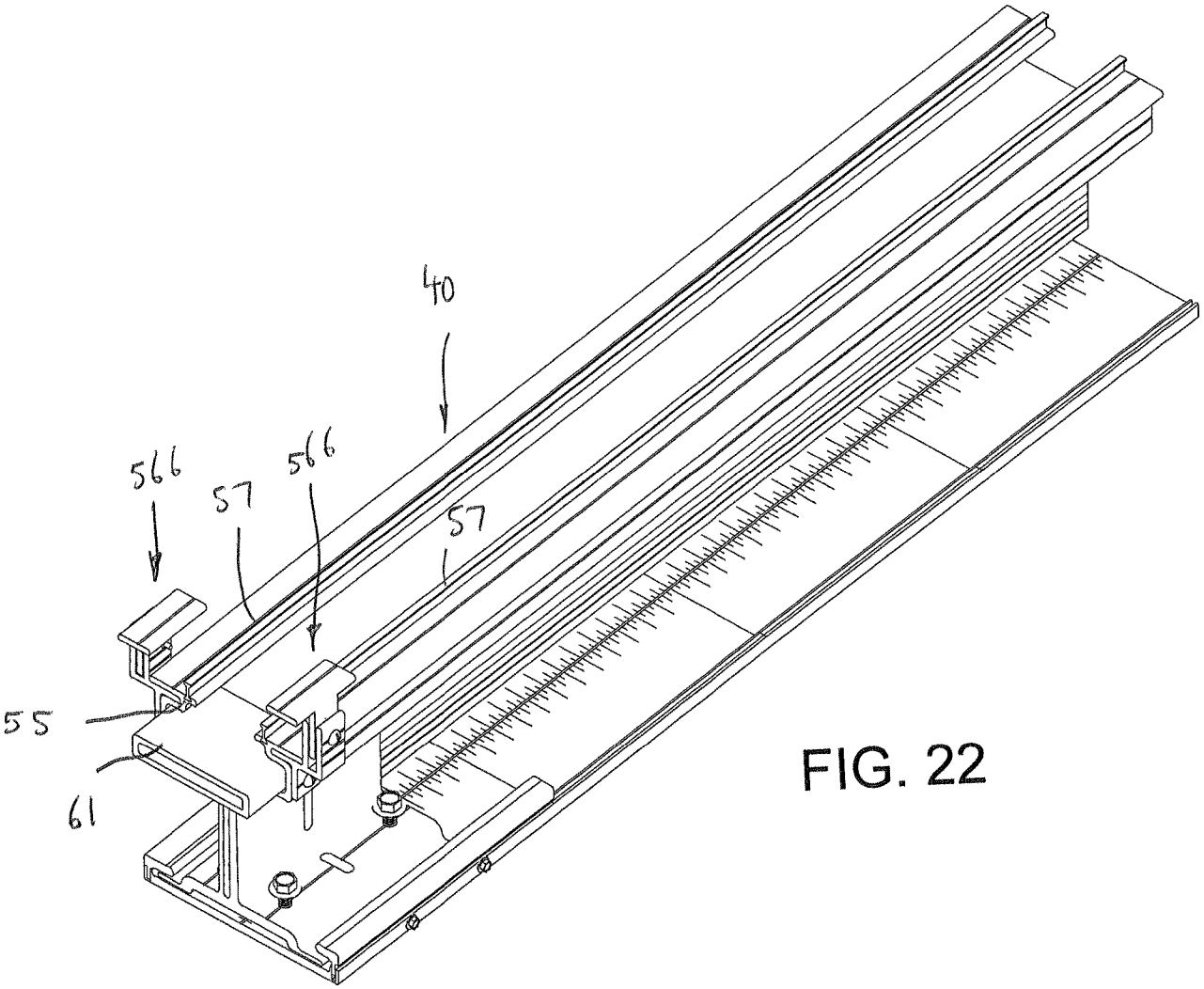
FIG. 22 is a perspective view of a wall panel sliding support which is the same as that of FIG. 20, assembled with a modified adjustment support member.

FIGS. 21 and 22 show embodiments which are identical to the embodiments of FIGS. 18-20, respectively, except that retaining walls 54 include elongated dovetail shaped slots 55 therein extending in the first lengthwise direction. Retaining bars 57 have at least one dovetail shaped end 57*a* which fits within each dovetail shaped slot 55. Retaining bars 57 function as water locking panels to prevent water ingress. Retaining bars 57 can be inserted after wall panels 86 are assembled with adjustment support members 40, or alternatively, can be inserted prior to assembly of wall panels 86 and, in such case, wall panels 86 would be angled when assembled to pass by retaining bars 57.

In addition, as shown in FIG. 22, a rectangular parallelepiped connecting member 61 is slid within track 44 to connect together in line, abutting or near abutting, adjustment support members 40.

Figure 23:
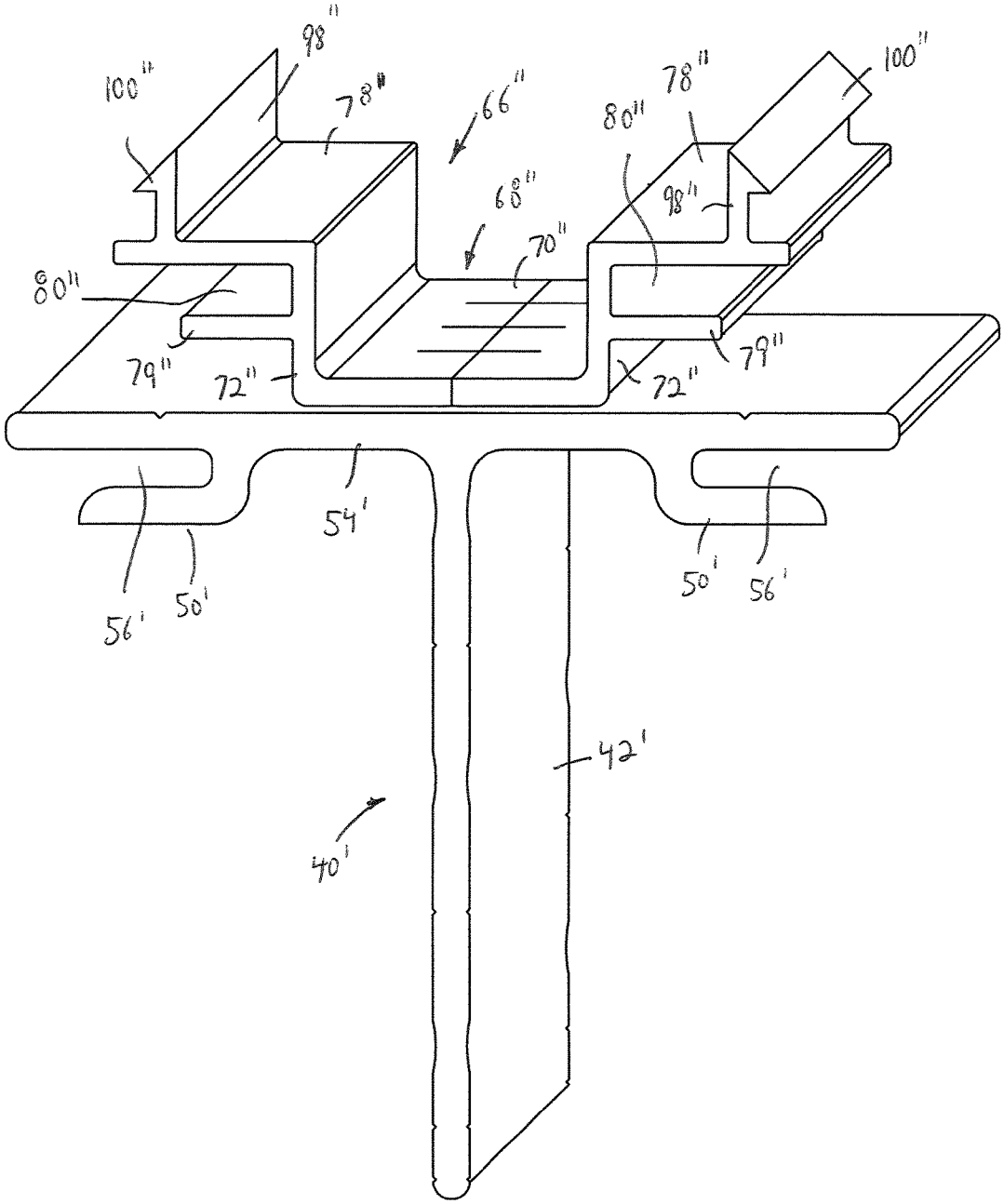
FIG. 23 is a perspective view of a modified adjustment support member and a wall panel support.
Figure 24:
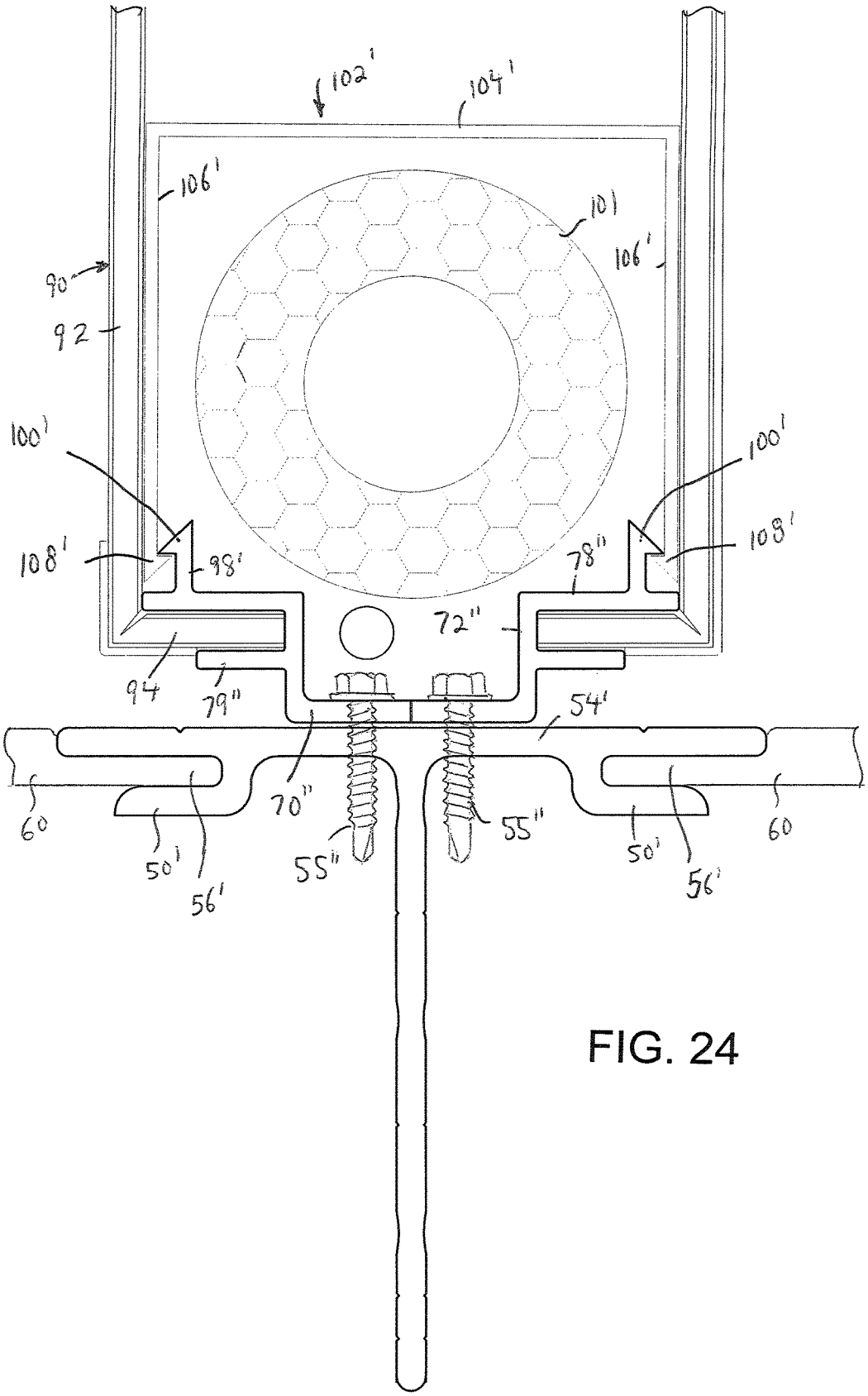
FIG. 24 is a plan view of the arrangement of FIG. 23, assembled with wall panels and connecting panels.

A further modification is shown in FIGS. 23 and 24 in which a modified adjustment support member 40' includes an elongated rectangular plate 42' that is dimensioned to fit snugly between capture walls 30 and 32, such that retaining lip 30*a* applies pressure to plate 42'. The opposite free lengthwise edge of rectangular plate 42' is fixed centrally to the lower surface of a platform wall 54'. Two L-shaped walls 50' extend from the underside of platform wall 54' on opposite sides of rectangular plate 42' and face away from rectangular plate 42', whereby a gap 56' is defined between each L-shaped wall 50' and platform wall 54' for receiving an end of a connecting panel 60 therein.

A wall panel support 66" is mounted on each modified adjustment support member 40' and includes a U-shaped support 68" having an elongated rectangular lower plate 70" and two upstanding, parallel, spaced apart walls 72" extending in the third direction from opposite lengthwise edges of lower plate 70". Rectangular lower plate 70" is secured centrally to the upper surface of platform wall 54' by screws 55". A retaining second wall 78" is connected to the outer free end of each wall 72" and extends in a direction in the second transverse direction in parallel, spaced apart relation to lower plate 70" but extending outwardly in a direction away from lower plate 70". A third retaining wall 79" extends outwardly from the outer surface of each wall 72" in parallel, spaced relation from second retaining wall 78" so as to provide a space 80" therebetween for capturing securing wall 94 of a wall panel 86. Of course, screws are then inserted between the elements to secure them together.

Catch walls 98" extend outwardly from the exposed surface of each retaining wall 78" in the third direction at a position slightly spaced inwardly from the outer edge thereof. Each catch wall 98" includes an outwardly facing V-shaped catch 100" at the upper end thereof.

As shown in FIG. 24, a heating pipe 101 can be positioned between inwardly extending walls 92 of adjacent wall panels 86. Accordingly, a modified cover 102' is provided having a central wall 104' adapted to be secured in covering relation to heating pipe 101, and capture walls 106' at opposite ends thereof which extend in parallel adjacent relation to respective inwardly extending walls 92, with each capture wall 106' having an inwardly facing V-shaped latch 108' at the free end thereof for engaging with a respective V-shaped catch 100'.

Figure 25:
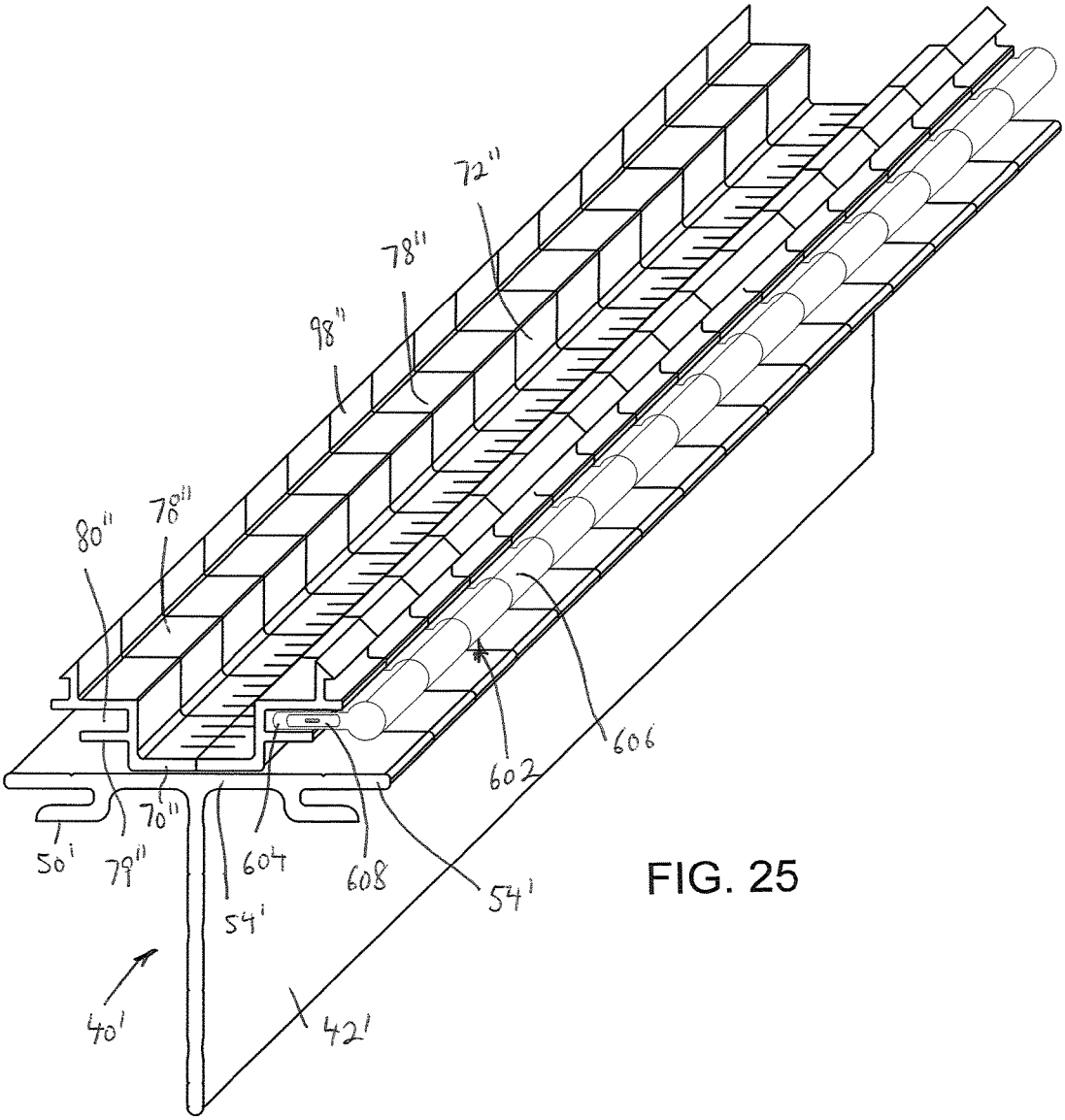
FIG. 25 is a perspective view of the arrangement of FIG. 23, used with a carpenter level.
Figure 26:
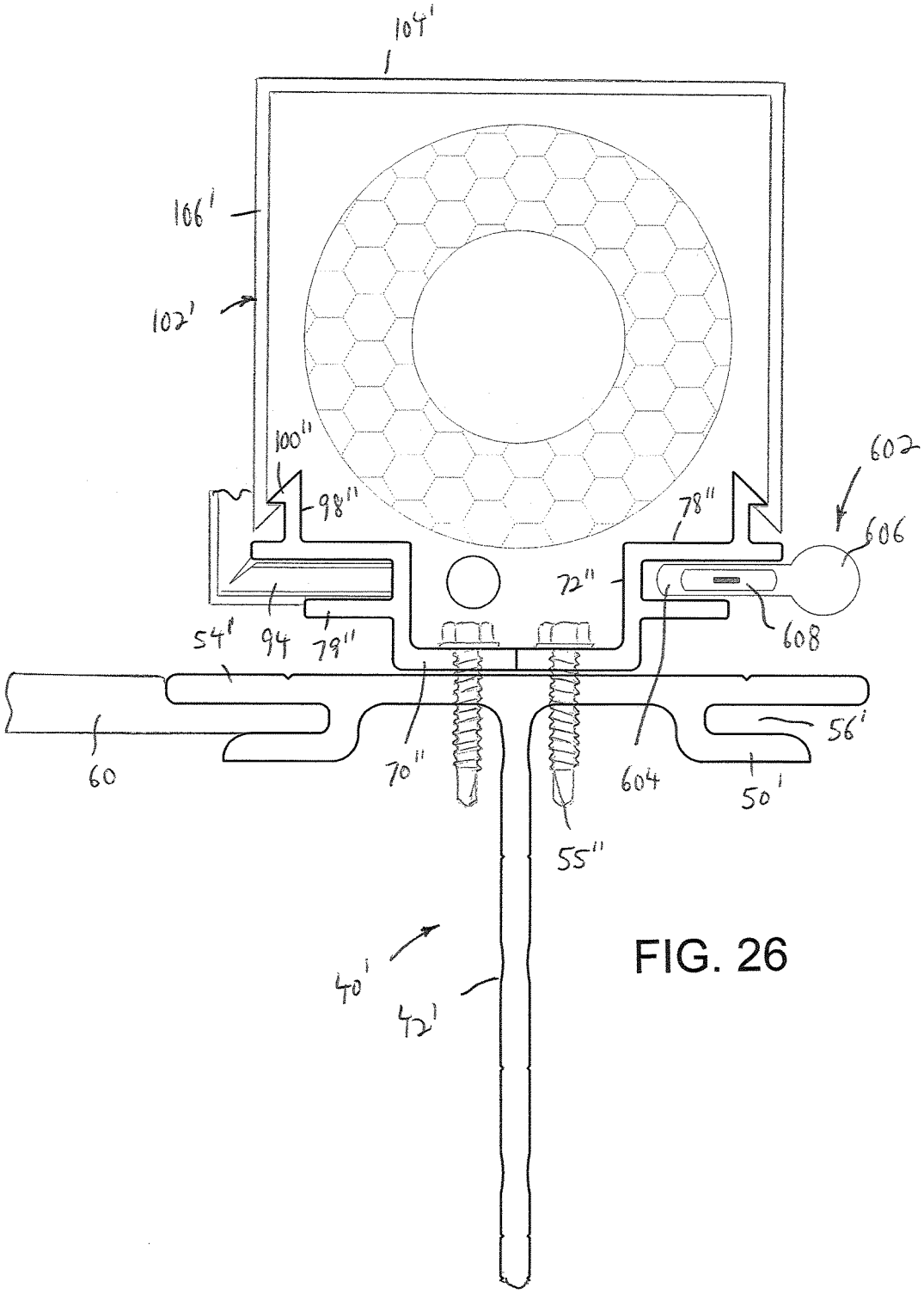
FIG. 26 is a plan view of the arrangement of FIG. 25.

As shown in FIGS. 25 and 26, in order to level each modified adjustment support member 40', a carpenter level 602 is provided which includes an elongated rectangular parallelepiped body 604 with a cylindrical grasping member 606 along an elongated edge thereof. Elongated rectangular parallelepiped body 604 includes a conventional bubble level 608 therein at a visible sign edge thereof. Thus, when assembling modified adjustment support member 40' with sliding support member 24, elongated rectangular parallelepiped body 604 of carpenter level 602 is inserted within space 80" and adjustment is made in accordance with the reading of the bubble level 608 to achieve a desired level and orientation. Thereafter, grasping member 606 is grabbed and carpenter level 602 is removed from space 80", whereupon the wall panels can then be assembled therewith.

Figure 27:
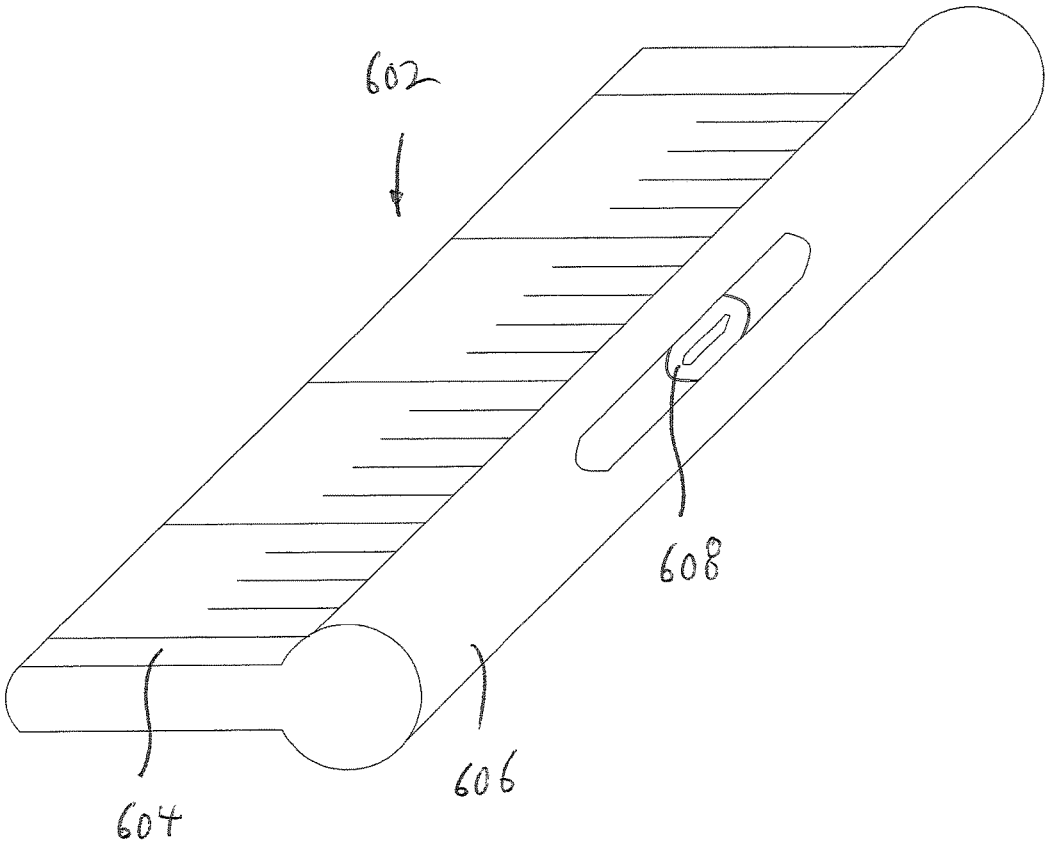
FIG. 27 is a perspective view of a modified carpenter level.

Alternatively, as shown in FIG. 27, bubble level 608 can be provided in cylindrical grasping member 606.

It will be appreciated that carpenter level 602 can be used with any of the embodiments in the present application, and instead of being positioned within space 80", it can be positioned in spaces 56, 56' as well.

It will be appreciated that the invention described above has permitted adjustment in at least three orthogonal directions. However, the present invention can also be provided with fewer degrees of freedom or adjustment, for example, adjustment in a single direction such as the first lengthwise direction.

In this regard, in all of the above embodiments, elongated rectangular plate 42 can be removed from adjustment support member 40, and lower plate 46 of adjustment support member 40 can be secured directly to an existing wall. In such case, wall panel sliding supports 66 would provide the only adjustment in the first lengthwise direction.

Figure 28:
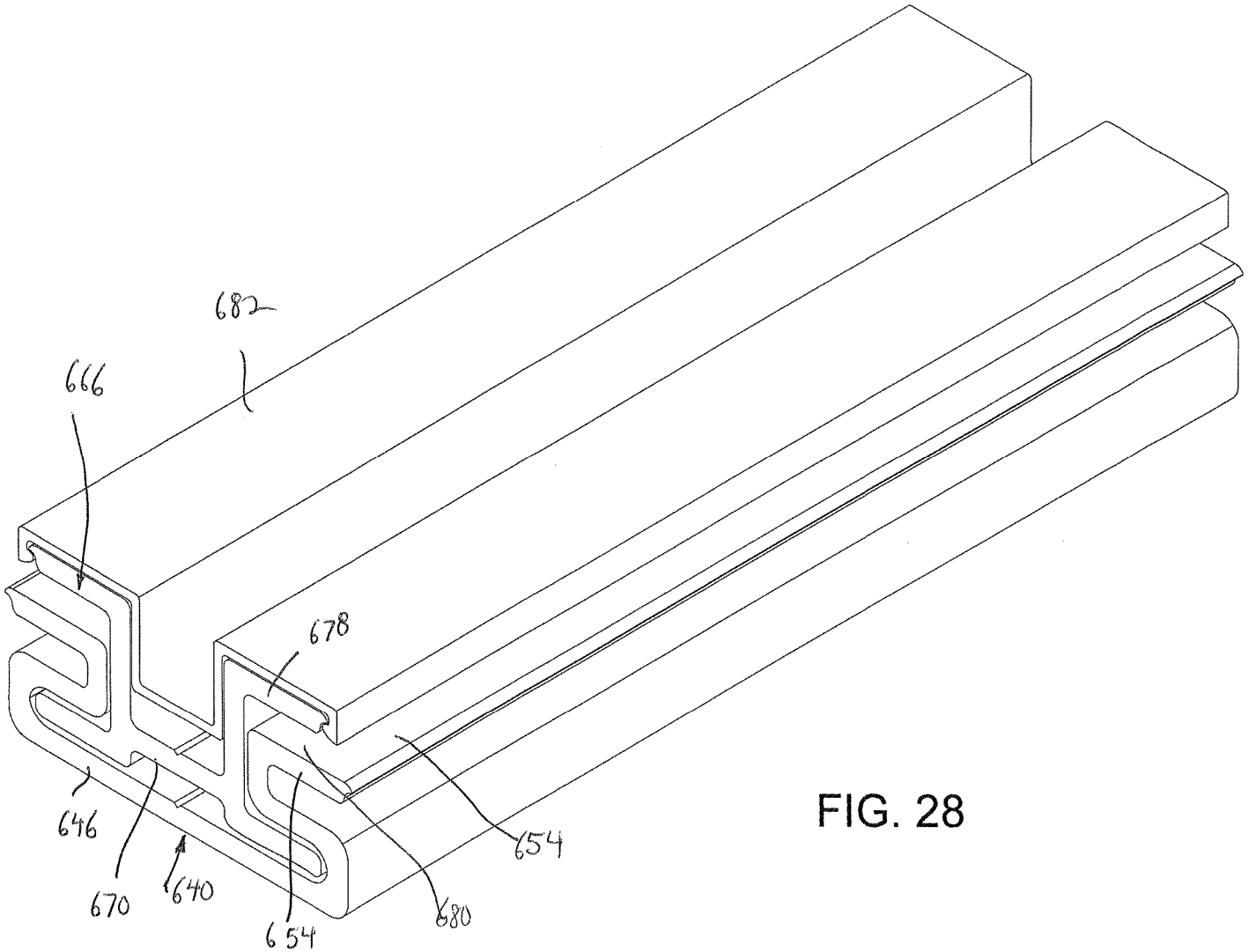
FIG. 28 is a perspective view of a modified adjustment support member and modified wall panel sliding support for adjustment in a single direction.
Figure 29:
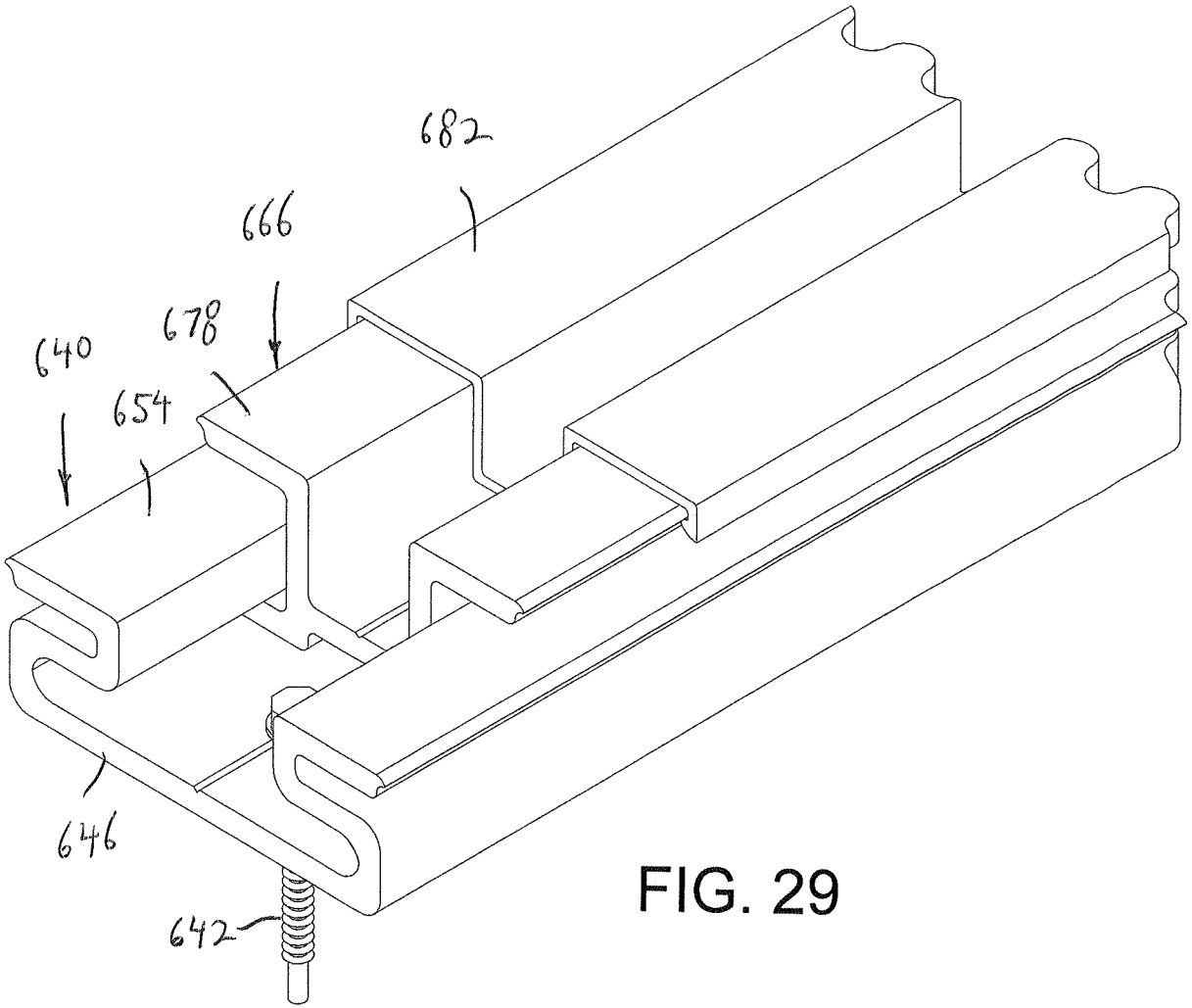
FIG. 29 is a perspective view of the arrangement of FIG. 28, showing the sliding arrangement of the parts.

One example of this arrangement, corresponding to FIG. 5, is shown in FIGS. 28 and 29 in which a modified adjustment support member 640 is provided, with a lower plate 646 adapted to be secured by screws 642 to an existing wall. A modified wall panel sliding support 666 is slidably retained by adjustment support member 640. It will be appreciated that elongated rectangular lower plate 670 of wall panel sliding support 666 has an inverted U-shape so as not to engage with the screws used to secure lower plate 646 to the existing wall. As with the aforementioned embodiments, the securing walls 94 of wall panels 86 are inserted in the space 680 between retaining wall 654 of adjustment support member 640 and retaining wall 678 of wall panel sliding support 666. A cover 682 is also shown which engages over retaining walls 678.

Figure 30:
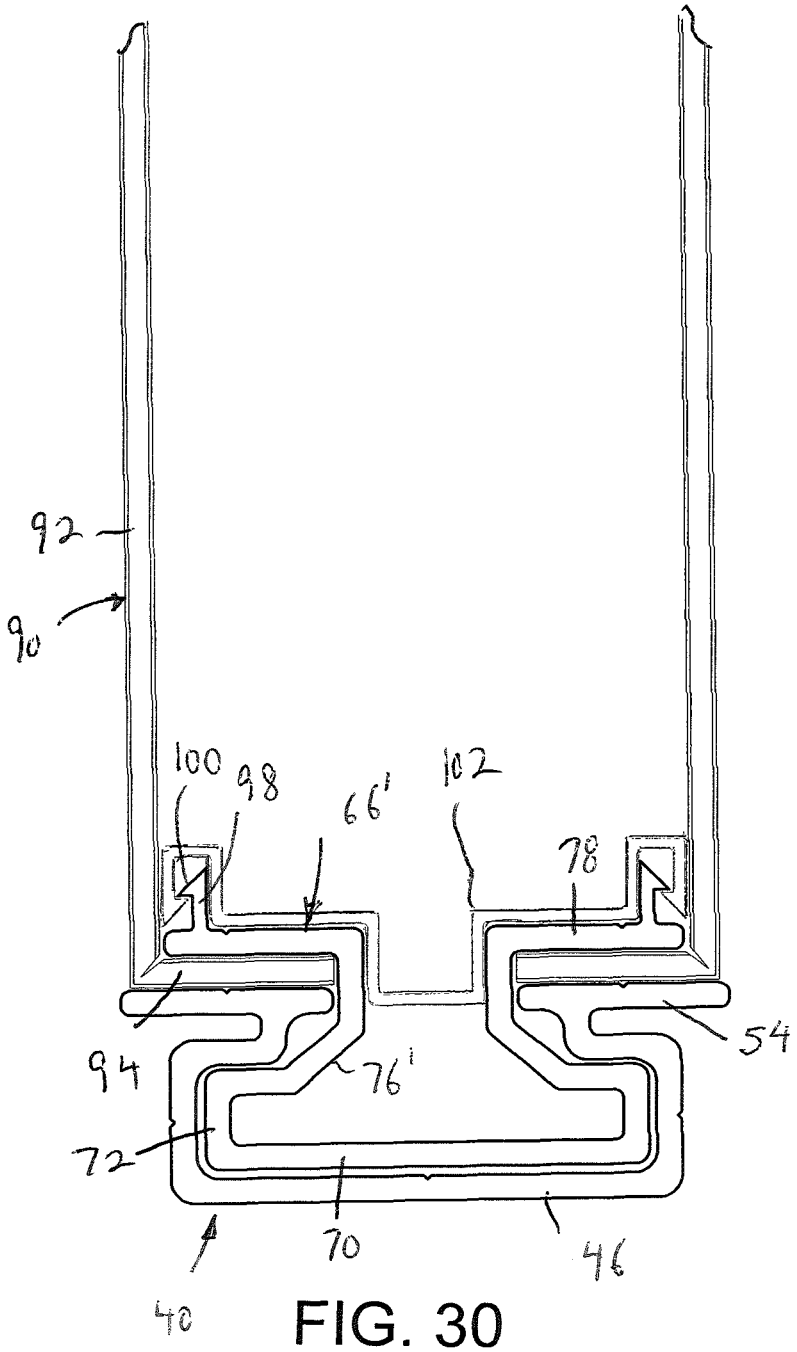
FIG. 30 is a plan view, similar to the arrangement of FIG. 28, with a further modified wall panel sliding support.
Figure 31:
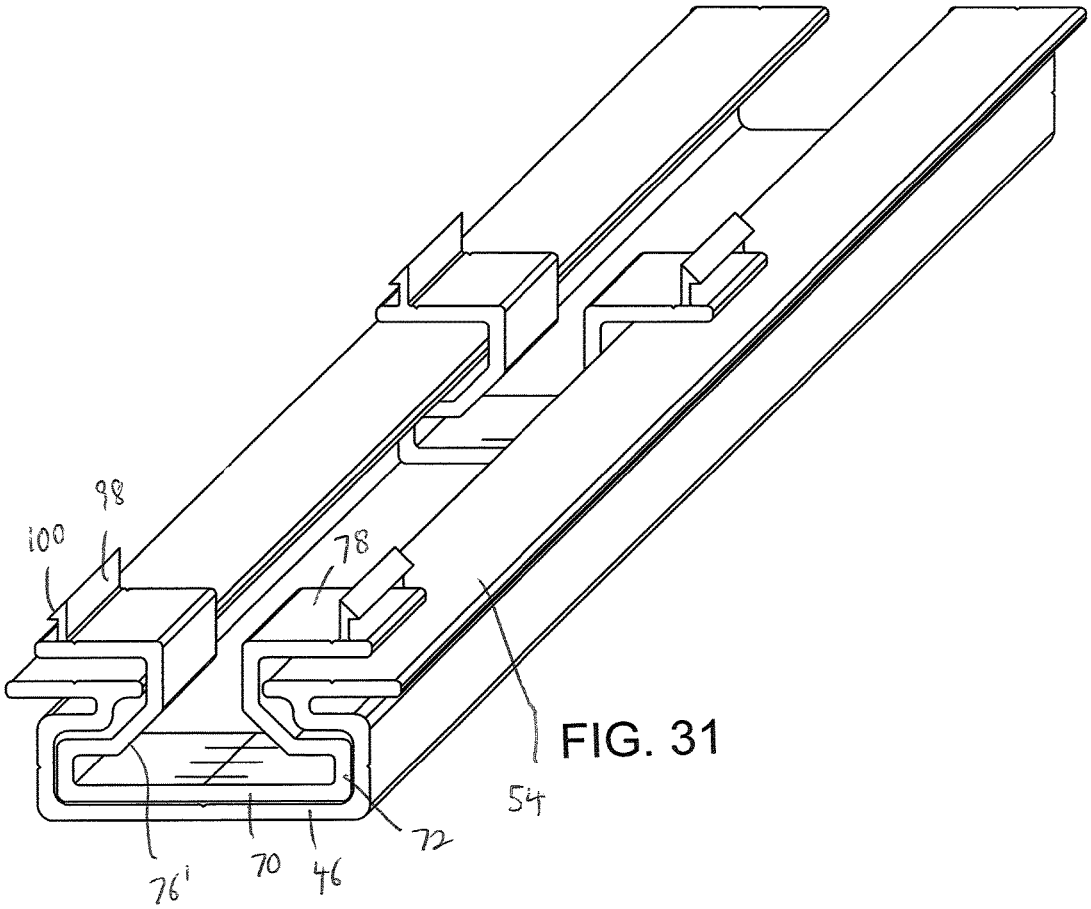
FIG. 31 is a perspective view of the arrangement of FIG. 30.
Figure 32:
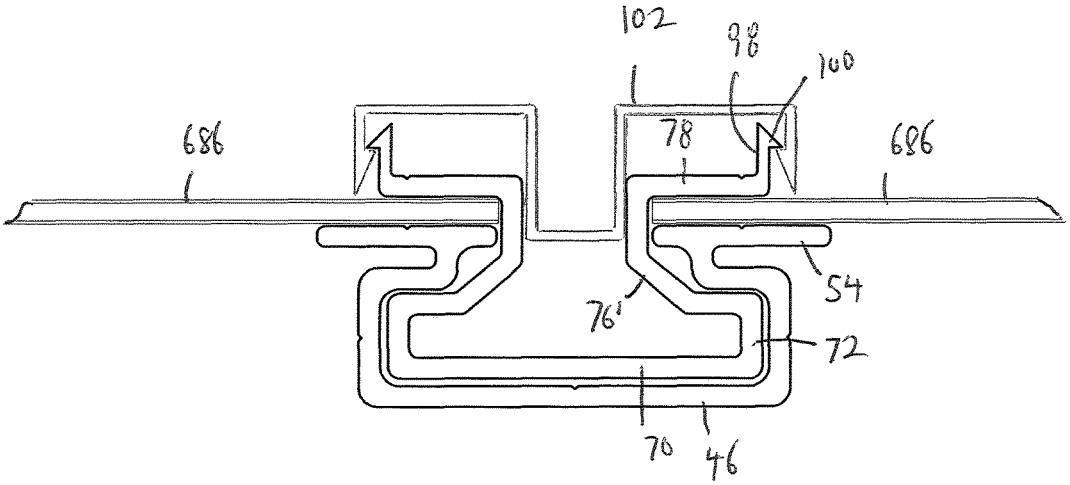
FIG. 32 is a plan view, similar to FIG. 32, showing connection with different wall panels.

As another example, reference is made to FIG. 30 which corresponds to the arrangement shown in FIGS. 7 and 8, but with elongated rectangular plate 42 removed. FIG. 32 is similar to FIG. 30, except that planar wall panels 686 are provided.

It will be appreciated that, with all of the above embodiments, wall panels 86 have been connected to adjustment support member 40 and/or wall panel sliding supports 66. However, wall panels 86 can alternatively be connected with connecting panels 60 which connect spaced apart adjustments support members 40.

Figure 33:
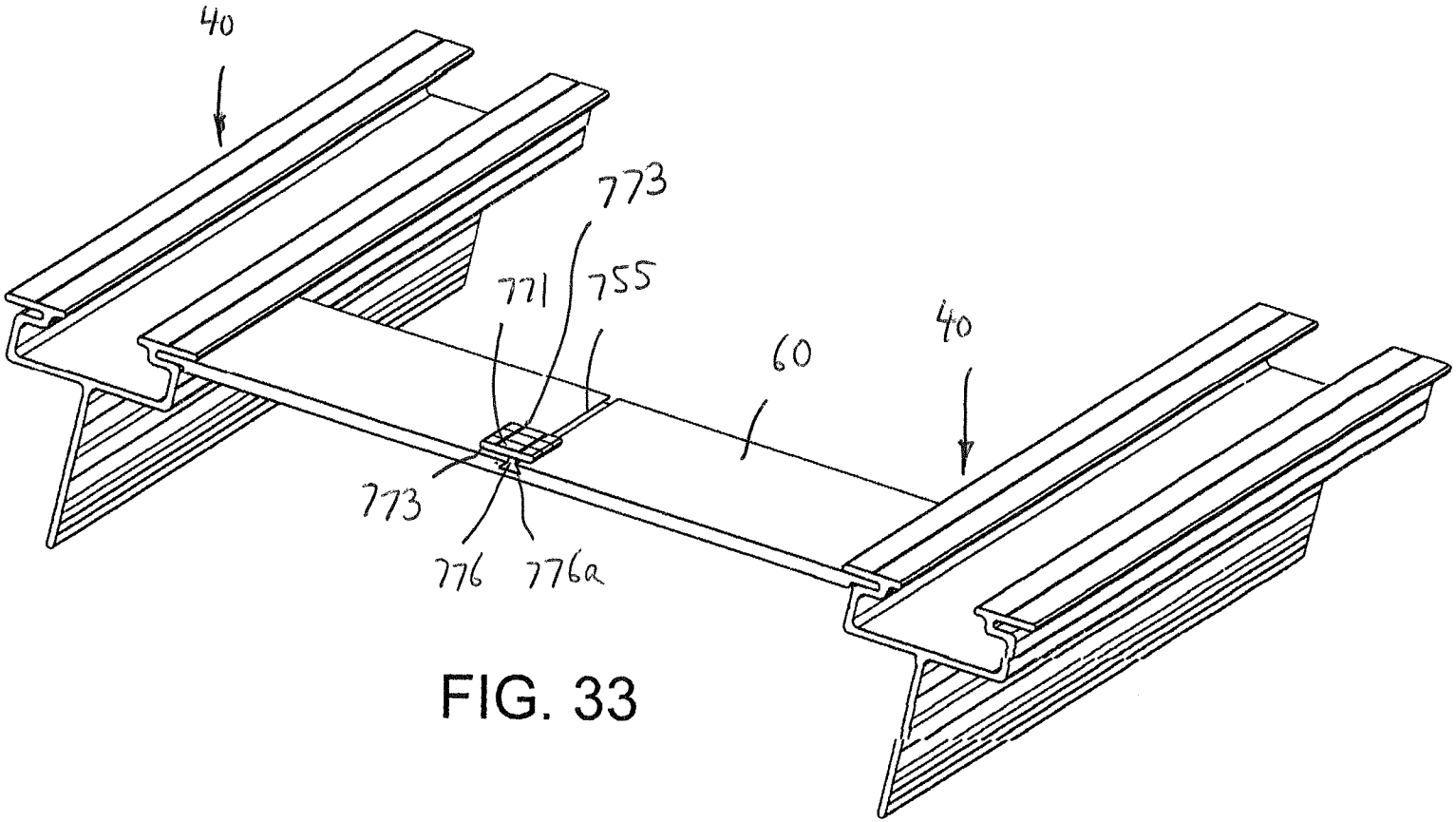
FIG. 33 is a perspective view of two adjustment support members connected together by connecting panels, with a first arrangement on the connecting panels for supporting wall panels.

Thus, for example, a rectangular securing plate 771, as shown in FIG. 33, and which is similar to rectangular securing plate 171, is connected to the upper end of an extension wall 776 having a dovetail shaped lower end **776*a* which fits within a dovetail shaped slot 755 extending in the first lengthwise direction in a connecting panel 60. As with rectangular securing plate 171, rectangular securing plate 771 defines tabs 773 extending to opposite sides of extension wall 776, for insertion into slots 189 in a side wall of a single panel member 188 of a wall panel 186 in order to retain wall panels 186 in position. With this arrangement, rectangular securing plate 771 can be moved to provide adjustment of wall panels 86. Further, with this arrangement, wall panel sliding supports 66** are eliminated.

Figure 34:
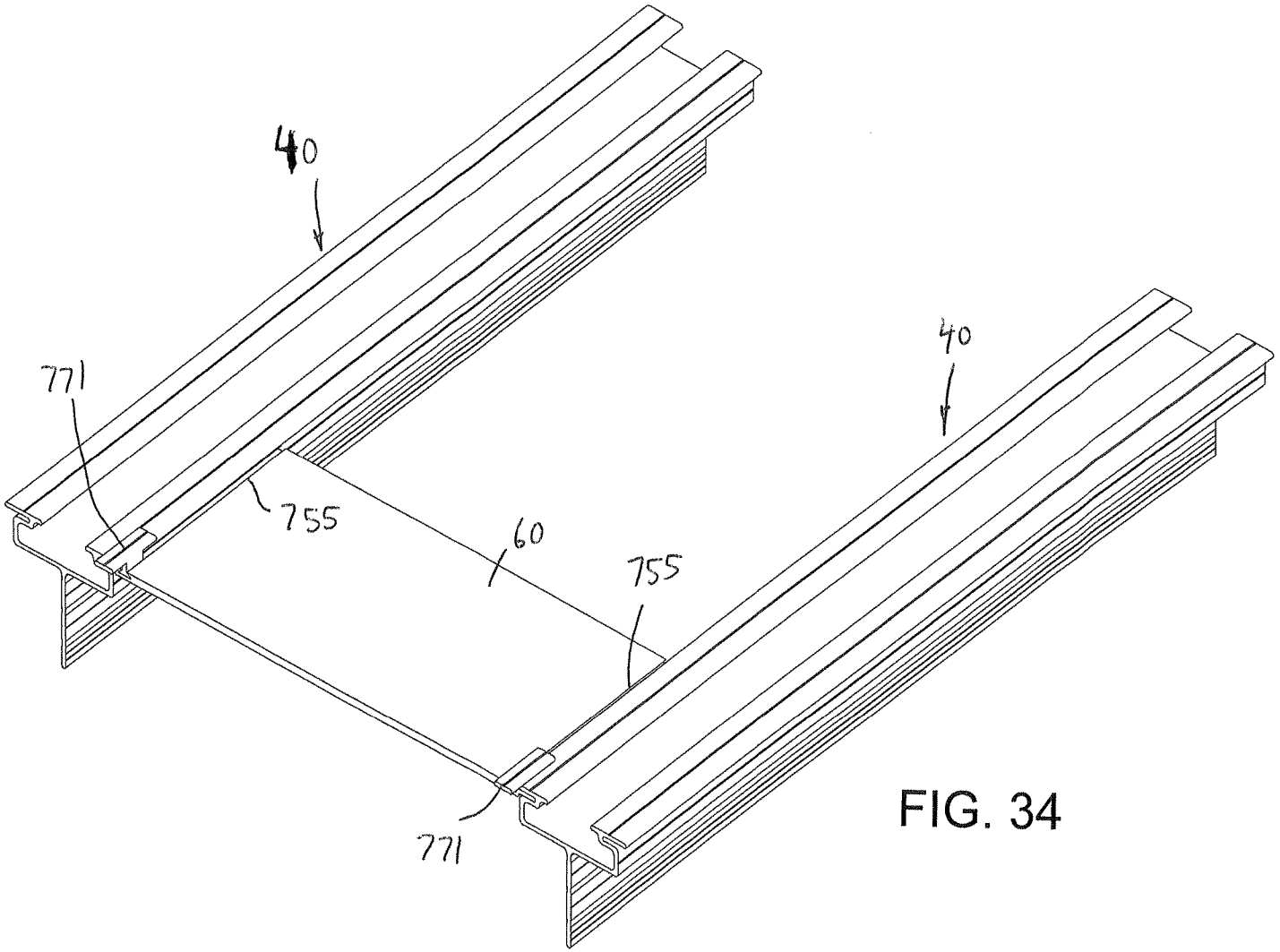
FIG. 34 is a perspective view similar to FIG. 33, with a modified arrangement on the connecting panels for supporting wall panels.
Figure 35:
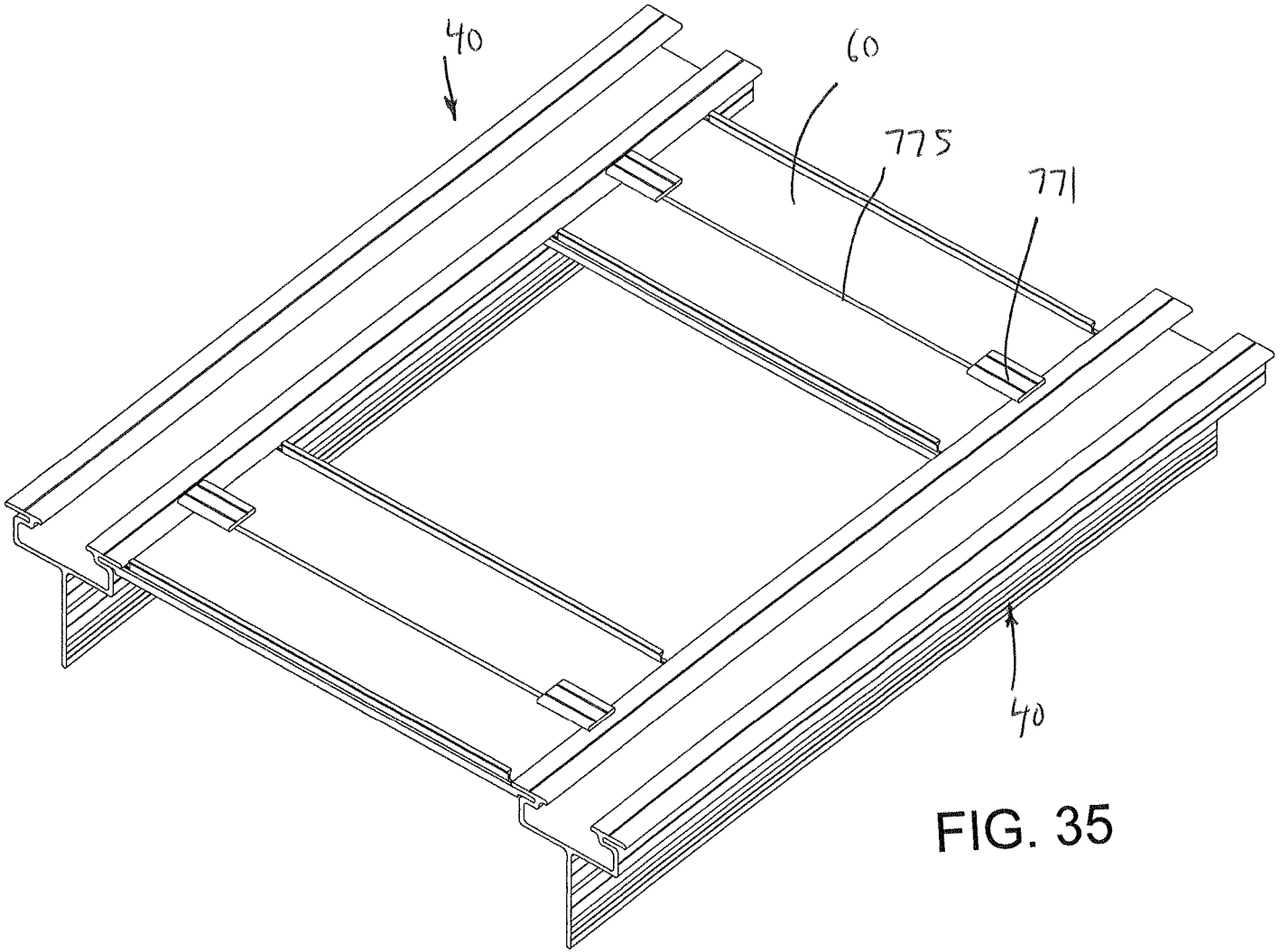
FIG. 35 is a perspective view similar to FIG. 33, with a further modified arrangement on the connecting panels for supporting wall panels.

While only one dovetail shaped slot 755 has been shown in FIG. 33, more than one dovetail shaped slot 755 can be provided, as shown in FIG. 34. Further, while dovetail shaped slots 755 has been shown in FIGS. 33 and 34 extending the first lengthwise direction, it can alternatively extend in the second transverse direction, as shown in FIG. 35.

Figure 36:
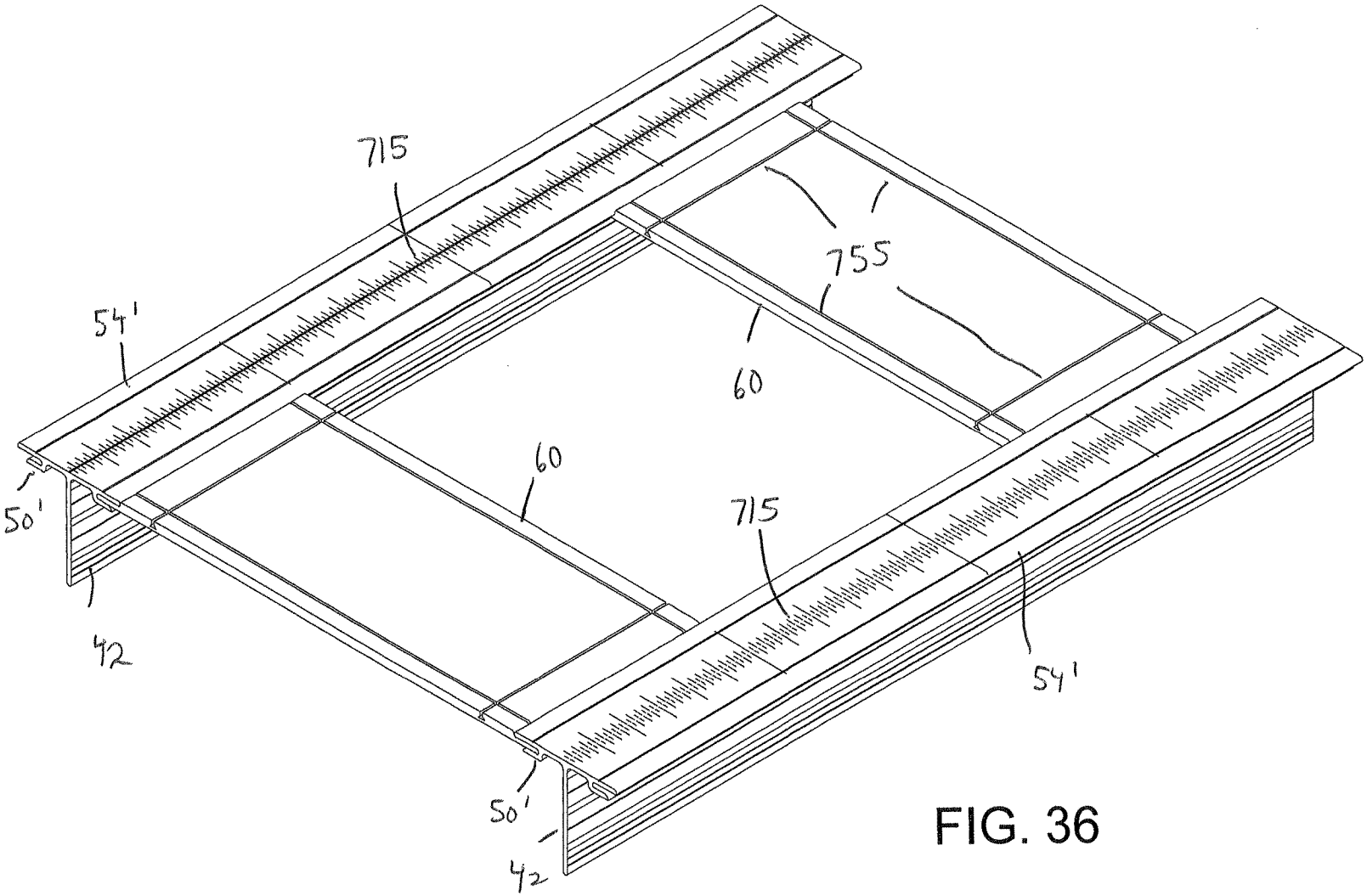
FIG. 36 is a perspective view similar to FIG. 33, with a still further modified arrangement on the connecting panels for supporting wall panels.

Still further, multiple dovetail shaped slots 755 can be provided, as shown in FIG. 36, in both the first lengthwise direction and second transverse direction. In addition, since the wall panels will be secured to rectangular securing plates 771, there is no longer a need for U-shaped track 44, and accordingly, an arrangement similar to that shown in FIG. 24 can be used, with platform wall 54' and L-shaped walls 50'. Further, measuring markings or gradations 715 are provided on the upper surface of platform wall 54'.

Figure 37:
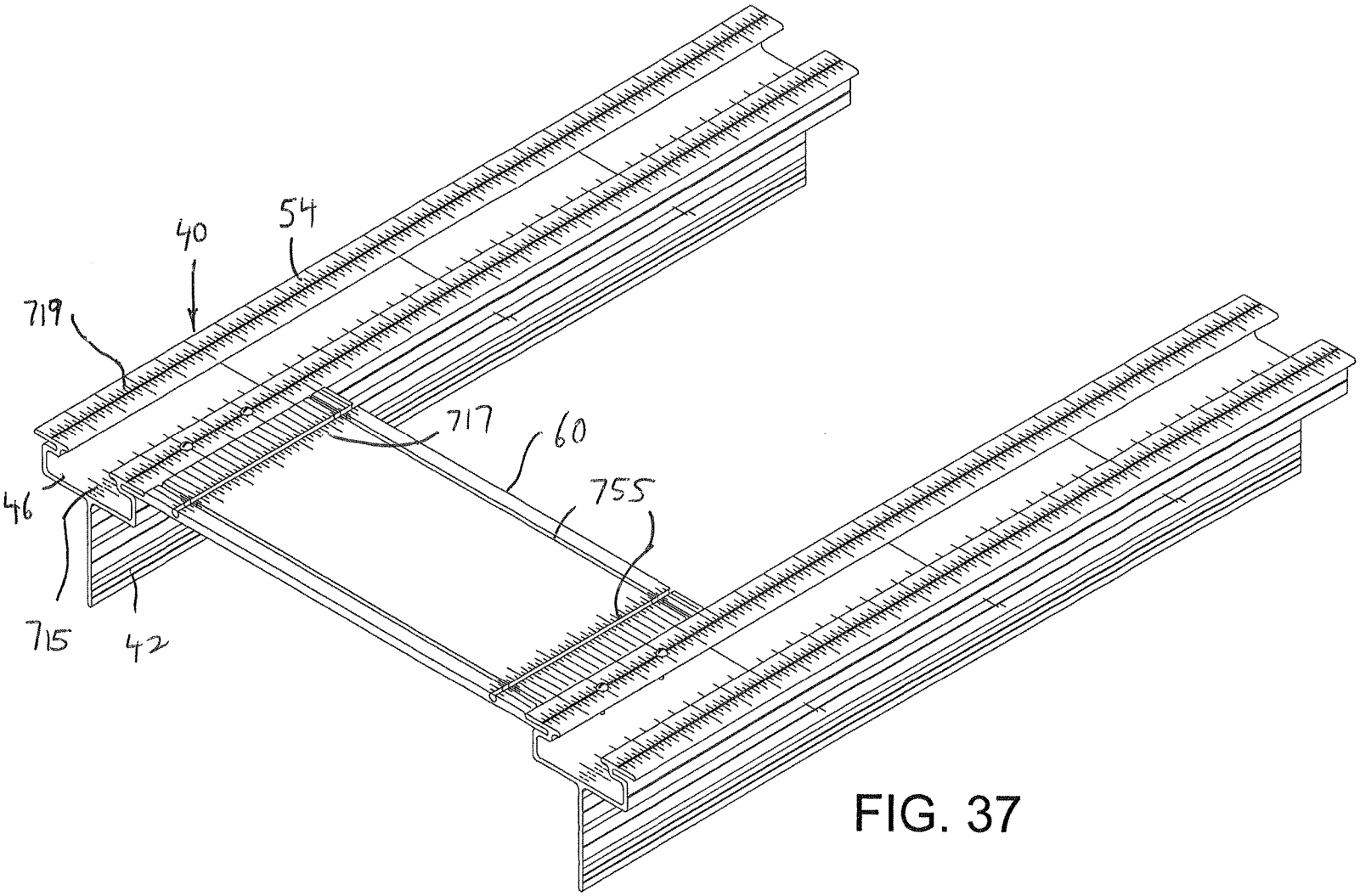
FIG. 37 is a perspective view similar to FIG. 33, with a yet further modified arrangement on the connecting panels for supporting wall panels.

FIG. 37 shows another modification in which connecting panel 60 of the type shown in FIG. 36 is connected to adjustment support members 40, with measuring markings or gradations 715, 717 and 719 provided on elongated rectangular lower plate 46, connecting plate 60 and elongated retaining walls 54, respectively.

Figure 38:
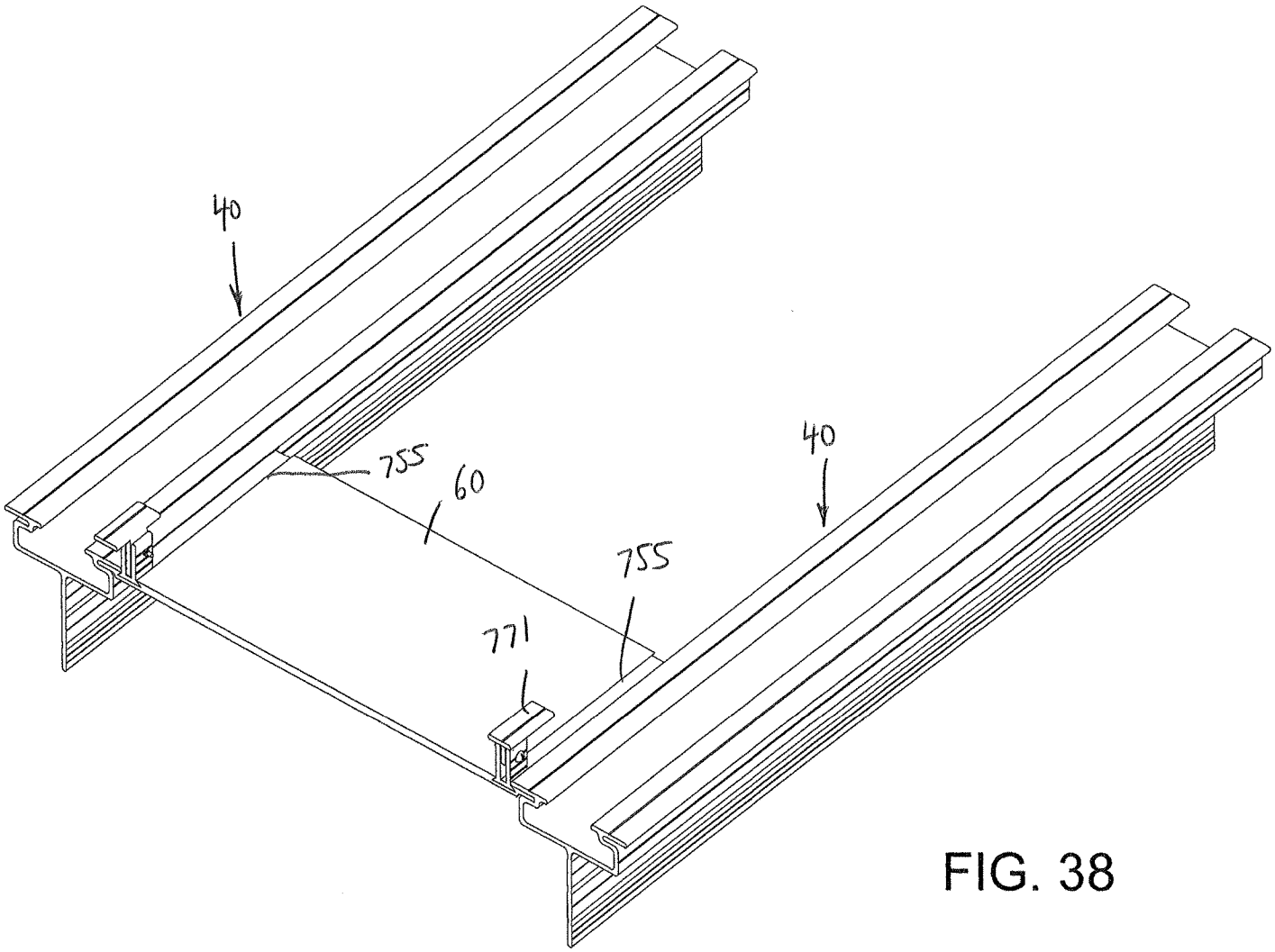
FIG. 38 is a perspective view similar to FIG. 33, with another modified arrangement on the connecting panels for supporting wall panels.

A further modification of the arrangement shown in FIG. 34 is shown in FIG. 38, in which rectangular securing plates 771 can be adjustably moved in the third orthogonal direction, in the same manner as previously described in regard to FIG. 10.

Figure 39:
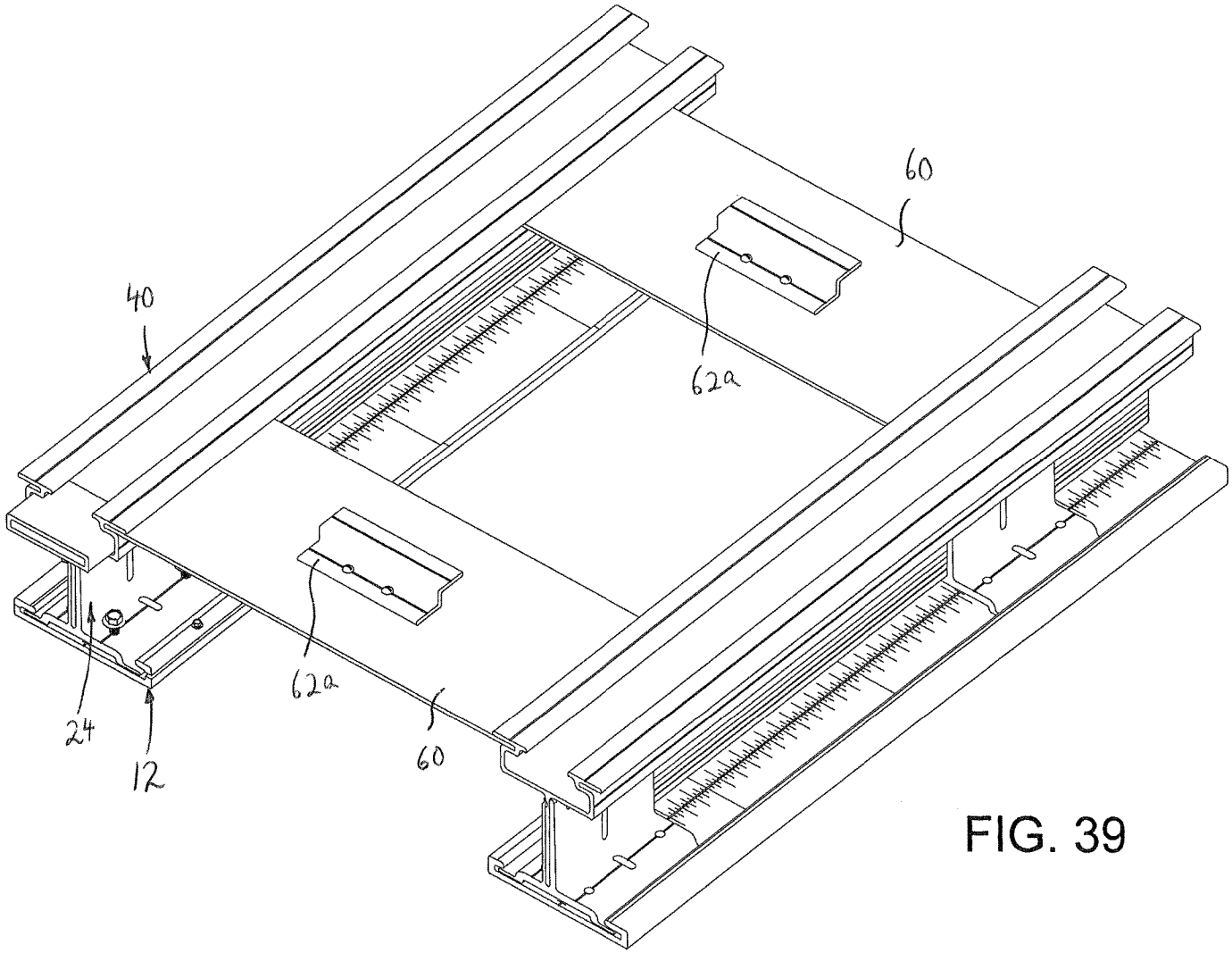
FIG. 39 is a perspective view of two adjustment support members connected together by connecting panels, with a second arrangement on the connecting panels for supporting wall panels.
Figure 40:
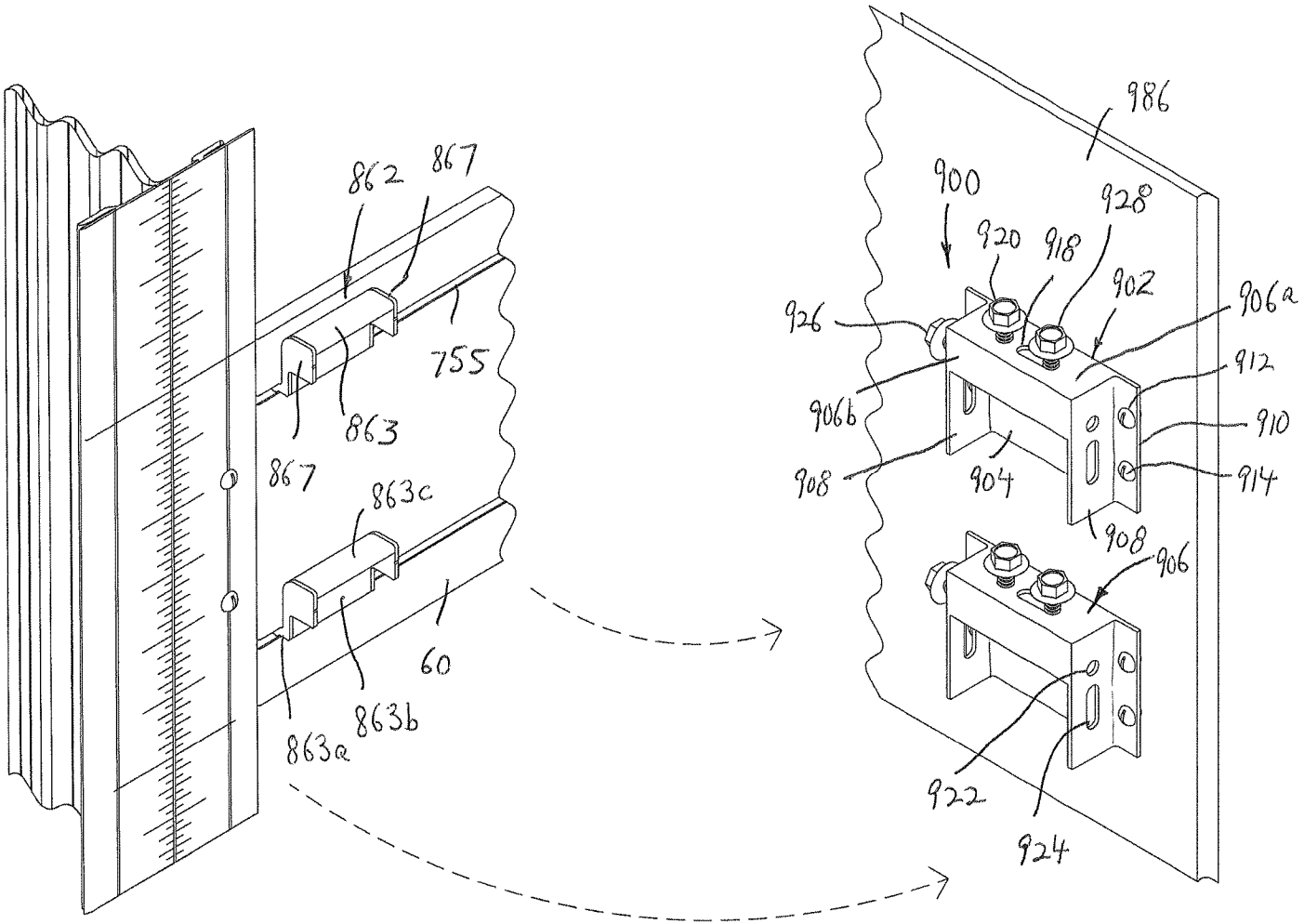
FIG. 40 is a perspective view of a portion of a modified arrangement similar to FIG. 39 for supporting wall panels according to the second arrangement
Figure 41:
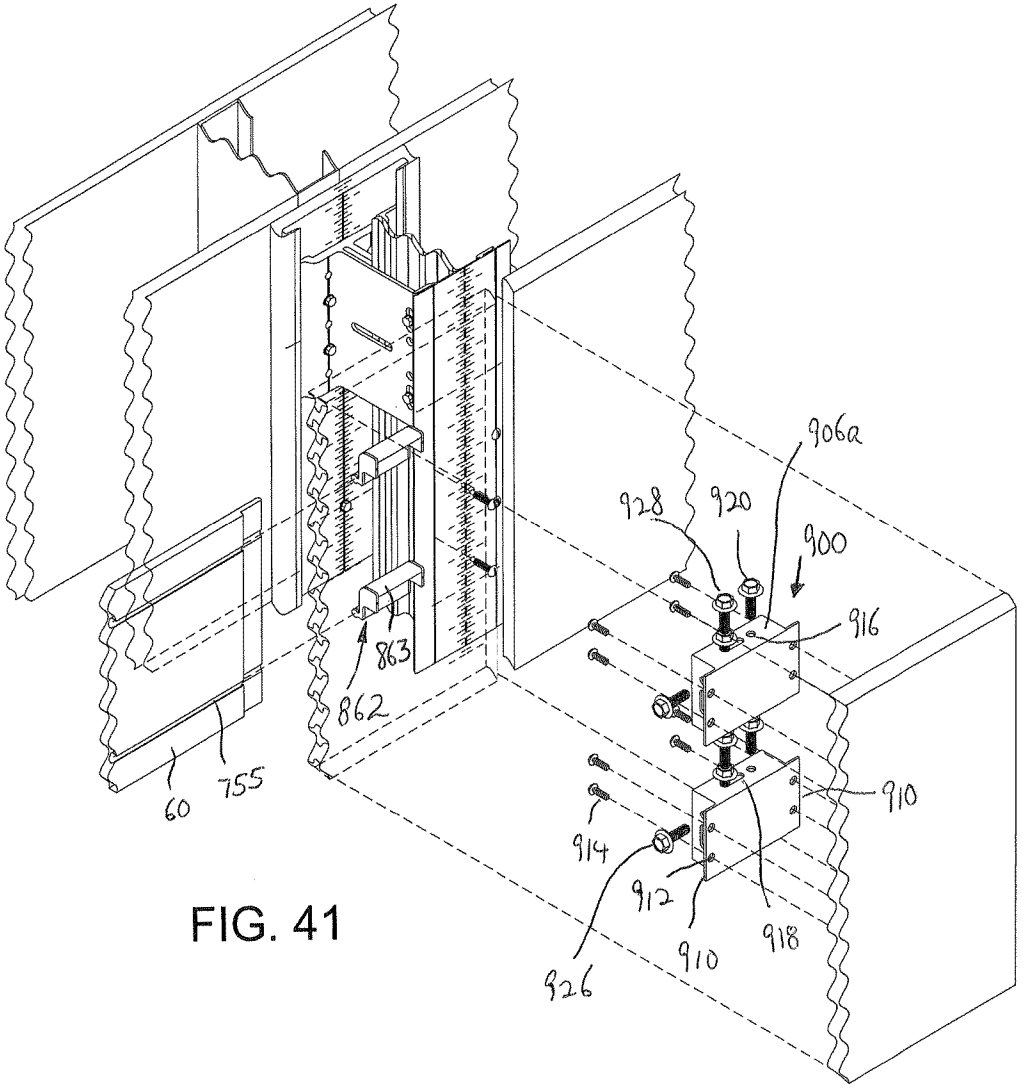
FIG. 41 is a first exploded perspective view of the arrangement of FIG. 40.
Figure 42:
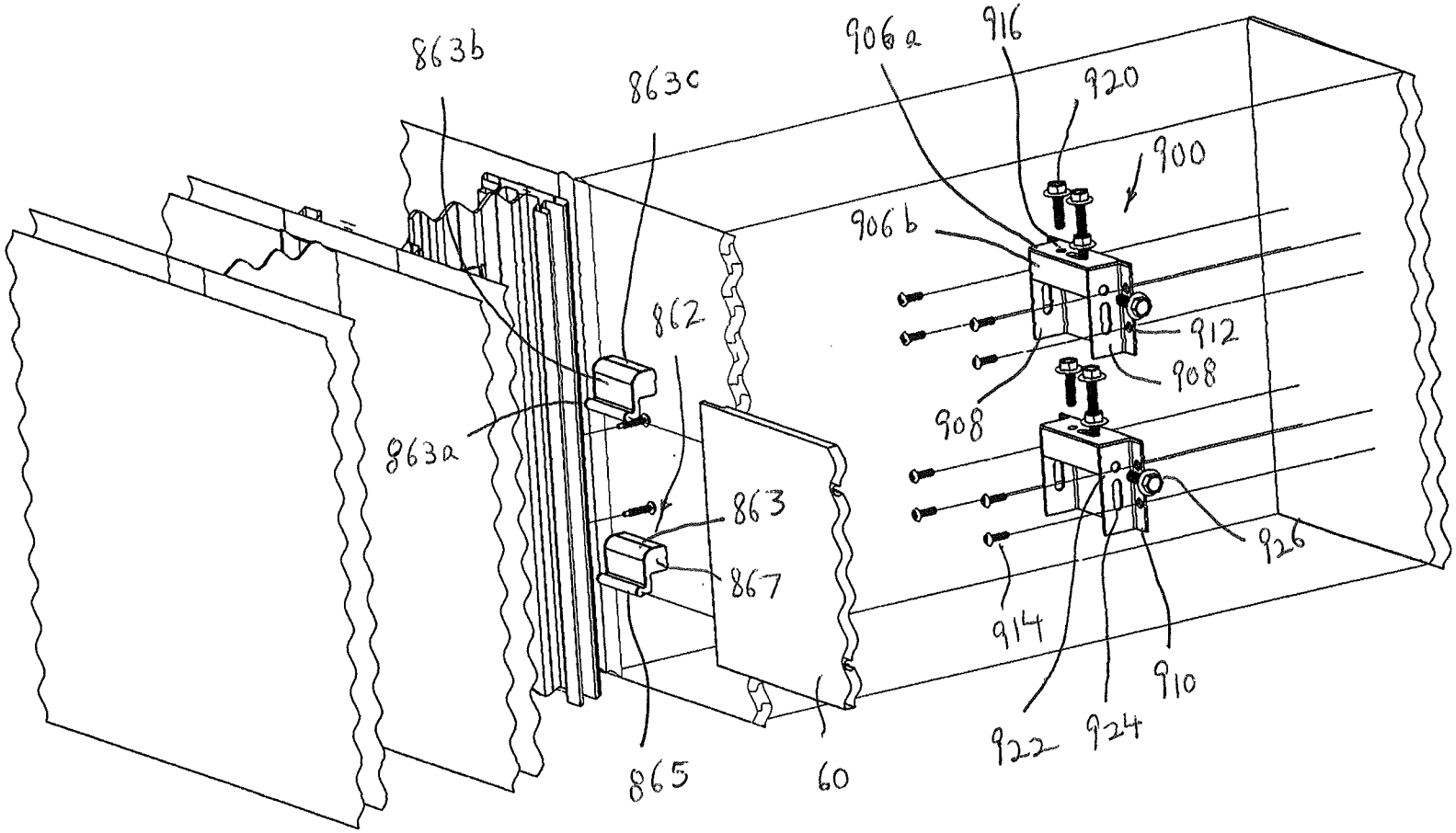
FIG. 42 is a second exploded perspective view of the arrangement of FIG. 40.
Figure 43:
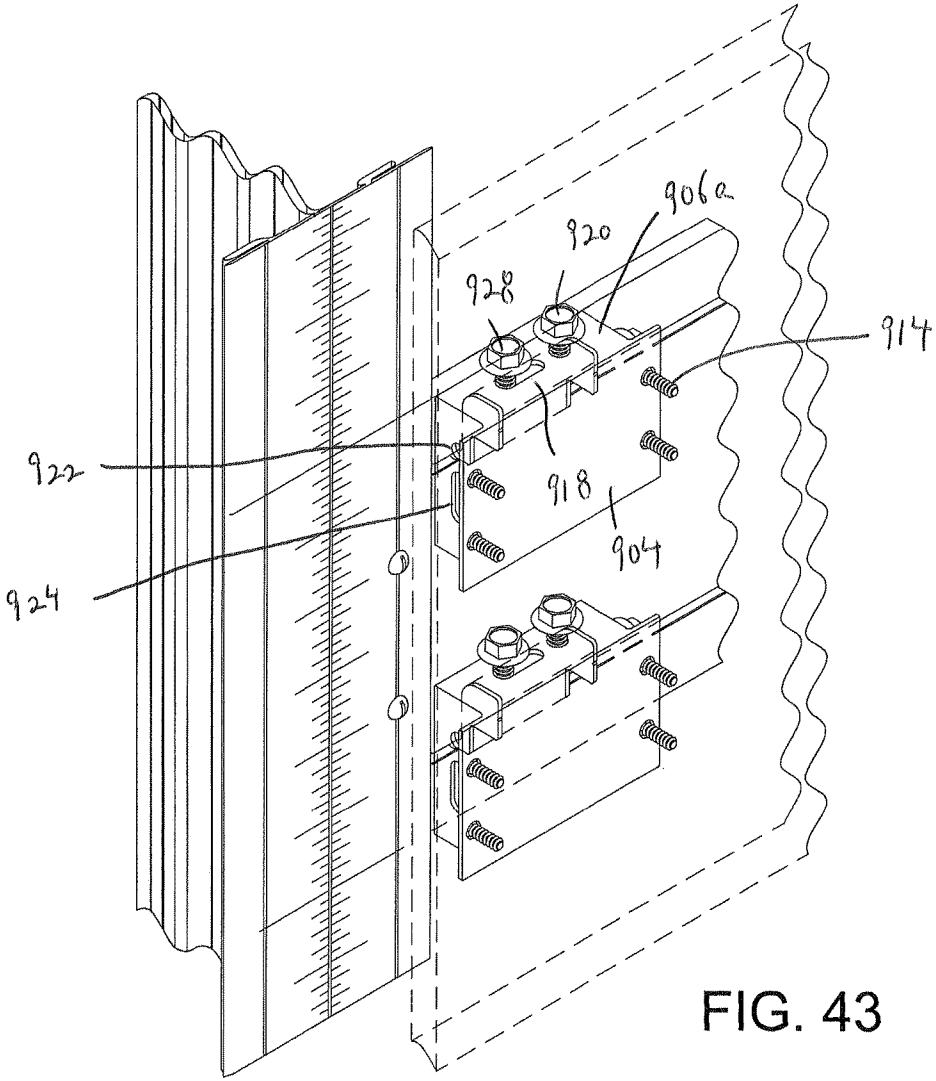
FIG. 43 is an enlarged perspective view of the portion of the modified arrangement of FIG. 40, in assembled condition.

Alternatively, instead of providing rectangular securing plates 771 with tabs 773 that fit within slots 189 in a side wall of a single panel member 188 of a wall panel 186 in order to retain wall panels 186 in position, one or more brackets can be secured on the exposed surface of each connecting panel 60, with a wall panel secured to each bracket in a hanging manner, similar to a picture frame. For example, as shown in FIG. 39, a single Z-shaped bracket **62*a* is mounted to each connecting panel 60. Similar brackets would then be provided on the rear surface of each planar wall panel for mounting the wall panel on brackets 62*a***.

In this regard, a preferred embodiment is shown in FIGS. 40-43 in which each Z-shaped bracket 862 has a Z-shaped wall 863 having one end 865 formed in a bulbous or dovetail shape for slidable insertion in a correspondingly shaped slot 755 of a connecting panel 60. Specifically, each Z-shaped wall 863 includes a first wall **863*a* having the bulbous end 865 and extending orthogonally out from the outer surface of the respective connecting panel 60, a second wall 863*b* extending orthogonally up from the free end of first wall 863*a*, and a third top wall 863*c* extending orthogonally out from the free end of second wall 863*b*. Z-shaped brackets 862 further include side walls 867** on opposite sides thereof.

Complementary hook assemblies 900 are secured to the rear surface of a planar wall panel 986 for connection with Z-shaped brackets 862. Specifically, each hook assembly 900 includes an inverted J-shaped wall 902 formed by a first rectangular wall 904 which seats flush against the rear surface of wall panel 986, and an inverted L-shaped wall 906 which extends out from the upper edge of first rectangular wall 904. L-shaped wall 906 includes a first top wall **906*a* which extends orthogonally out from the top edge of rectangular wall 904 and a downwardly extending wall 906*b* which extends down from the free edge of top wall 906*a* in parallel spaced apart relation from first wall 904. Rectangular side walls 908 are connected to and close off both sides of J-shaped wall 902. The width of rectangular wall 904 is greater than the width of J-shaped wall 902, such that rectangular wall extensions 910 extend to the sides of side walls 908, while also seating flush against the rear surface of wall panel 986. Openings 912 are provided in wall extensions 910 in order to receive screws 914 therein to secure each hook assembly 900 to the rear surface of wall panel 986**.

With this arrangement, hook assemblies 900 are positioned over Z-shaped brackets 862 for mounting wall panels 986 to connecting panel 60. In such case, top wall **906*a* seats on top wall 863*c*, and side walls 908 encompass and surround side walls 867. Further, downwardly extending wall 906*b* is positioned behind second wall 863*b* to prevent pullout of wall panels 986**.

In order to provide vertical adjustment of wall panels 986 relative to connecting panels 60, upper wall **906*a* includes a first circular threaded opening 916 and an adjacent slot 918. An adjustment bolt 920 is threaded within the threaded opening 916 and engages the upper surface of top wall 863*c*** for moving each hook assembly 900 up and down relative to the respective connecting panel 60.

In order to provide side to side adjustment of wall panels 986 relative to connecting panels 60, at least one side wall 908 includes a first circular threaded opening 922 and an adjacent slot 924. An adjustment bolt 926 is threaded within the threaded opening 922 and engages the adjacent side wall 867 for moving each hook assembly 900 side to side relative to the respective connecting panel 60.

In this regard, it will be appreciated that hook assemblies 900 are positioned near the edges of wall panel 986 in order to permit access to adjustment screws 920 and 926.

After adjustment bolts 920 and 926 have been rotated to provide adjustment of hook assemblies 900 relative to Z-shaped brackets 862, and thereby adjustment of wall panel 986 relative to the corresponding connecting panel 60, securing screws 928 which extend through slots 918 and 924 into threaded engagement with top wall 863*c* and side wall 867, respectively, are rotated to fix hook assemblies 900 relative to Z-shaped brackets 862.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

REFERENCE DESIGNATOR

10 system
12 base support
14 base plate
15 measuring gradations
16 openings
17' screws
18 L-shaped retaining wall
18*a* first wall
18*b* second wall
19' slots
20 L-shaped retaining wall
20*a* first wall
20*b* second wall
22 space
24 sliding support member
25 adjustment bolts
26 inverted U-shaped plate
26*a* upper plate
26*b* downwardly extending leg plate
26*c* downwardly extending leg plate
27*a* openings
27*b* slots
28*a* wing plate
28*b* wing plate
30 retaining wall
30*a* inwardly directed lip
32 retaining wall
34 slot
36 slot
38 circular opening
40 adjustment support member
40' adjustment support member
42 elongated rectangular plate
42' rectangular plate
44 U-shaped track
46 elongated rectangular lower plate
48 upstanding walls
50 inwardly directed walls
50' L-shaped walls
52 elongated stub wall
54 elongated retaining wall
54' platform wall
54*a* first portion
54*b* second portion
55" screws
56 elongated gap
56' elongated gap
60 connecting panels
61 rectangular parallelepiped connecting member
62*a* bracket
62*b* bracket
66 wall panel sliding supports
66' wall panel sliding supports
66" wall panel supports
68 U-shaped slide
68" U-shaped support
70 elongated rectangular lower plate
70" elongated rectangular lower plate
72 upstanding walls
72" upstanding walls
74 inwardly directed walls
76 extension walls
76' V-shaped extension walls
78 retaining wall
78" second retaining wall
79" third retaining wall
80 space
86 decorative wall panels
88 outer exposed panel section
90 inwardly extending L-shaped connecting walls
92 inwardly extending wall
94 securing wall
96 screws
98 catch walls
98" catch walls
100 outwardly facing V-shaped catch
100" outwardly facing V-shaped catch
102 cover
102' cover
104 central section
104' central section
106 capture walls
106' capture walls
108 inwardly facing V-shaped latch
108' inwardly facing V-shaped latch
115 measuring gradations
117 measuring gradations
142 second elongated rectangular plate
166 wall panel sliding supports
168 U-shaped slide
170 elongated rectangular lower plate
171 rectangular securing plate
172 upstanding walls
173 tabs
174 inwardly directed walls
175 screws
176 single extension wall
177*a* extension wall
177*b* extension wall
186 decorative wall panel
186*a* side wall
188 single panel member
189 slots
241 transverse connecting wall

242 second elongated rectangular plate
266 wall panel sliding support
271 rod
276 single extension wall
366 wall panel sliding support
367 extension wall
369 inclined wall
374 inwardly directed wall
378 retaining wall
386 wall panels
388 outer exposed panel section
389 bent end
390 inwardly extending L-shaped connecting wall
392 inwardly extending wall
394 securing wall
465 inturned lip
466 wall panel sliding support
467 extension wall
478 retaining wall
487 2×4 board
566 wall panel sliding supports
571 T-shaped wall
573 wall
575 transverse wall
575*a* first wall section
575*b* second wall section
576 extension wall
577*a* extension wall
577*b* extension wall
578 retaining wall
581 openings
585 bolt
596 screws
602 carpenter level
604 elongated rectangular parallelepiped body
606 cylindrical grasping member
608 bubble level
640 modified adjustment support member
642 screws
646 lower plate
654 retaining wall
666 modified wall panel sliding support
670 elongated rectangular lower plate
678 retaining wall
680 space
682 cover
686 planar wall panels
687 framing studs
715 measuring markings or gradations
717 measuring markings or gradations
719 measuring markings or gradations
755 dovetail shaped slot
771 rectangular securing plate
773 tabs
776 extension wall
776A dovetail shaped lower end
862 Z-shaped bracket
863 Z-shaped wall
863*a* first wall
863*b* second wall
863*c* third top wall
865 bulbous end
867 side walls
900 hook assemblies
986 planar wall panel
902 inverted J-shaped wall
904 first rectangular wall
906 L-shaped wall
906*a* first top wall
906*b* downwardly extending wall
908 side walls
910 rectangular wall extensions
912 openings
914 screws
916 first circular threaded opening
918 adjacent slot
920 adjustment bolts
922 first circular threaded opening
924 adjacent slot
926 adjustment bolts
928 securing screws

What is claimed is:

1. A system for mounting wall panels to an existing wall, comprising:

a plurality of elongated base assemblies adapted to be secured to the existing wall, each elongated base assembly including an elongated base support extending in a lengthwise direction and adapted to seat flush against and be secured to the existing wall, and a retaining arrangement extending outwardly from opposite sides of the base support;

a wall panel securement arrangement adapted to be secured to a wall panel; and an adjustment arrangement for adjustably securing the securement arrangement to the base assembly at a position with at least three degrees of freedom, the adjustment arrangement being separate and distinct from the base assembly and the wall panel securement arrangement and the adjustment arrangement being movable relative to both the base assembly and the wall panel securement arrangement;

the adjustment arrangement including a plurality of sliding members slidably positioned in each elongated base assembly for sliding movement along the elongated base support in said lengthwise direction parallel to the existing wall and slidably held to the elongated base assembly by the retaining arrangement.

2. A system for mounting wall panels to an existing wall according to claim 1, wherein the three degrees of freedom are mutually orthogonal.

3. A system for mounting wall panels to an existing wall according to claim 1, wherein the base support includes at least one opening for receiving a fastening member therethrough to secure the base support to the existing wall.

4. A system for mounting wall panels to an existing wall according to claim 1, wherein said base support includes measuring gradations thereon for correctly positioning the sliding member relative to the base support.

5. A system for mounting wall panels to an existing wall according to claim 1, wherein said sliding member is further slidably received in said base support for movement in a second transverse direction of the base support parallel to the existing wall.

6. A system for mounting wall panels to an existing wall according to claim 1, wherein:

said elongated base support includes a base plate and said retaining arrangement includes two L-shaped retaining walls extending outwardly from opposite side edges of the base plate, with said base plate being adapted to be secured to the existing wall and each L-shaped retaining wall including a first wall extending orthogonally from a side edge of the base plate and a second wall extending orthogonally inwardly from a free edge of the first wall in parallel, spaced apart relation from the base plate;

said sliding member includes:

a central member, and first and second wing members secured to opposite edges of the central member, with each wing member slidably received within a respective said L-shaped retaining wall; and a distance between opposite free edges of the two wing members is less than a distance between the first walls of the two L-shaped retaining walls to permit sliding movement of the sliding member relative to the base support in the first lengthwise direction and the second transverse direction of the base support.

7. A system for mounting wall panels to an existing wall according to claim 1, wherein:

each said sliding member includes:

a central member slidably received within said base support, and at least one capture member extending from the central member; and the adjustment arrangement further includes an adjustment positioning member movably connected to the at least one capture member for adjustably moving in a third direction orthogonal to the first lengthwise direction.

8. A system for mounting wall panels to an existing wall according to claim 7, wherein the at least one capture member is angularly adjustable relative to the central member.

9. A system for mounting wall panels to an existing wall according to claim 7, wherein the adjustment arrangement further includes an adjustment support member connected with the adjustment positioning member; and wherein the wall panel securement arrangement is engaged with the adjustment support member.

10. A system for mounting wall panels to an existing wall according to claim 9, wherein each said wall panel includes a main panel section and L-shaped connecting walls at side edges thereof, and one leg of each L-shaped connecting wall is engaged with the wall panel securement arrangement.

11. A system for mounting wall panels to an existing wall according to claim 10, wherein the wall panel securement arrangement further includes an adjusting arrangement for adjusting a position in the third direction of the at least one tab relative to the adjustment support member.

12. A system for mounting wall panels to an existing wall according to claim 9, wherein the wall panel securement arrangement includes:

a retaining wall against which an edge of a wall panel rests, and at least one of:

a tab and a rod for engaging within an opening at a side edge of the wall panel.

13. A system for mounting wall panels to an existing wall according to claim 9, wherein each wall panel securement arrangement includes:

a cover securing arrangement, and a cover adapted to be secured by the cover securing arrangement in a gap between adjacent wall panels.

14. A system for mounting wall panels to an existing wall according to claim 13, wherein the cover securing arrangement includes spaced apart catch walls extending therefrom, and each cover includes capture walls adapted to be engaged by the catch walls to hold the cover in the gap between adjacent wall panels.

15. A system for mounting wall panels to an existing wall according to claim 9, wherein the adjustment support member includes a track, and the wall panel securement arrangement includes at least one wall panel sliding support slidably received with the track and including a securement member for securing the wall panel thereto.

16. A system for mounting wall panels to an existing wall according to claim 15, wherein each wall panel sliding support includes at least one angled wall for orienting a wall panel secured to the adjustment support member in an angled, three-dimensional manner.

17. A system for mounting wall panels to an existing wall according to claim 15, wherein each wall panel sliding support includes an arrangement for holding a framing stud.

18. A system for mounting wall panels to an existing wall according to claim 15, wherein each wall panel sliding support is slidably received one of:

within and on a outside of a respective said track.

19. A system for mounting wall panels to an existing wall according to claim 9, wherein the adjustment support member includes a platform, and the wall panel securement arrangement includes at least one wall panel support mounted to the platform and including a securement member for securing the wall panel thereto.

20. A system for mounting wall panels to an existing wall according to claim 9, wherein the adjustment support member includes at least one wall panel sliding support slidably received within the base assembly, and the wall panel securing arrangement includes a portion of the base assembly and a portion of the at least one wall panel sliding support to capture a wall panel therebetween, with the base assembly adapted to be secured to the existing wall.

21. A system for mounting wall panels to an existing wall according to claim 1, wherein the wall panel securement arrangement includes:

at least one connecting panel for connecting together spaced apart adjustment arrangements, each connecting panel including at least one slot therein, and each slot being open at a side edge of the respective connecting panel, and a securing assembly mounted on the at least one connecting panel for mounting each wall panel on the at least one connecting panel, the securing assembly including at least one securing member slidably mounted in the at least one slot from said open side edge for securement to a respective said wall panel.

22. A system for mounting wall panels to an existing wall according to claim 21, wherein each securing member includes at least one of the following:

a plate and a rod for insertion within a respective opening in a wall panel.

23. A system for mounting wall panels to an existing wall according to claim 21, wherein an upper surface of each connecting panel is flush with an upper surface of each adjusting arrangement.

24. A system for mounting wall panels to an existing wall according to claim 1, further comprising a level measuring device adapted to be connected with at least one of the wall panel securement arrangement and the adjustment arrangement.

25. A system for mounting wall panels to an existing wall according to claim 1, further comprising measuring gradations on at least one of the base assembly, wall panel securement arrangement and adjustment arrangement.

26. A system for mounting wall panels to an existing wall, comprising:

a base assembly adapted to be secured to the existing wall, said base assembly including a base support, said base support includes a base plate and two L-shaped retaining walls extending outwardly from opposite side edges of the base plate, with said base plate being adapted to be secured to the existing wall and each L-shaped retaining wall including a first wall extending orthogonally from a side edge of the base plate and a second wall extending orthogonally inwardly from a free edge of the first wall in parallel, spaced apart relation from the base plate;

a wall panel securement arrangement adapted to be secured to a wall panel; and an adjustment arrangement for adjustably securing the securement arrangement to the base assembly at a position with at least one degree of freedom, the adjustment arrangement including a sliding member slidably received in said base support for movement in a first lengthwise direction of the base support, said sliding member including:

a central member including at least one threaded opening for receiving an adjusting member therethrough to adjust a distance of the sliding member relative to the base support in a third direction which is orthogonal to the first lengthwise direction and second transverse direction, and first and second wing members secured to opposite edges of the central member, with each wing member slidably received within a respective said L-shaped retaining wall; and a distance between opposite free edges of the two wing members is less than a distance between the first walls of the two L-shaped retaining walls to permit sliding movement of the sliding member relative to the base support in the first lengthwise direction and the second transverse direction of the base support.

27. A system for mounting wall panels to an existing wall according to claim 26, wherein the central member further includes at least one opening for receiving a fastening member therethrough to secure the sliding member to the base support.

28. A system for mounting wall panels to an existing wall, comprising:

a base assembly adapted to be secured to the existing wall, said base assembly including a base support;

a wall panel securement arrangement adapted to be secured to a wall panel; and an adjustment arrangement for adjustably securing the securement arrangement to the base assembly at a position with at least one degree of freedom, the adjustment arrangement including:

a sliding member slidably received in said base support for movement in a first lengthwise direction of the base support, said sliding member including:

a central member slidably received within said base support, and at least one capture member extending from the central member, and said at least one capture member includes two parallel, spaced apart capture walls extending from said central member; and an adjustment positioning member adjustably connected to the at least one capture member for adjustably moving in a third direction orthogonal to the first lengthwise direction, and the adjustment positioning member includes an adjustment plate positioned adjustably between the capture walls in at least an adjustment direction orthogonal to the first lengthwise direction such that at least one securing member is adapted to be secured through the adjustment plate and at least one of the capture walls for securing the adjustment plate to the capture walls.

29. A system for mounting wall panels to an existing wall according to claim 28, wherein said sliding member is further slidably received in said base support for movement in a transverse direction of the base support, said transverse direction being orthogonal to said first lengthwise direction and said adjustment direction.

30. A system for mounting wall panels to an existing wall according to claim 29, wherein at least one of:

the adjustment plate, and at least one said capture wall, includes at least one opening therein for receiving said at least one securing member.

31. A system for mounting wall panels to an existing wall, comprising:

a base assembly adapted to be secured to the existing wall;

a wall panel securement arrangement adapted to be secured to a wall panel; and an adjustment arrangement for adjustably securing the securement arrangement to the base assembly at a position with at least two degrees of freedom, the adjustment arrangement being separate and distinct from the base assembly and the wall panel securement arrangement and the adjustment arrangement being movable relative to both the base assembly and the wall panel securement arrangement;

wherein the wall panel securement arrangement includes:

at least one connecting panel for connecting together spaced apart adjustment arrangements, and a securing assembly mounted on the at least one connecting panel for mounting each wall panel on the at least one connecting panel; and wherein the securing assembly includes:

at least one bracket member mounted to each connecting panel, and at least one hook member mounted to a rear surface of each wall panel, with each hook member adapted to engage one bracket member for mounting each wall panel to the connecting panels.

32. A system for mounting wall panels to an existing wall according to claim 31, further including an adjustment arrangement for adjusting a position of each hook member relative to a respective said bracket member on which the hook member is mounted.

33. A system for mounting wall panels to an existing wall according to claim 32, wherein the adjustment arrangement includes at least one adjusting bolt threadedly engaged through each hook member for engagement with a respective said bracket member.

34. A system for mounting wall panels to an existing wall, comprising:

a base assembly adapted to be secured to the existing wall;

a wall panel securement arrangement adapted to be secured to a wall panel; and an adjustment arrangement for adjustably securing the securement arrangement to the base assembly at a position with at least one degree of freedom;

wherein the wall panel securement arrangement includes:

at least one connecting panel for connecting together spaced apart adjustment arrangements, and a securing assembly mounted on the at least one connecting panel for mounting each wall panel on the at least one connecting panel, wherein the securing assembly includes:

at least one bracket member mounted to each connecting panel, and at least one hook member mounted to each wall panel, with each hook member adapted to engage one bracket member for mounting each wall panel to the connecting panels;

an adjustment arrangement for adjusting a position of each hook member relative to a respective said bracket member on which the hook member is mounted, wherein the adjustment arrangement includes at least one adjusting bolt threadedly engaged through each hook member for engagement with a respective said bracket member, wherein the at least one adjusting bolt includes two adjusting bolts threadedly engaged through each hook member in mutually orthogonal directions for engagement with a respective said bracket member for adjusting a position of the respective hook member relative to the bracket member in said mutually orthogonal directions.

* * * * *